US010398959B2

(12) United States Patent
Hall

(10) Patent No.: US 10,398,959 B2
(45) Date of Patent: Sep. 3, 2019

(54) MULTI-HEAD, MULTI-ABDOMEN, MULTI-ARMED APPARATUS FOR USE WITH A SLIP AND COUNTER FIGHT SIMULATION / WORKOUT MACHINE OR STAND ALONE DEVICE FOR FIGHT SIMULATION

(71) Applicant: Clarence V. Hall, Plainfield, NJ (US)

(72) Inventor: Clarence V. Hall, Plainfield, NJ (US)

( * ) Notice: Subject to any disclaimer, the term of this patent is extended or adjusted under 35 U.S.C. 154(b) by 322 days.

(21) Appl. No.: 15/373,974

(22) Filed: Dec. 9, 2016

(65) Prior Publication Data

US 2017/0095719 A1 Apr. 6, 2017

Related U.S. Application Data

(63) Continuation-in-part of application No. 13/999,772, filed on Mar. 20, 2014, now Pat. No. 9,821,208,
(Continued)

(51) Int. Cl.
*A63B 69/34* (2006.01)
*A63B 24/00* (2006.01)
(Continued)

(52) U.S. Cl.
CPC ..... *A63B 69/34* (2013.01); *A63B 24/0087* (2013.01); *A63B 69/004* (2013.01);
(Continued)

(58) Field of Classification Search
CPC ..... A63B 69/004; A63B 69/0051; A63B 69/0053; A63B 69/20; A63B 69/201;
(Continued)

(56) References Cited

U.S. PATENT DOCUMENTS 835,796 A 11/1906 Lindsley
1,685,495 A * 9/1928 Latz ..... A63B 69/206 223/67

(Continued)

FOREIGN PATENT DOCUMENTS

EP 0557264 A2 8/1993 ..... A63B 69/34
WO WO 2012089194 7/2012 ..... A63B 69/201

OTHER PUBLICATIONS

"Cardio Exercise Equipment" found at http://www.dailymotion.com/video/xc2rtn_cardio-exercise-equipment-cardio-bo_sport.

(Continued)

*Primary Examiner* — Joshua Lee
(74) *Attorney, Agent, or Firm* — Ernest D. Buff & Associates, LLC; Ernest D. Buff; Margaret A. LaCroix

(57) ABSTRACT

A free standing fight simulation workout machine with a fight simulation multi-headed, multi-abdomen, multi-armed apparatus is adapted to be used in conjunction with a slip and counter fight simulation apparatus or stand alone apparatus. The fight simulation multi-headed, multi-abdomen, multi-armed apparatus includes a multi-headed member having at least one head attached to at least one abdomen and at least one arm having a glove appending member. Preferably, multiple heads are attached to multiple abdomens with multiple arm pairs to provide different punch configurations for the user to strike at. The multi-headed, multi-abdomen, multi-armed provides various angles adapted for a user to punch, knee, and/or do a flying knee.

32 Claims, 34 Drawing Sheets

Related U.S. Application Data which is a continuation-in-part of application No. 13/781,594, filed on Feb. 28, 2013, now Pat. No. 9,050,518, which is a continuation-in-part of application No. 13/385,703, filed on Mar. 2, 2012, now Pat. No. 9,044,659.

(51) Int. Cl.

| | |
|---|---|
| ***A63B 69/00*** | (2006.01) |
| ***A63B 69/20*** | (2006.01) |
| *A63B 21/005* | (2006.01) |
| *A63B 21/008* | (2006.01) |
| *A63B 21/06* | (2006.01) |
| *A63B 21/00* | (2006.01) |
| *A63B 71/00* | (2006.01) |
| *A63B 71/02* | (2006.01) |

(52) U.S. Cl.

CPC ..... *A63B 69/0053* (2013.01); *A63B 69/203* (2013.01); *A63B 69/206* (2013.01); *A63B 69/208* (2013.01); *A63B 21/008* (2013.01); *A63B 21/0058* (2013.01); *A63B 21/0602* (2013.01); *A63B 21/0603* (2013.01); *A63B 21/151* (2013.01); *A63B 69/201* (2013.01); *A63B 2071/0081* (2013.01); *A63B 2071/025* (2013.01); *A63B 2071/027* (2013.01); *A63B 2210/50* (2013.01); *A63B 2220/801* (2013.01); *A63B 2220/803* (2013.01); *A63B 2225/09* (2013.01); *A63B 2225/093* (2013.01); *A63B 2225/10* (2013.01); *A63B 2225/20* (2013.01); *A63B 2244/102* (2013.01); *A63B 2244/106* (2013.01)

(58) Field of Classification Search

CPC ... A63B 69/203; A63B 69/205; A63B 69/206; A63B 69/208; A63B 69/24; A63B 69/32; A63B 69/34; A63B 69/345; A63B 2069/0044; A63B 2244/10; A63B 2244/102; A63B 2244/104; A63B 2244/106; A63B 2244/108; A63B 21/008; A63B 24/00; A63B 2071/025–2071/026; A63B 2210/50; A63B 2220/801; A63B 2220/803; A63B 2225/09; A63B 2225/093; A63B 2225/10; A63B 2225/50

See application file for complete search history.

(56) References Cited

U.S. PATENT DOCUMENTS

| | | | | | |
|---|---|---|---|---|---|
| 2,909,370 | A | | 10/1959 | Fortney | 482/83 |
| 3,250,533 | A | | 5/1966 | Nicholson | 482/83 |
| 3,804,406 | A | * | 4/1974 | Viscione | A63B 69/004 273/454 |
| 4,088,315 | A | * | 5/1978 | Schemmel | A63B 69/34 482/4 |
| 4,353,545 | A | * | 10/1982 | Anderson | A63B 69/0053 273/440 |
| 4,434,980 | A | * | 3/1984 | Babineaux | A63B 69/20 482/86 |
| 4,491,324 | A | | 1/1985 | Yoshida | 463/8 |
| 4,593,900 | A | * | 6/1986 | Burke | A63B 69/34 482/83 |
| 4,765,609 | A | | 8/1988 | Wilson et al. | 482/83 |
| 4,819,934 | A | | 4/1989 | Wilson et al. | 482/83 |
| 5,052,683 | A | | 10/1991 | Wang et al. | 482/7 |
| 5,100,138 | A | | 3/1992 | Wilde | 273/440.1 |
| 5,221,243 | A | * | 6/1993 | Walker | A63B 69/004 482/83 |
| 5,256,069 | A | * | 10/1993 | Snowden, Jr. | A63B 69/34 434/247 |
| 5,281,191 | A | | 1/1994 | De Sousa | 482/83 |
| 5,352,170 | A | * | 10/1994 | Condo | A63B 69/201 482/83 |
| 5,419,749 | A | | 5/1995 | Morgenstein | 482/99 |
| 5,613,925 | A | * | 3/1997 | Miasserian | A63B 69/0053 482/83 |
| 5,700,230 | A | * | 12/1997 | Cardona | A63B 69/34 482/83 |
| 5,735,775 | A | | 4/1998 | Miasserian | 482/83 |
| 5,803,877 | A | | 9/1998 | Franey | 482/83 |
| 5,863,278 | A | * | 1/1999 | Chen | A63B 69/20 482/83 |
| 5,888,152 | A | * | 3/1999 | Rogers | A63B 69/345 473/440 |
| 6,063,011 | A | * | 5/2000 | Pelchat | A63B 69/004 482/83 |
| 6,110,079 | A | * | 8/2000 | Luedke | A63B 24/0062 446/268 |
| 6,152,863 | A | * | 11/2000 | Nelson | A63B 69/004 482/83 |
| 6,165,068 | A | | 12/2000 | Sonoda et al. | 463/8 |
| 6,336,891 | B1 | | 1/2002 | Fedrigon et al. | 482/8 |
| 6,416,445 | B1 | | 7/2002 | Nelson et al. | 482/83 |
| 6,432,027 | B1 | * | 8/2002 | Haselrig | A63B 69/201 482/83 |
| 6,685,581 | B2 | | 2/2004 | Krause et al. | 473/445 |
| 6,896,630 | B1 | | 5/2005 | Breinning | 473/422 |
| 6,994,349 | B2 | * | 2/2006 | Lambert | F41J 7/04 273/392 |
| 7,041,039 | B2 | | 5/2006 | Wang et al. | 482/87 |
| 7,329,210 | B1 | * | 2/2008 | Marano | A63B 69/004 482/83 |
| 7,371,164 | B2 | | 4/2008 | Ueshima | 463/8 |
| 7,678,028 | B1 | * | 3/2010 | Gore | A63B 69/004 482/86 |
| 7,789,810 | B2 | | 9/2010 | Le | 482/83 |
| 7,828,701 | B1 | * | 11/2010 | Chen | A63B 69/004 482/83 |
| 7,862,485 | B2 | * | 1/2011 | Luigi | A63B 69/004 482/83 |
| 7,998,035 | B2 | * | 8/2011 | Chen | A63B 69/208 482/83 |
| 8,025,612 | B1 | | 9/2011 | Buzzanco et al. | 482/83 |
| 8,079,938 | B2 | | 12/2011 | Jones et al. | 482/8 |
| 8,298,124 | B2 | * | 10/2012 | Brenner | A63B 69/34 482/83 |
| 8,348,815 | B2 | * | 1/2013 | Signorino | A63B 69/20 482/4 |
| 8,617,034 | B2 | * | 12/2013 | Eem | A63B 69/203 482/83 |
| 8,777,818 | B1 | * | 7/2014 | Tate, Jr. | A63B 69/004 482/83 |
| 2002/0193211 | A1 | * | 12/2002 | Kao | A63B 69/34 482/83 |
| 2003/0073548 | A1 | * | 4/2003 | Haselrig | A63B 69/201 482/83 |
| 2003/0125168 | A1 | * | 7/2003 | Hackaday | A63B 69/206 482/89 |
| 2004/0248633 | A1 | * | 12/2004 | Trawick | A63B 69/34 463/8 |
| 2006/0252608 | A1 | | 11/2006 | Kang et al. | 482/84 |
| 2006/0258515 | A1 | | 11/2006 | Kang et al. | 482/83 |
| 2007/0183829 | A1 | * | 8/2007 | Dickson | A63B 69/004 400/273 |
| 2008/0008984 | A1 | * | 1/2008 | McDonald | A63B 69/004 434/247 |
| 2008/0076636 | A1 | * | 3/2008 | Smith | A63B 69/004 482/1 |
| 2008/0119335 | A1 | * | 5/2008 | Luigi | A63B 69/20 482/89 |
| 2009/0264264 | A1 | * | 10/2009 | Reen | A63B 69/004 482/86 |
| 2010/0179031 | A1 | | 7/2010 | Luigi | 482/89 |

(56) References Cited

U.S. PATENT DOCUMENTS

| | | | | |
|---|---|---|---|---|
| 2011/0059827 | A1* | 3/2011 | Fazio | A63B 69/34 482/83 |
| 2011/0067521 | A1 | 3/2011 | Linn et al. | 74/490.06 |
| 2011/0264266 | A1 | 10/2011 | Kock | 700/253 |
| 2011/0295399 | A1 | 12/2011 | Plociennik et al. | 700/97 |
| 2012/0065032 | A1* | 3/2012 | Jang, II | A63B 24/0062 482/83 |
| 2012/0108394 | A1 | 5/2012 | Jones et al. | 482/8 |
| 2012/0214648 | A1* | 8/2012 | Schlicher | A63B 69/203 482/87 |
| 2012/0252637 | A1* | 10/2012 | Pellot | A63B 69/20 482/89 |
| 2013/0065731 | A1 | 3/2013 | Jones et al. | 482/8 |
| 2013/0065735 | A1* | 3/2013 | Conarty | A63B 69/20 482/89 |
| 2014/0039680 | A1 | 2/2014 | Angie et al. | 700/259 |
| 2015/0018174 | A1* | 1/2015 | Partlo | A63B 69/201 482/87 |

OTHER PUBLICATIONS

"Don King Boxing game Wii" found at http://www.gamespot.com/wii/sports/don-king-boxing/index.html.

* cited by examiner

Right Uppercut Arm

MULTI-HEAD, MULTI-ABDOMEN, MULTI-ARMED APPARATUS FOR USE WITH A SLIP AND COUNTER FIGHT SIMULATION / WORKOUT MACHINE OR STAND ALONE DEVICE FOR FIGHT SIMULATION

This is a Continuation-In-Part of U.S. application Ser. No. 13/999,772, filed Mar. 20, 2014 for "Multi-Headed, Multi-Abdomen, Multi-Armed Apparatus For Use With A Slip And Counter Fight Simulation/Workout Machine Or Stand Alone Device For Fight Simulation" which, in turn, is a Continuation-In-Part of U.S. application Ser. No. 13/781,594, now U.S. Pat. No. 9,050,518, filed Feb. 28, 2013 for "Slip And Counter Fight Simulation/Workout Machine" which, in turn, is a Continuation-In-Part of U.S. application Ser. No. 13/385,703, now U.S. Pat. No. 9,044,659, filed Mar. 2, 2012 for "Slip And Counter Fight Simulation/Workout Machine", the disclosures of which are hereby incorporated in their entirety by reference thereto.

BACKGROUND OF THE INVENTION

1. Field of the Invention

The present invention relates to sports training devices; and, more particularly, to a slip and counter fight simulation and workout machine that promotes physical fitness, and provides fight training and/or fight simulations.

2. Description of the Prior Art

Boxing, fighting and karate arts involve martial training for sport, self-defense, and/or physical fitness. Kick-boxing and boxing have gained more popularity in the past several years owing to physical fitness and weight loss benefits imparted through the discipline. Increasingly, people of all ages are discovering the benefits derived from boxing or fighting, or self-defense training when developing self-protection skills.

Often in sports training, exercising and self-defense instruction for an individual utilizes a punching bag or the like to practice punching and/or kicking. However, in this manner the individual is generally the sole participant and does not have to return punches or kicks. Although the use of a punching bag or punching device provides a good work-out, the device does not provide any skill teaching methods for knocking-out an adversary, or for dodging or defending against punches or kicks.

Another form of training in sport boxing, exercising and/or self-defense instruction involves a close contact sport wherein two individuals in a ring participate in a sparring match. While highly effective, there can be problems with finding a sparring partner and particularly, finding a sparring partner having a complementing skill level. Moreover, the actual person to person contact can sometime result in injuries.

Various devices have been heretofore disclosed and utilized for providing fight/boxing training and/or workouts. A number of devices generally include a boxing dummy, full body devices simulating a person, or sparing device, wherein a right and left arm with gloves are extended from a torso and some sort of mechanism is provided so that the arms move outwardly and upwardly if at all. Generally, only two arms are provided. As a result the mechanism can only deliver a very limited type of punch and punching range. Even where more than one type of arm is provided, the arms have a very limited range of motion and cannot be adjusted to accommodate specific needs of a plethora of individuals.

There remains a need in the art for an exercise apparatus that incorporates boxing and kick-boxing fitness features, and comprises a plurality of moving arms spaced at intervals that deliver different punches and/or defensive moves. Further, there exists a need in the art for an exercise fight simulation apparatus that can be adjusted to meet specific training and fitness needs of each individual.

SUMMARY OF THE INVENTION

The present invention is directed to a multi-headed, multi-abdomen, multi-armed member for use with a slip and counter fight simulation/workout machine or stand-alone device for fight simulation. The present invention is also directed to a free standing fight simulation workout machine with a fight simulation multi-headed, multi-abdomen, multi-armed apparatus.

One aspect of the invention provides a free standing fight simulation workout machine with a fight simulation multi-headed, multi-abdomen, multi-armed apparatus having at least one main support pole structure having a mounting means for attaching a first s-hook thereto supported by a base pole support portion supporting the height adjustable main support structure. A multi-headed member is provided having at least one head having a mating s-hook adapted to be removably attached on the first s-hook of the main support structure. The free standing fight simulation also includes an interchangeable member removably attached to and being located in-line with and under the multi-headed member. At least one pair or set of height-adjustable arms are located on the base pole support portion, the base pole support portion comprises slots therein and the height-adjustable arms are capable of being inserted into the slots for height adjustment. A base in-line with and under the interchangeable member is provided. The simulation workout machine also includes a base platform having a plurality of omni-directionally rotating wheels adapted to provide movement, and a wheel lock function adapted to lock the wheels in place to make the base platform stationary. The base rests upon the base platform. The head and arms are arranged to provide different punch configurations, so that the multi-head member provides various angles adapted for a user to punch, knee, and/or do a flying knee and the apparatus presents at least two fighting stances. Preferably, the fighting stances include one or more boxing, muay thai, wing chun and/or wresting stances.

In another aspect of the invention the free standing fight simulation workout machine can be disassembled, wherein said interchangeable member, base and base platform are removable from said free standing fight simulation workout machine to provide a separate free standing apparatus, wherein said interchangeable member comprises a kicking bag.

Yet, in another aspect of the invention the free standing fight simulation workout machine further comprises a slip and counter workout machine comprising at least two substantially parallel opposing side walls and wherein said multi-headed, multi-abdomen, multi-armed apparatus is centered in said slip and counter workout machine. The slip and counter machine comprises a fight simulation apparatus that incorporates boxing and kick-boxing fitness features. A plurality of moving arms spaced at intervals deliver different punches and/or defensive moves. The slip and counter machine incorporates a fight simulation apparatus that is readily adjusted to meet specific training and fitness needs of each individual. Usage of the fight simulation apparatus spans substantially the entire range from novice to pro; is particularly well suited for educating, training and/or challenging users. Specific applications also include assisting individuals during training for self-defense, so that the trainee becomes empowered to protect himself/herself.

The fight simulation/workout machine includes a) at least two side walls, b) each side may include at least one, preferably at least two, height-adjustable arms traversing slots, c) a glove appendage member (most preferably Jumbo gloves) being located on a proximate end of each of said arms, d) at least one counter area/counter element, and e) the arms being located on the side walls and arranged in a manner as to provide different punch configurations, including hook punches, straight punches or uppercuts and uppercut type punches, respectively. Further embodiments of the fight simulation/workout machine include the construction of the glove appendage member that is removable and composed of different grade materials/softness (i.e. pillow soft, soft, medium); configuration of the arms: with a first and third arm including an elbow joint, and the second/middle arm being straight; configuration of the counter area/element, and preferably presentation of at least two counter areas/elements, including a head counter area/element and a mid/stomach counter area/element; and specific elements concerning the control and activation of the machine (i.e. sensor, on/off switch, and the like).

BRIEF DESCRIPTION OF DRAWINGS

The invention will be more fully understood and further advantages will become apparent when reference is had to the following detailed description and the accompanying drawings, in which.

DESCRIPTION OF THE PREFERRED EMBODIMENTS

Figure 1A:
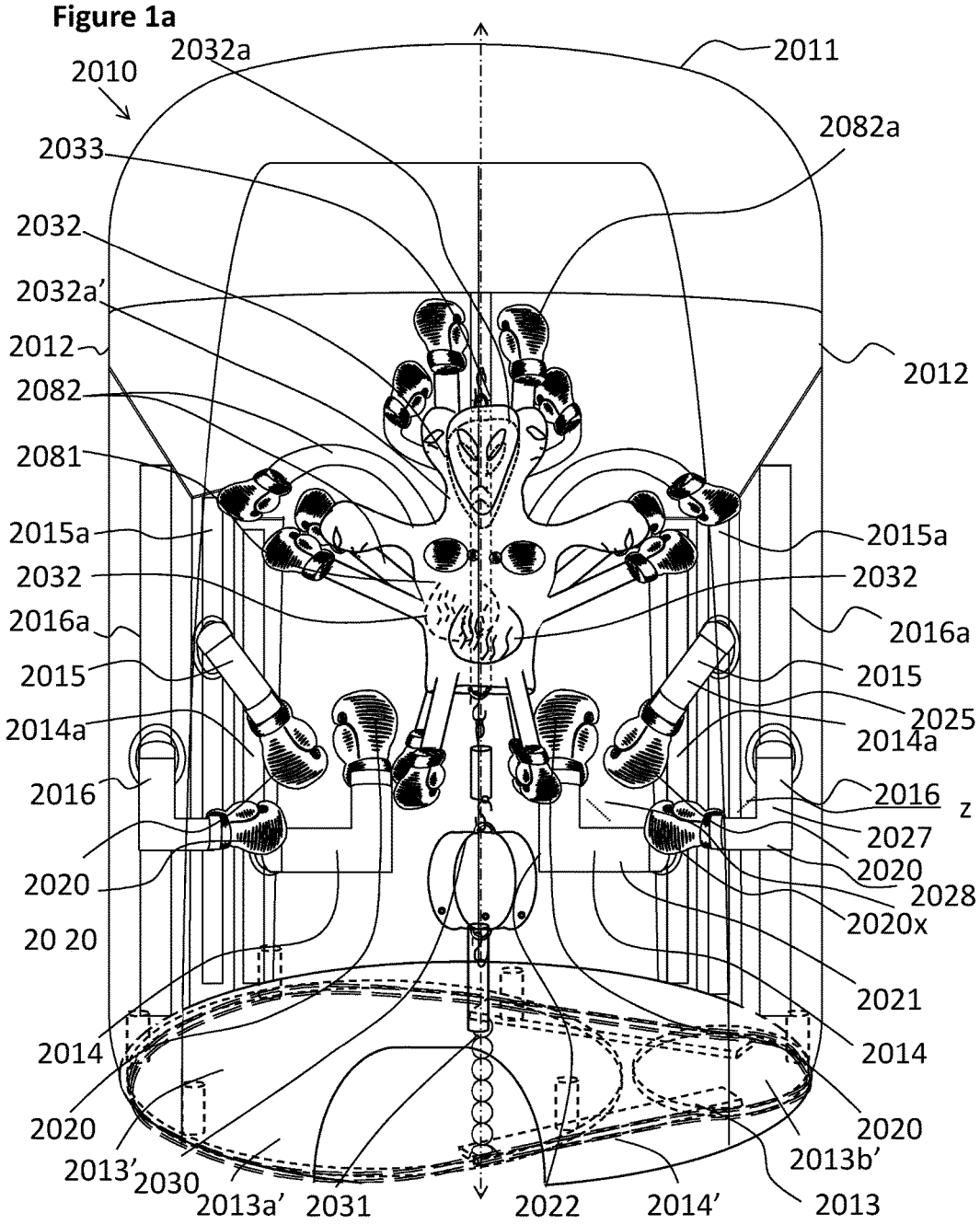
FIG. 1*a* illustrates a perspective view of an embodiment of the fight simulation apparatus of the subject invention.

The present invention is directed to a multi-headed, multi-abdomen, multi-armed member for use with a slip and counter fight simulation/workout machine or stand-alone device for fight simulation. The fight simulation multi-headed, multi-abdomen, multi-armed apparatus includes a multi-headed member having at least one head, at least one abdomen and at least two pair of arms each preferably having a glove appending member. Preferably, multiple heads are attached to multiple abdomens with multiple arm pairs to provide different punch configurations including hook punches, straight punches or uppercuts and uppercut type punches. The multi-headed, multi-abdomen, multi-armed apparatus provides various angles adapted for a user to punch, or knee strike around, over and/or under the apparatus. The fight simulation multi-headed, multi-abdomen, multi-armed apparatus may be configured so that one side of the apparatus has different arm orientations, height placement, arm length, etc, so that varying moves are required by the user for advanced training. For example, on one side of the apparatus hook arms may be located higher than hook arms on another side of the apparatus, which hook arms may be located higher. In addition, arms can vary in length, be; shorter or angled to protect the abdomen of the apparatus. Also, the; heads can be adjusted, placed and/or angled at varying heights, locations and angles.

The multi-member apparatus provides a main center/abdomen area for a user to knee, punch, etc. Between, around, over, under arms are positioned near chins located on heads of the apparatus, coming from heads (preferably of aliens for example) and also coming out of necks in straight, overhand, and/or hooked positions.

The present invention is directed to a multi-headed, multi-abdomen, multi-armed member for use with a slip and counter fight simulation/workout machine or stand-alone device for fight simulation; is adapted to be used in physical fitness, fight training and/or fight simulations. Generally stated, the slip and counter fight simulation/workout machine provides a plurality of movable arms that move in a random or programmable fashion, directing jabs, hooks and upper-cut punches at an individual. The slip and counter machine incorporates a fight simulation/workout machine that includes at least two side walls. Each side wall includes at least one height-adjustable arm, preferably at least two arms, traversing slots. At least two or three of the arms of the slip and counter machine can come towards a user simultaneously simulating a person being jumped or ganged-up on by more than one person so that the user can practice a fight simulation where the user is being ganged-up on by more than one person. A glove appendage member is located on a proximate end of each of the arms. Preferably the base of the slip and counter machine moves in intervals of 12 seconds, 10 seconds, 7 seconds, 3 seconds, etc. Also, preferably the base or base platform of the slip and counter machine is fixed on a turntable and includes sensors so that the base platform can follow a user. The sensors or turntable function may be turned off when necessary. The turntable is preferably constructed with a belt on pullys and/or gears driven by a motor in association with the sensor and a programmable memory. The programmable memory may include software programming of games or fight or exercise simulations. It is noted that herein sensors may include a plethora of different sensors, including for non-limiting example, motion sensors.

The present invention is further directed toward a workout apparatus and method that includes a base with a plurality of wheels that can go in any direction. The base can be controlled by a sensor/sensors (it is noted that although a motion sensor may be used, other sensor types may also be utilized), a handheld remote control, or the wheels can be locked so that the base is stationary. Wherein a sensor, or more than one sensor, is integrated within the base, a program is provided to allow different settings including the sensor can be elected to follow the user, or to move away from the user, or a random or sequential combination of both (follow; move away). Various speeds may also be incorporated into the programming of the base movement. Basically any apparatus can go into the base, but most preferably the type of apparatus that comes with a base of its own that's typically filled with a substance to provide a bottom heavy base is preferred. Such substance may include sand, particles, metals, etc. to effectuate a heavy base.

The sides of the head/s are preferably exposed with enough room that a big size boxing glove can strike comfortably. Heads of the apparatus are constructed facing various directions, including downward, straight forward etc. Head/s can be made with almost any material, and this same concept will work with any type of head/s or pad/s, an insect head, animal head, human head etc., even a round ball with a face on it or any shape with a face on it or any type of mask over it etc. The term "head" or "heads" herein shall broadly refer to a top located portion which can be arranged as pads, shaped as animal head/s, human head/s, insect head/s, a round ball, or any shape with a face on it, a mask over a ball, or any shape that is arranged as a top surface or object for punching or kicking in a boxing, fighting or exercise activity.

To assure that the head/s will move once struck it can be clamped, hooked or otherwise secured between cords, springs or the like. The bottom part of the head/s preferably will have at least one neck, and on the bottom of that neck will be a bungee cord, or a spring, or the like, clamped or hooked onto the neck. The other end of the cord will hook onto the top of the four sided portly abdomen. There are preferably at least one abdomen, and preferably constructed as a four sided abdomen, which may be formed together as one mold. There is enough room on each side of abdomen for a big size boxing glove to strike. On the bottom of the abdomen/s there is preferably either some type of spring or cord attached to a height adjustable pole that extends into the base of the apparatus which, in turn, extends onto the base with wheels. The very top of the head/s are preferably hooked or clamped onto a cord and the other end of the cord is preferably attached to a support structure with a mounting loop. The support structure preferably has at least one hole in it for at least one arm to either be clamped onto or may go through the hole of structure. Arm/s may go into any hole for appropriate height. A support structure can be attached to the base with the wheels, or the entire thing can be disassembled to attach an interchangeable kicking bag in its place (FIG. 2). The hands of the arms may be boxing gloves instead, and arms can be composed of many different materials, including rubber, plastic, and the like; but, most preferably, are composed of corrugated metal or plastic.

In order that the machine will present an appearance that is attractive to a martial artist as well, an option is provided to have the abdomen section be changed out when necessary and replaced by some type of kicking bag or pad. Optionally, six (6) arms of the slip and counter are located on poles alone, as opposed to being located behind the side walls; optionally, three (3) arms are located on one pole with three on each side of the machine. The mechanism that will turn the machine may be located on the outside or the inside of the structure. The 6 mechanical arms and the counter area can all go onto one turntable inside of the structure.

The exercise machine can also transition into a few games in one. Game #1: basically the machine counts how many punches the user ducks in a certain amount of time, and the machine gains points as well, and user will be able to increase speed of arms and turntable when necessary. Game #2: sensors are added to all areas that the user will strike, and once struck, the machine will accumulate that as points than machine vs. the machine's six arms also having an opportunity to touch the user; and again those arms will be programmed to sometimes strike the user simultaneously. The way the user wins is by having more striking points when the timer buzzes. Game #3: gloves are removed from all six arms and replaced with various scary zombie, animal or other type of heads, but most preferably scary zombie like heads or faces. In the game, the zombie will randomly jump out towards the user, as if to bite the user, then the user has a preselected amount of time to strike the zombie before it retracts back into place, thus accumulating points. Game #4: remove all 6 gloves again and replace them with some sort of boxing type of punching mitts that a boxing trainer will use to practice with boxers. Optionally, for each of the games the arms may come out in a random fashion or a programmable order.

The machine includes at least one counter area/element. The arms are located on the side walls and arranged in a manner that provides different punch configurations, including hook punches, straight punches or uppercuts and uppercut type punches, respectively. Further embodiments of the fight simulation/workout machine concern the construction of the glove appendage member. In these embodiments, the glove appendage member is removable and composed of different grade materials/softness (i.e. pillow soft, soft, medium). Other embodiments involve the configuration of the arms: with a first and third arm including an elbow joint, and the second/middle arm being straight. Further embodiments involve the configuration of the counter area/element, and the presence of at least two counter areas/elements, one of which comprises a head counter area and another of which comprises a mid/stomach counter area. Still other embodiments involve specific elements concerning the control and activation of the machine (i.e. sensor, on/off switch, and the like).

The multi-headed, multi-armed, multi-abdomen, preferably alien faced apparatus is comprised of a plethora of heads and arms strategically placed in various angles and are structured to provide a use with the ability to practice different punch moves. As the apparatus is hit, it shifts or rotates to expose an abutting side of the apparatus, which preferably has different arm configurations and multiple arms and heads configurations for the user to strike. The subject multi-headed, multi-armed, multi-abdomen device attaches to flexible poles and cords to simulate the potentially rapid movements of an actual physical altercation. Multi-heads are angled in positions from upright tall to low, facing towards the ground and various positions in between, with at least one of the necks preferably being elongated. Arms are arranged to extend from or come out of the abdomen, heads and necks of the apparatus, and are arranged in overhand, straight and hook punch positions, with the arms or fists (of each of the arms) being beside chins of each of the heads. Preferably, the apparatus is designed to look like a forward facing alien, looking mean and unhappy with a downward frowning mouth and big eyes, preferably black and glossy eyes and grey, brownish or greenish skin. The subject device is adapted to help the user learn how to hit a moving head at different angles while simultaneously the device has some of the gloved hands protecting the chins of the apparatus. Arms extend out from the necks and heads of the apparatus, with the arms being positioned in a combination of positions, including hooking positions, overhand positions, straight out positions, one pointing upward position and one pointing downward, all for a user to learn how to go under arms, over, in between etc. utilizing knees, kicks, and punches. Each side of the device poses a different challenge. The head and arms are arranged to provide different punch configurations, so that the multi-head member provides various angles adapted for a user to punch, knee, and/or do a flying knee and the apparatus presents at least two fighting stances. Preferably, the fighting stances include one or more boxing, muay thai, wing chun and/or wresting stances.

The apparatus originally stands as the counter part of a slip and counter machine. However, the apparatus can be attached to either a height adjustable pole stand with s hooks and bungee cords and threaded u adapters that unscrews so that parts of the apparatus can be used with a different type of stand if required. The height adjustable pole stand includes a base with a threaded hole either on it or in it for a flexible spring pole to be screwed into. The other end of the pole in turn screws into the bottom of the abdomen of the multi-headed device. The multi-headed device can also work on a stand that utilizes one or two flexible spring poles, one pole if the user would like to use just one part of the multi-headed device, either the lower or the upper part. Where both the upper and lower part of the multi-headed device is intended to be used, two poles would be needed. The upper flexible pole has a strong spring usually in the middle of the pole, and the pole is threaded at both ends to go into the bottom of the upper striking part while the other end screws into the top of the lower striking part of the multi-headed device. The second lower pole is preferably not as flexible and is preferably thicker and stronger, so that the mid-section part of the multi-headed device doesn't move as much. The second lower pole is threaded on one side only, to screw into the bottom of the mid-section of the multi-headed device. The other end of the second pole has height adjustable holes and slides into a water or sand filled base having height adjustable holes along with a tightening knob.

In another embodiment, the multi-headed device is adapted to be attached to chains and hung on a traditional punching or kicking bag stand. Punching or kicking bag stands are preferably sold separately. The multi-headed device slip and counter machine preferably is constructed preferably having six height adjustable arms that have separate slots and at least two side walls. Preferably, the multi-headed device has at least two pairs of arms—with at least one for each side wall where the apparatus is a four sided construct/with at least two on each side wall where the apparatus is a two sided construct. The hook and uppercut arms of the multi-headed device preferably have elbow joints, in order to practice fighting very close. The multi-headed device further preferably comprises straight arms angled downward or upward. When the multi-headed device/apparatus is placed within the slip and counter machine as discussed herein, the slip and counter machine arms are arranged so that two or three arms simultaneously come toward the user to simulate fighting against more than one person at the same time. Preferably the slip and counter machine moves in random, unpredictable directions and at different times. For example after 10 seconds the entire slip and counter machine will move and at times after three seconds or seven seconds, etc., the slip and counter machine will again move. The multi-headed apparatus sits within the center of the slip and counter machine. Movement of the slip and counter machine is preferably at various speeds. Proximity sensors are provided at different areas, like at the wrist, etc., for safety reasons.

In one embodiment, movement of the subject device is achieved by the way of at least two wheels located underneath the base of the device. One wheel is preferably larger than the other wheel. At least six prongs are located on the wheels: three on each side of the top half of the wheel and three prongs on the bottom of the second half. A durable high strength belt surrounds the two wheels, causing them to move by an electric motor. Preferably, the arms of the device operate similarly, via wheel pulley structure or by pneumatics, linear actuators, hydraulics or the like.

The multi apparatus in the center of the Slip and Counter machine preferably comes with a plethora of interchangeable parts. Due to some users just beginning, or even being elderly, etc., one may want to work their way up from using one head and one mid-section, portly or muscular (optional) and eventually change out the singular head and utilize a four sided head that will have two of the heads facing downwards, similar to the eight multi-headed apparatus but without sixteen arms to focus on which will be harder to time the movement and strike accurately. It may require lots of confidence to start out with an eight headed sixteen armed apparatus, and therefore a novice user has the ability want to focus on using just the four sided abdomen alone. Interchangeability of the different members of the device takes seconds. Pillow soft gloved shaped washable cushions optionally come with the apparatus so that a user has the ability to place cushions over some of the protruding arms.

The present invention advantageously incorporates a plurality of heads hooked between two bungee cords to provide various heads for numerous positions, strikes, timing, speed and accuracy. Preferably there are at least two heads, more preferably there are at least four heads, and most preferably there are at least eight heads. Additionally, the present invention further preferably provides at least a two sided portly stomach. Most preferably, a four sided portly stomach is provided. In this manner, as opposed to striking just one stomach hooked on to one end of a bungee cord, the user can strike various stomachs. Directly on the top center of the four sided portly stomachs there is a u-shaped loop for an s-hook to hook onto. The other side of the s-hook connects to a bungee cord that similarly hooks onto the bottom of the multi headed apparatus, meaning via an s-hook hooked onto a u-shaped loop connected to the bottom of the multi headed apparatus. This multi headed apparatus most preferably has a total of eight faces and five heads. The head at the very top includes four faces on one head, similar to the four sided stomach member. The side of each face on the four sided head preferably terminate or stop right before where an ear would appear, such as on a typical human head, so that the side of each head can be hit. Consequently, there will be no ears or back of head on the four face head portion of the multi headed member. Likewise concerning the multi stomach member, preferably each stomach will have each side exposed for side hits, but no backs will be exposed or provided. The top center of the four sided head member of the multi headed member includes a u-shaped loop connected to an s-hook that connects to a bungee cord. The other end of the bungee cord in turn connects to a hook preferably located in the top or ceiling of the slip and counter apparatus. Connected to the bottom of the neck of the four faced head of the multi headed member are four additional heads with one face each, but these heads are faced in an angle a little higher than facing towards the ground, and the necks are somewhat long. The angle of these heads preferably ranges from 30 degrees to 80 degrees in relation to the horizontal plane or ground surface. More preferably, the angle ranges from 35 degrees to 55 degrees. Most preferably, the angle is about 45 degrees.

Additionally, at least two sets of arms are provided. Most preferably four sets of arms are provided. The hands of the arms are preferably in the form of boxing gloves. Heads are located on the front and back of the multi-headed apparatus/member—wherein there is at least a two headed configuration. Preferably, the heads on the front and back of the multi-headed member are set extremely low on the apparatus so that the heads can be used for knee strikes. Preferably, at least one arm associated with at least one of the heads (front and/or back) is positioned as if it is ready to pick-up a person, like a wrestler, and with Mixed Martial Arts (MMA) style gloves on as opposed to other arms with boxing gloves on as hands. One set of the arms is located in the front of the faces of the upper four faced head portion with gloved hands protecting both sides of the chin. The other three sets of arms are located in front of three out of the four angled heads. Though the gloved hands are located on the side of the chins, none of the gloved hands are too close to the chins as there must be enough space for the user to punch around the arms and gloves of the apparatus. The multi headed member may be constructed as one mold, including the u-shaped hooks for the s-hook connections. In the bottom of the four sided stomach member there is a threaded hole. A strong spring pole with a thread at both sides of the pole is screwed into the bottom of the stomach member. The other end of the spring pole screws into the bottom of the slip and counter apparatus. Additionally spring poles and bungee cords are provided with the device to provide for various heights and placement of the multi headed member and multi stomach member. Further, the single head and/or single stomach construction, as described in U.S. application Ser. No. 13/385,703 filed Mar. 2, 2012, the disclosure of which is hereby incorporated in its entirety by reference thereto, can be interchanged out from the multi headed and multi stomach members of the subject invention.

Advantageously, as constructed, the subject apparatus enhances the ability for the user to practice his/her uppers cuts and knee strikes. Further, as constructed, a user can also walk into the slip and counter apparatus and warm up and build confidence by practicing with the stationary arms of the multi headed member, prior to exercising with the moving arms of the apparatus as a whole, and warm-up punching between, around, under, over arms. Each side of the multi-member apparatus is preferably different, so that the arms/necks/heads are placed at different locations, heights, angles so that the apparatus can be unhooked and turned on the other side for varying the work-out or fight simulation.

In one embodiment a fight simulation workout machine is provided comprising at least two substantially parallel opposing side walls wherein each side wall including at least one height-adjustable arm that traverse separate slots and are substantially parallel to one another. A glove appendage member located on a proximate end of each of the arms is also provided. At least one counter area/element constructed as a multi-head member having at least two head portions each having a face is provided. The multi apparatus can work with any type of face or head or, even pads instead, but most preferably alien faced heads. These heads will be in all positions from upright to facing the ground, for knee strikes. To be more versatile, the apparatus comes with interchangeable parts, single head, single abdomen portly/muscular, a four sided head, a four sided abdomen, and four sided cross shaped pads, all interchangeable. Most preferably, there are at least eight heads. Wherein the arms provide different punch configurations including hook punches, straight punches or uppercuts and uppercut type punches, respectively. Further, wherein the multi-head member provides various prospective adapted for a user to punch.

In another embodiment a free standing fight simulation workout machine is provided. The free standing fight simulation workout machine comprises: a. a main support structure including a mounting loop thereon for attaching a first s-hook thereto, the first s-hook further being connected to a first cord; b. at least one counter area/element including a top having a u-shaped loop thereon for receiving a second s-shaped hook adapted to be attached to the first cord; c. the at least one counter area/element including a bottom having a u-shaped loop thereon for receiving a third s-shaped hook adapted to be attached to a second cord, the second cord having a fourth s-shaped hook attached on an opposite end thereof; and d. a base portion, wherein the base portion includes a base loop that removably connects to the fourth s-shaped hook. Preferably, the counter area/element is shaped as a head, more preferably being a multi-head member having at least two heads; and most preferably being a multi-head member having eight heads, further comprising at least two to eight pairs of arms extending from the apparatus—extending from heads, necks, and/or an abdominal area. Preferably a mid-counter area/element is also provided, optionally including a multi-stomach mid counter area/element, which preferably includes at least four stomach portions forming a four sided portly stomach.

The slip and counter fight simulation/workout machine is ideally suited for installation in a gym, workout center, private home, game room, amusement parks and/or cruise ships. It contains a number of arms that move in random fashion, directing jabs, hooks and upper-cut punches at an individual ("User") that stands between the moving arms. The machine can operated at a slow speed for training purposes; at a medium speed as training progresses; or at a higher speed for skilled individuals that wish to perfect and maintain their skills.

Figure 1B:
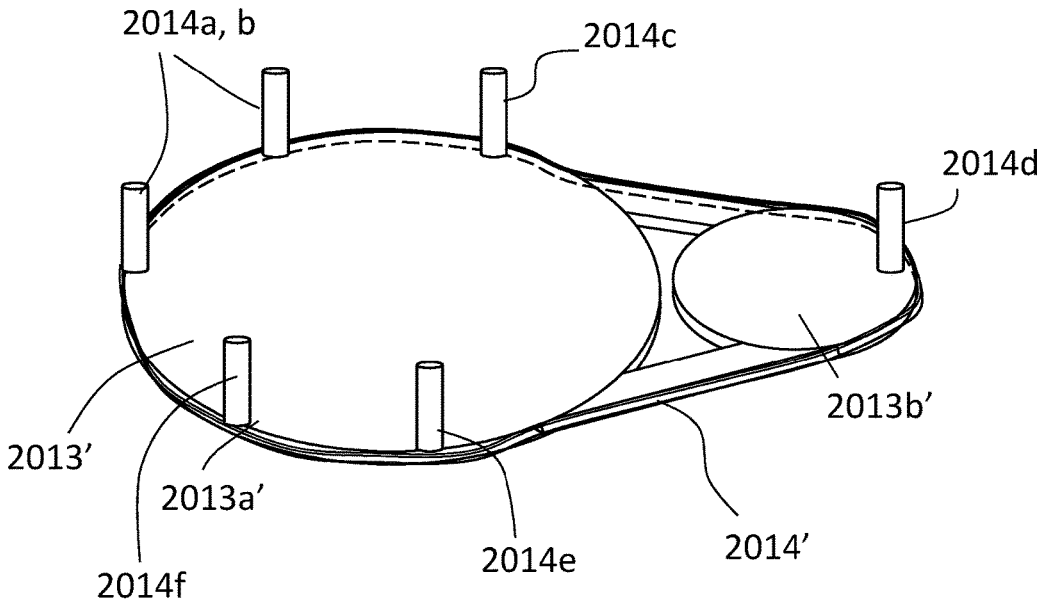
FIG. 1*b* illustrates a perspective view of an embodiment of the movement driver of the subject fight simulation apparatus of FIG. 1*a;*
Figure 1C:
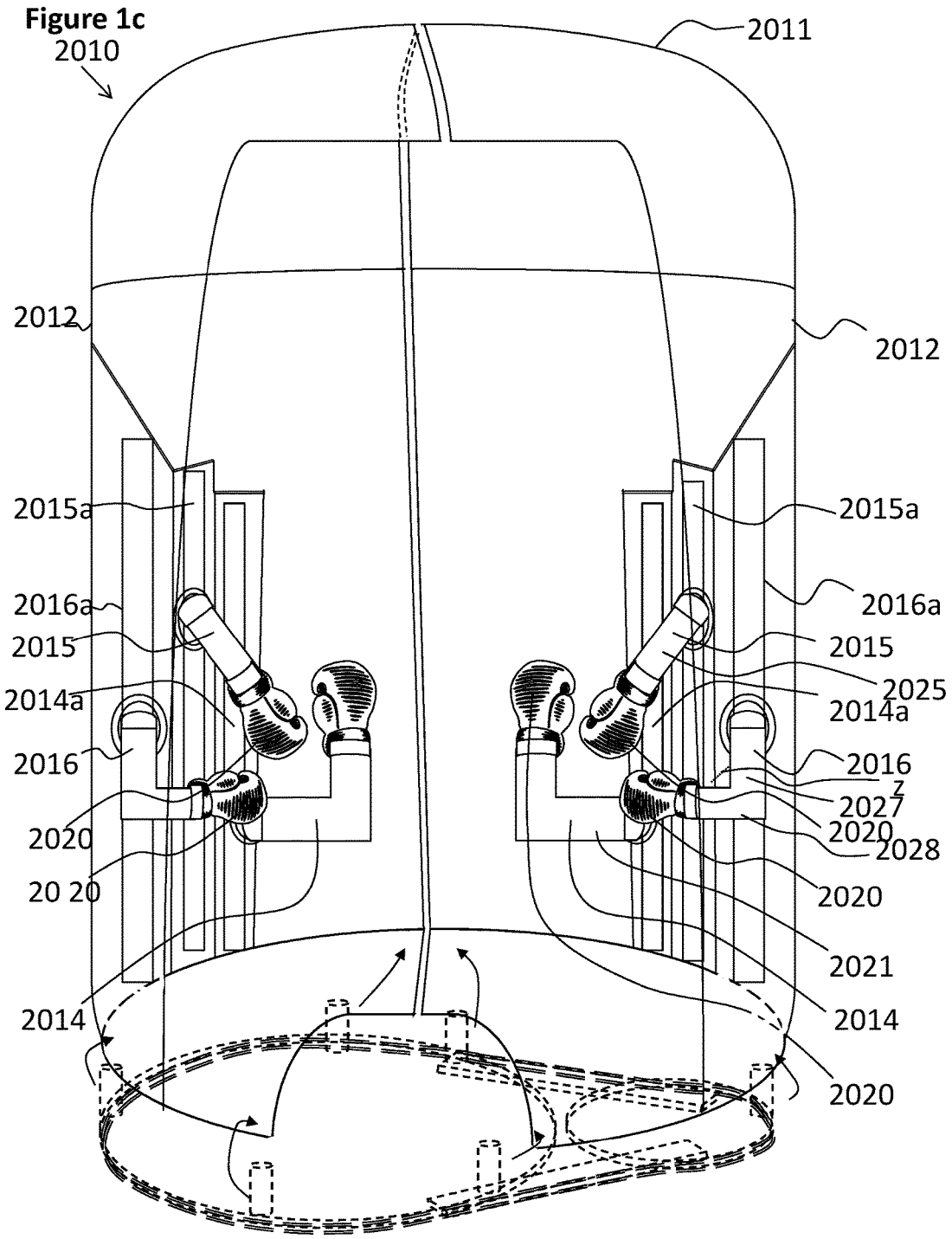
FIG. 1*c* illustrates a perspective view of the embodiment of the movement driver of the subject fight simulation apparatus of FIG. 1*a* as arranged under the fight simulation apparatus/device with the multi-head, multi-abdomen, and multi-arm apparatus removed therefrom.
Figure 1D:
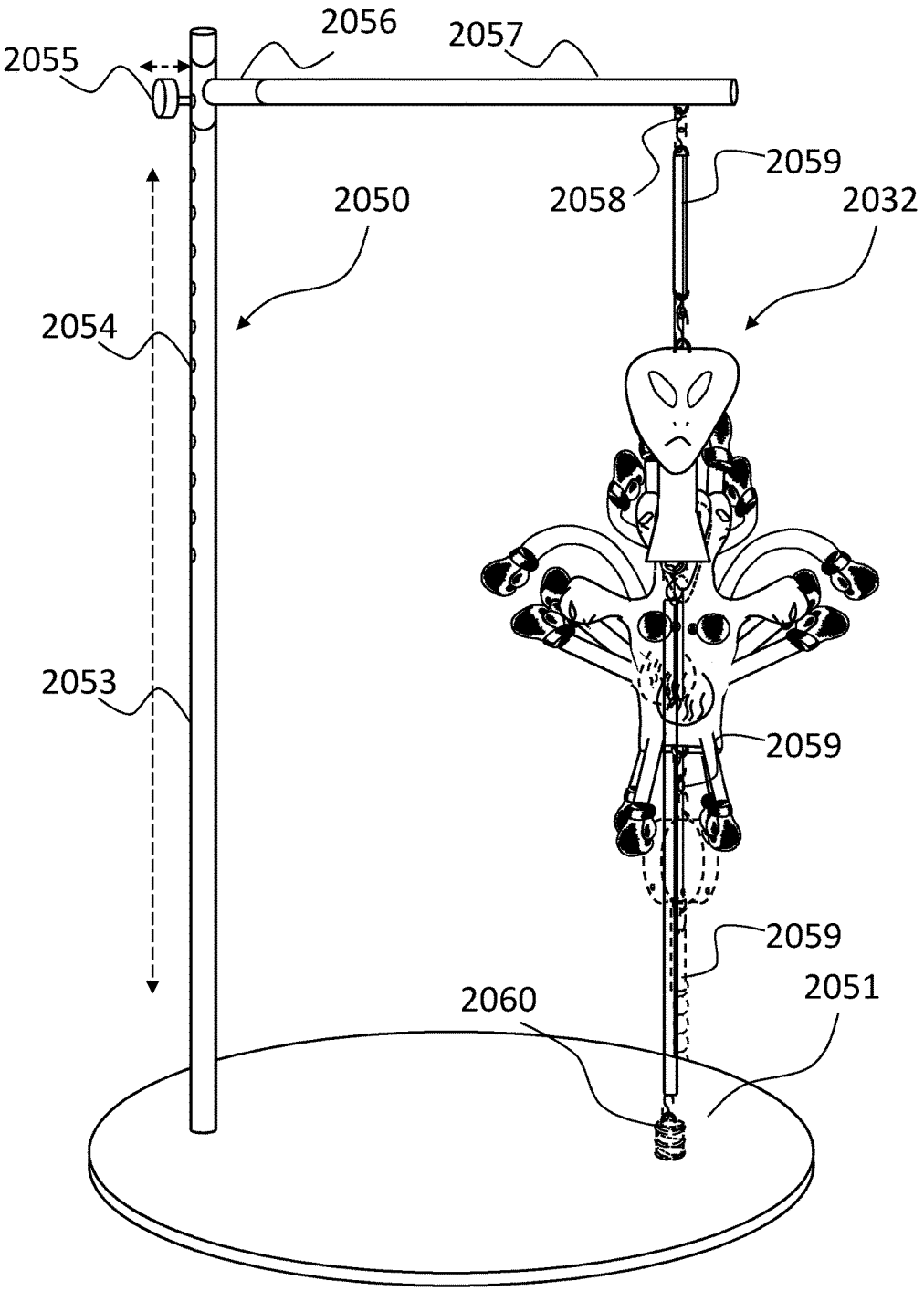
FIG. 1*d* illustrates a perspective view of the embodiment of the fight simulation apparatus of the subject invention where the multi-head, multi-abdomen, and multi-arm apparatus is removed from the slip and counter machine and placed on a free standing apparatus as a punching or kicking bag type structure (for example)

FIGS. 1*a*-1*c* illustrates perspective views of the subject fight simulation apparatus and interchangeable elements thereof. FIG. 1*a* illustrates a perspective view of an embodiment of the fight simulation apparatus of the subject invention. FIG. 1*b* illustrates a perspective view of an embodiment of the movement driver of the subject fight simulation apparatus of FIG. 1*a*. FIG. 1*c* illustrates a perspective view of the embodiment of the movement driver of the subject fight simulation apparatus of FIG. 1*a* as arranged under the fight simulation apparatus/device. FIG. 1*d* illustrates a perspective view of the embodiment of the fight simulation apparatus of the subject invention where the multi-head, multi-abdomen, and multi-arm apparatus is removed from the slip and counter machine and placed on a free standing apparatus as a punching or kicking bag type structure (for example). The slip and counter machine may have the ability to play music, various sounds such as bells, buzzers, etc., colorful lights that come on when someone wins against the machine, some motivational and funny recordings, timers, and/or mirrors.

Referring to FIGS. 1*a*-1*c*, the multi-headed, multi-abdomen, multi-armed member shown at 2032 is shown used with a slip and counter fight simulation/workout machine at 2010. Workout machine 2010 generally includes a U-Shaped construct having a top wall 2011, at least two parallel side walls 2012 arranged opposite from one another, and may optionally include a bottom floor mat 2013 located on a base 2013'. Preferably, there is no bottom floor mat. As used herein, the term "U-Shaped" is meant to be a ground view of the device 2010 as one stands directly in front of the device 2010. In this manner, a user is appointed to walk into the U-shape between the side walls 2012 and is thus substantially surrounded by the device. That is to say, the user's front, and sides are in proximity with the side walls 2012 of the device as the user walks inside the U-shape; providing a device 2010 having side walls 2012 forming an arc ranging from about 90 degrees up to about 270 degrees. Preferably, the side walls 2012 are arced or curved and form a semicircle of about 180 degrees. In this manner, fight simulation is optimized to substantially surround a user who walks into the U-shaped device (sides and front of user).

If a bottom floor mat 2013 is provided, it may include a sensor therein for activating or turning on the machine 2010. Optionally, the bottom floor mat 2013 may be constructed as a turntable that follows a user's movement by incorporating sensors under the bottom floor mat 2013 which may be a well cushioned mat that the turntable rests on, so that wherever a user moves the turntable follows. Alternatively, the device may be constructed without a bottom floor mat 2013 and instead there may simply be a sensor beam located near the bottom of one or more of the side walls 2012, or top wall 2011. Within side walls 2012 there are a series of arms 2014, 2015, 2016 extended within first, second and third slots 2014*a*, 2015*a*, 2016*a*, respectively, that allow the arms to adjust height wise from the floor mat 1013, on a substantially vertical plane. The slots 2014*a*, 2015*a*, 2016*a* or tracks are located substantially parallel to one another and are substantially perpendicular to the bottom floor mat 2013. Preferably there are three arms 2014, 2015, 2016 as shown, each located in separate slots 2014*a*, 2015*a*, 2016*a* and each being capable of being adjusted along the vertical plane extending from the floor/ground level/or bottom floor mat 2013. Each of the arms 2014, 2015, 2016 are spaced and constructed to deliver different punch types/provide different extension ranges for delivery of different punches, as discussed hereinafter.

Base 2013' is preferably constructed to provide movement of the device achieved by the way of at least two wheels 2013*a'* and 2013*b'* located underneath the base 2013'. Wheel 2013*a'* is preferably larger in diameter than the wheel 2013*b'*. (See FIG. 1*b*). At least six prongs 2014*a*-2013*f* are located on the wheels 2013*a'* and 2013*b'*: three on each side of the top half of the wheels 2013*a'* and 2013*b'* and three prongs on the bottom of the second half. A durable high strength belt 2014' surrounds the wheels 2013*a'* and 2013*b'*, causing them to move by an electric motor. Preferably, the arms of the device operate similarly, via wheel pulley structure or by pneumatics, linear actuators, hydraulics and the like.

The multi apparatus preferably includes some arms coming out of the elongated necks of aliens and arms out of the alien heads, arms in all positions like overhand, coming straight out, or hook positions. Preferably eight heads and sixteen arms are provided. Mixed Martial Arts (MMA) style gloves, boxing gloves or pads can be arranged on the ends of the arms. Some arms will be positioned so that the gloved hands would be located next to the chin of heads. The multi-member apparatus can work in the center of the slip and counter machine, which includes a moving base, two side walls, and at least two arms as shown in FIG. 1*a*. Alternatively, all parts of the multi-member apparatus can also work with the height adjustable stand of FIG. 1*d*, consisting of bungee cords, S hooks, flexible spring pole with thread at both ends, and threaded U adapter to screw into the base of stand.

The arms 2014, 2015 and 2016 are provided within slots 2014*a*, 2015*a*, 2016*a* so that the arms 2014, 2015, 2016 vertically traverse the slots 2014*a*, 2015*a*, 2016*a* to accommodate users of varying heights. The arms and slots may include tongue and groove mating means, with teeth and mating slots. Alternatively, hydraulics and/or electronics may be used for movement of the arms 2014, 2015, 2016 along slots 2014*a*, 2015*a*, and 2016*a*.

Each of the arms 2014, 2015, 2016 includes a glove appendage member 2020 thereon. Preferably, glove appendage members 2020 are removable and different grade glove members 2020 are provided, including pillow soft, soft, medium, hard.

Figure 5:
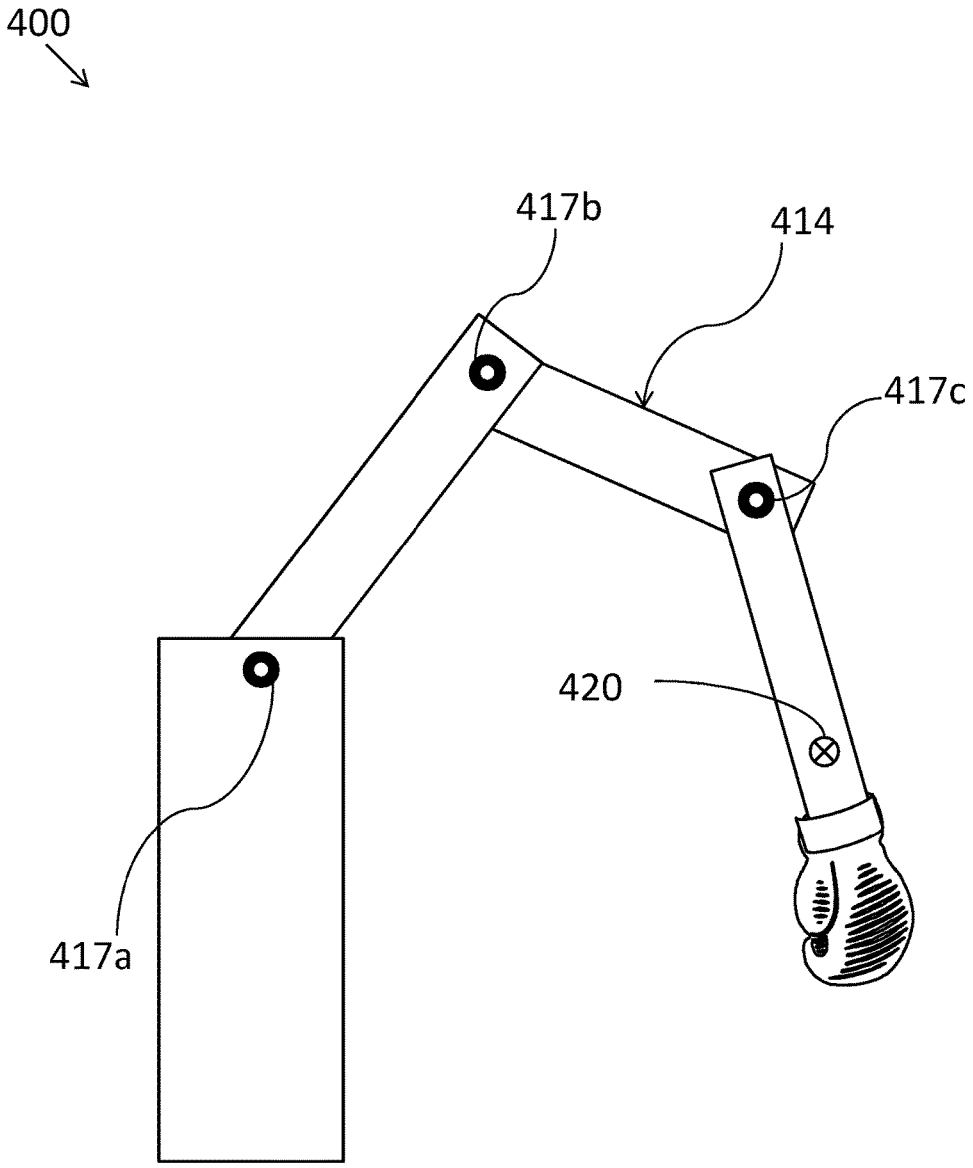
FIG. 5 illustrates a view of a left hook arm, showing flexible joints.

Arm 2014 includes at least on elbow joint connecting an upper arm portion 2021 and a lower arm portion 2022 and provides an angle x located there between. FIG. 5 illustrates arm jointed configurations. Arm 2014 is appointed to deliver uppercut type punches. Arm 2016, like arm 2014, includes an elbow joint connecting an upper arm segment 2027 and a lower arm segment 2028 and provides an angle z located there between. Arm 2016 is appointed to deliver hook type punches. Advantageously, the purpose for the elbow joints on the hook arms 2016 are for tighter hooks, in case a user prefers fighting up close. The purpose for the elbow joints on the uppercut arms 2014 is so the half uppercut-half hook punch can be thrown.

In contrast, arms 2015, located centrally between arms 2014 and 2016, and are preferably constructed on as straight members 2025 that are angled downward (or upward) from side walls 2012. Preferably, arms 2015 slant or angle toward the center of the device 2010 and said angle is adjustable as illustrated by way of FIG. 4. As so constructed, arm 2015 delivers straight punches. Preferably, arms 2015 are provided as telescoping arms as shown in FIGS. 2 and 3.

Continuing with FIGS. 1*a* and 1*b*, counter areas/elements are provided, generally including a mid/stomach section counter area/element 2030 having a strong cable 2031 or bungee cord, and a counter area/element shown as a multi headed member 2032. Cable 2031 may be composed of a flexible material so that the cable 2031 gives a little to avoid hurting the user's wrists; alternatively, cable 2031 may be composed of a rigid material but in such an event cable 2031 has some slack in order to give so it won't hurt the user's wrists. The counter areas are to be positioned in the back and center of the machine, the same way a user's body would be behind his/her arms in the fighting position.

Each of the counter elements, herein 2030 and 2032, are interchangeable, including use of the different punch-able members that can be interchanged on the apparatus, including showing the multi-headed member, a single head member, a single stomach member, the multi-stomach member, the 4-sided cross pad and 4-sided alien head. These members are shown for example in FIG. 2*c*.

A multi-headed, multi-abdomen, multi-armed apparatus/member 2032 is provided having at least one head, one abdomen and one arm—preferably, multiple heads (or pad portions if not shaped like heads) abdomens 2081 and arms 2082 (2082*a*-*n*) are provided. One set of arms, shown generally at 2082*a*, is shown extending preferably from the back of a head 2032*a*. Heads are located on the front and back of the multi-headed apparatus/member—wherein there is at least a two headed configuration. Preferably, the heads on the front and back of the multi-headed member are set extremely low on the apparatus so that the heads can be used for knee strikes. Preferably, at least one arm associated with at least one of the heads (front and/or back) is positioned as if it is ready to pick-up a person, like a wrestler, and with Mixed Martial Arts (MMA) style gloves on as opposed to other arms with boxing gloves on as hands. It is noted that arms 2082*a*-*n* can have configurations that are arranged differently from one another so that the arms 2082*a*-*n* provide different arrangements for the user to punch. Arms 2082*a*-*n* are arranged to extend from or come out of the abdomen, chest, head, and/or neck of the apparatus and are preferably arranged in overhead, straight and/or hook positions. In the embodiment shown eight heads 2032*a*-*h*, each with alien faces thereon (though the heads 2032*a*-*h* can be a plethora of different head shapes and sizes) (See FIG. 1*f*). Note that the heads can have a plethora of different faces and may be arranged on elongated necks 2032*a*-*h'*. The heads 2032*a*-*h* may merely simply be appendages/pads having no face configuration. The top portion 2032' of the multi headed member 2032 is constructed having four heads 2032*a*-*d* interconnected to one another. Directly on the top center there is a u-shaped loop 2032" for an s-hook 2033 to hook onto. Top portion 2032' extends to an abdomen which in turn includes four more heads 2032*e*-*h* (heads 2032*f* and 2032*h* are shown as back of heads inasmuch as they are angled downward at an angle). These heads 2032*e*-*h* are faced in an angle a little higher than facing towards the ground, and the necks are somewhat long. The angle of these heads 2032*e*-*h* preferably ranges from 30 degrees to 80 degrees in relation to the horizontal plane or ground surface. More preferably, the angle ranges from 35 degrees to 55 degrees. Most preferably, the angle is about 45 degrees. The plurality of heads provides various heads for numerous positions, strikes, timing, speed and accuracy. Preferably there are at least two heads, more preferably there are at least four heads, and most preferably there are at least eight heads (as shown). [See FIGS. 1*f* and 2*c* for more embodiments]. The heads may arranged to extend from or come out of what would be the chest or/and abdomen area as depicted at 2023*h*, for example (See also, for example, FIGS. 10*a*, 10*b* wherein directly under the two gloves, there's a head, with the back of a head facing the floor). This multi headed apparatus most preferably has a total of eight faces and five heads. The side of each face on the four sided head preferably terminate or stop right before where an ear would appear, such as on a typical human head, so that the side of each head can be hit. Consequently, there will be no ears or back of head on the four face head portion of the multi headed member.

In the embodiment shown, and referring to FIG. 1*a*, a multi stomach member 2030 is provided having four stomachs 2030*a-d*. In this manner, as opposed to striking just one stomach hooked on to one end of a bungee cord, the user can strike various stomachs. Directly on the top center of the four sided portly stomachs there is a u-shaped loop 2080 for an s-hook 2022 to hook onto Likewise concerning the multi stomach member, preferably each stomach will have each side exposed for side hits, but no backs will be exposed or provided.

Additionally, at least two sets of arms 2090 are provided. Most preferably four sets of arms are provided, 2090*a-d*. The hands of the arms are preferably in the form of boxing gloves. One set of the arms is located in the front of the faces of the upper four faced head portion with gloved hands protecting both sides of the chin. The other three sets of arms are located in front of three out of the four angled heads. Though the gloved hands are located on the side of the chins, none of the gloved hands are too close to the chins as there must be enough space for the user to punch around the arms and gloves of the apparatus. Preferably, there is a space of ranging from about 4 inches to about 8 inches.

The multi headed member may be constructed as one mold or more than one mold, including the u-shaped hooks for the s-hook connections. In the bottom of the four sided stomach member there is a threaded hole. A strong spring pole with a thread at both sides of the pole is screwed into the bottom of the stomach member. The other end of the spring pole screws into the bottom of the slip and counter apparatus. Additionally spring poles and bungee cords are provided with the device to provide for various heights and placement of the multi headed member and multi stomach member.

Counter areas/elements are preferably made in the shape of a human stomach. These counter elements can alternatively comprise circular counter spots, and the shape of the areas/elements can be hexagonal with counter spots thereon. In one embodiment, there are only two areas/elements: a mid-section (stomach area) area/element having a strong cable on it so that it does not move and preferably resembling an oblong oval or pear corresponding to the look of a portly belly area on a person, and a head counter area/element having rubber straps so that it can move a little more, but not as much as a double end bag. The counter areas/elements are to be positioned in the back and center of the machine, the same way a user's body would be behind his/her arms in the fighting position. The counter areas/elements should come with different cables and different rubber straps, for different height/sized customers.

The machine is preferably constructed having a U-shaped or arc-shaped construction. The uppercut slot 2014*a* for the uppercut arm 2014 is located the furthest away from the user and the closest arms towards the back of the device 2010, close to the counter areas/elements. The second or middle slot 2015*a* is appointed to deliver straight punches via the straight arm 2015. The third slot 2016*a* is for holding hook arm 2016 and for thus delivering deliver hook type punches. The straight arms 2015/second slot 2015*a* are preferably straight arms that go toward the center in a slant. The machine is approximately seven feet high so that the device can be utilized by users of varying heights. All six arms are able to go very low or are able to be adjusted to low levels, down to approximately 3 feet and 7 inches from the bottom mat 2013. The slots 2014*a*, 2015*a*, 2016*a* are designed to have the capability to make the arms 2014, 2015, 2016 work in a one foot position as well for small kids and people. Accordingly, the machine has a height range for the arm movement extending from 3 feet, 7 inches up to 7 feet.

The arms can be moved to heights located there between to adjust to the height or arm range of the user. The arms have the ability to work in a downward slant and upward slant so that a user can practice fighting people shorter and/or taller than himself or herself. The straight middle arms (2015) can be adjusted down low and slant in an upward position, for a taller person to practice fighting a shorter person. Also, preferably the hook arms and the uppercut arms (2016, 2014, respectively) have elbow joints, more significantly the uppercut arms, so that the machine can throw a half hook/half uppercut punch.

The machine is in communication with a power source, and may include a manual on/off power switch or a sensor can activate the machine. A control panel may be provided that allows some of the arms to be turned off, while others are on so that a user can just work on hooks, etc. The machine may be programmed to carry out random maneuvers or unpredictable combinations, or programmed to utilize pre-programmed combinations and/or workout or practice routines. What is more, the machine control pad includes different speeds and user levels, including slow, fast, faster, pro speeds; and/or levels of beginner, intermediate, or advanced.

The arms include removable gloves that may be screwed on or snapped on or placed over the arms. The gloves are durable and stay secured during use. The purpose of the removable gloves is that the gloves can be composed of different materials or flexibility levels. For example, customers who are afraid or can't withstand a punch can put on the safe optional cushioned type of glove. Harder gloves can be provided for more advanced users.

FIG. 1*d* illustrates a perspective view of the embodiment of the fight simulation apparatus of the subject invention where the multi-head, multi-abdomen, and multi-arm apparatus 2032 is removed from the slip and counter machine and placed on a free standing apparatus 2050 as a punching or kicking bag type structure (for example). Preferably, the fee standing apparatus 2050 includes a water filled base 2051. The slip counter is shown in phantom to illustrate that the multi-head, multi-abdomen, and multi-arm apparatus 2032 may be placed on the device alone to provide a punching or kicking bag type configuration.

Figure 1E:
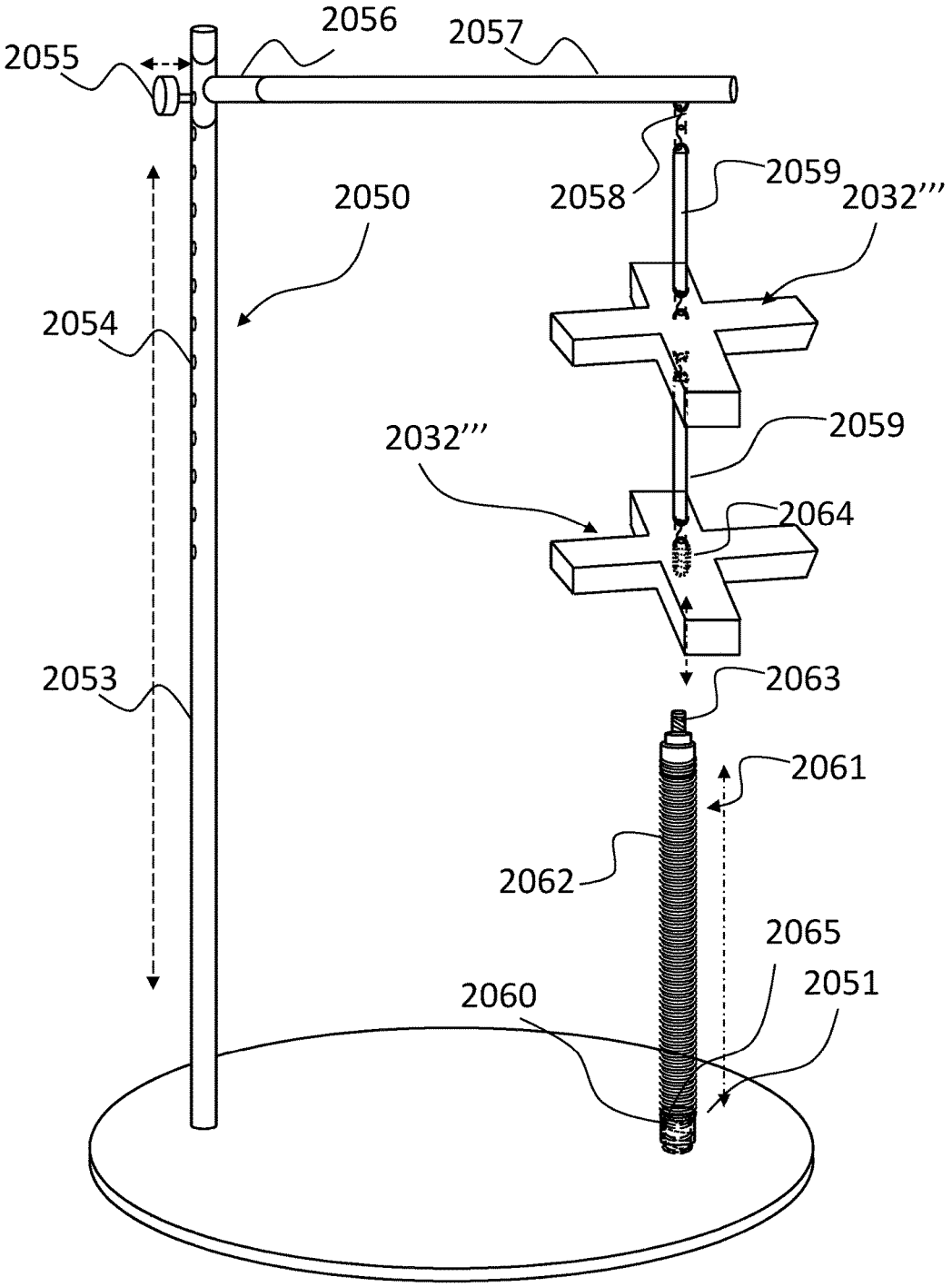
FIG. 1*e* illustrates a perspective view of the embodiment of the fight simulation apparatus of FIG. 1*d* wherein the multi-head, multi-abdomen, and multi-arm apparatus is removed from the free standing apparatus and interchanged with 4-sided cross-shaped head pads (for example)
Figure 12:
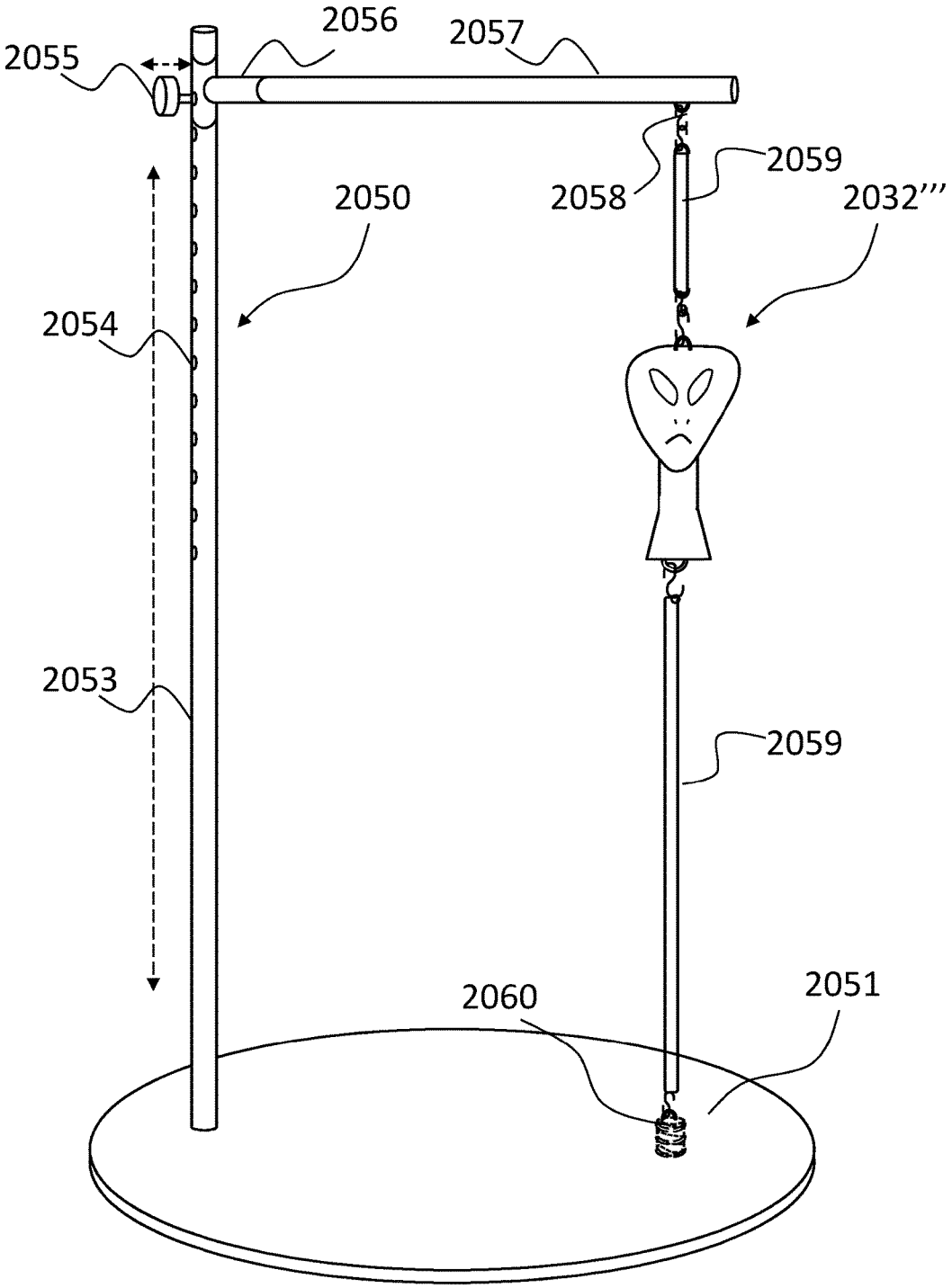
FIG. 12 illustrates a perspective view of the embodiment of the fight simulation apparatus of the subject invention where a multi-head apparatus being a single head interchangeable part is removed from the slip and counter machine and placed on an adjustable free standing apparatus as a punching or kicking bag type structure (for example)

FIG. 1*e* illustrates a perspective view of the embodiment of the fight simulation apparatus of FIG. 1*d* wherein the multi-head, multi-abdomen, and multi-arm apparatus 2032 is removed from the free standing apparatus 2050 and interchanged with 4-sided cross-shaped head pads 2032' (for example). Additionally, FIG. 12 illustrates a perspective view of the embodiment of the fight simulation apparatus of the subject invention where a multi-head apparatus being a single head interchangeable part 2032' is removed from the slip and counter machine and placed on the adjustable free standing apparatus 2050.

Referring to FIGS. 1*d,* 1*e,* and 12 generally, the adjustable free standing apparatus 2050 includes a support pole 2053 having height adjustable apertures 2054 adapted to receive a pin 2055 that locks into place a t-bar connector 2056 having a horizontal support pole 2057 extending therefrom. In turn, horizontal support pole 2057 include attachment means (i.e. a hook) 2058 for securing an apparatus thereto. The apparatus may be bungee cords or flexible elastomeric cords 2059 which in turn connect to the interchangeable member, 2032, 2032' or 2032''' in FIGS. 1*d,* 1*e* and 12, respectively. At the base 2051 a connection means 2060 is provided which in turn may be a threaded connector that is adapted to attach to an insert pole 2061 as shown in FIG. 1*e.* Insert pole 2061 includes a strong flexible spring 2062 in the middle of the pole 2061, and has a threaded top 2063 to screw into the bottom of the abdomen of 2032 (or into the bottom of 2032' or 2032'', etc.) which in turn has a threaded aperture 2064 therein. The bottom of the pole 2061 includes a threaded aperture 2065 therein for receiving the threaded connector of connection means 2060. Height adjustable holes/adjustable apertures 2054 are located at the bottom of the support pole 2053 along with a tightening knob or pin 2055. If the free standing device 2050 is being utilized in conjunction with the slip and counter machine of FIG. 1 (for example) doors may be provided in the back of slip and counter machine of FIGS. 1*a* and 1*c,* located behind each side wall, so that the user would have access to changing the height of the arms. Once a user is done training on one side of the multi apparatus, he/she can simply unhook and spin the multi apparatus around in the Slip and Counter and proceed to use the other side. The multi-member apparatus allows two or three arms to come toward a user simultaneously along with at least one arm in at least one side wall on each side.

Figure 1F:
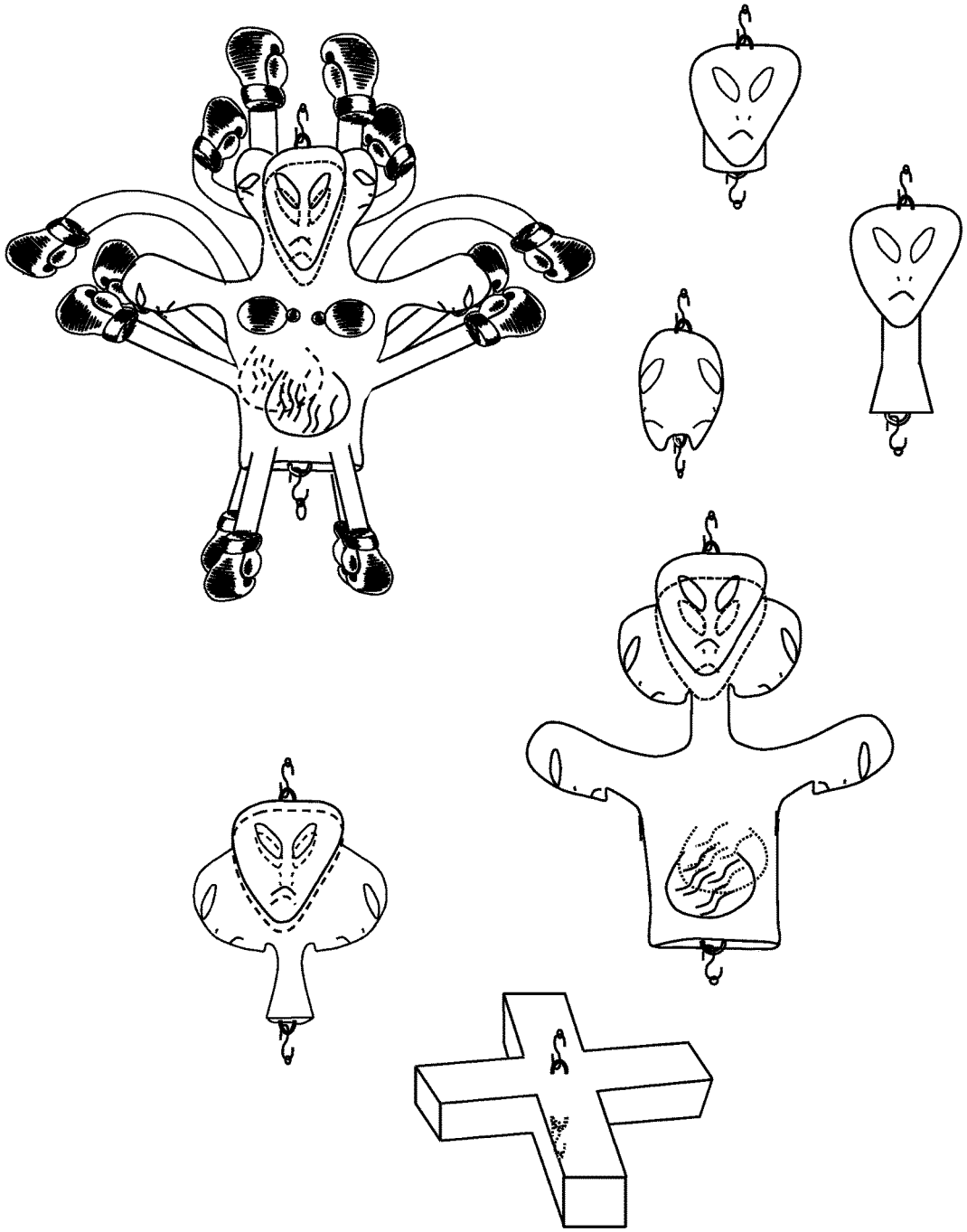
FIG. 1*f* illustrates views of the different punch-able members that can be interchanged on the apparatus, including showing the multi-headed member, a single head member, a single stomach member, and the multi-stomach member.

FIG. 1*f* illustrates views of the different punch-able members that can be interchanged on the apparatus, including showing the multi-headed member, a single head member, a single stomach member, a single headed alien, four-headed alien, the multi-stomach member, 4-sided cross-shaped head pads, etc.

Figure 1G:
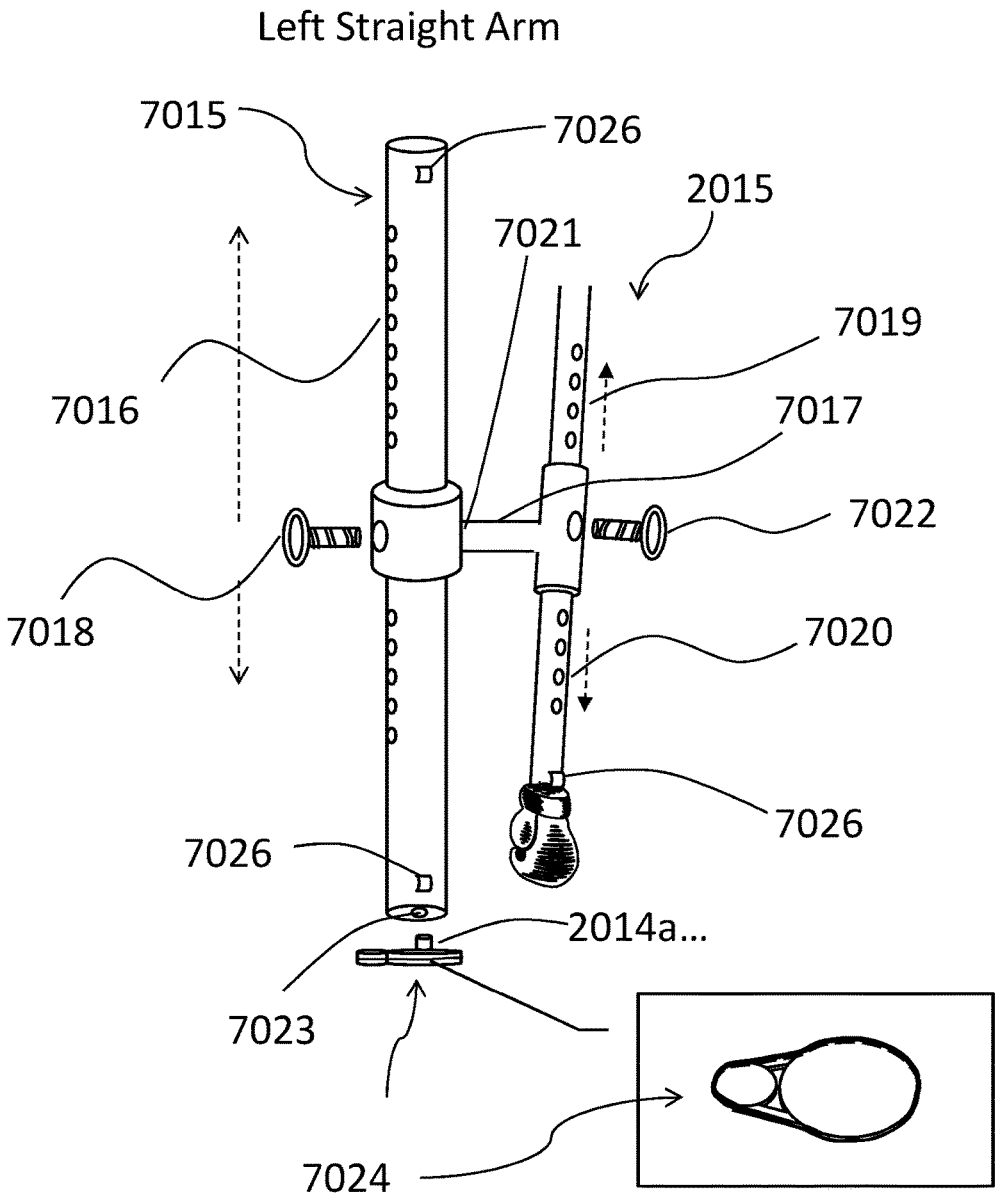
FIG. 1*g* illustrates views of the movable left straight arm configuration of the slip and counter machine of FIG. 1*a;*
Figure 1H:
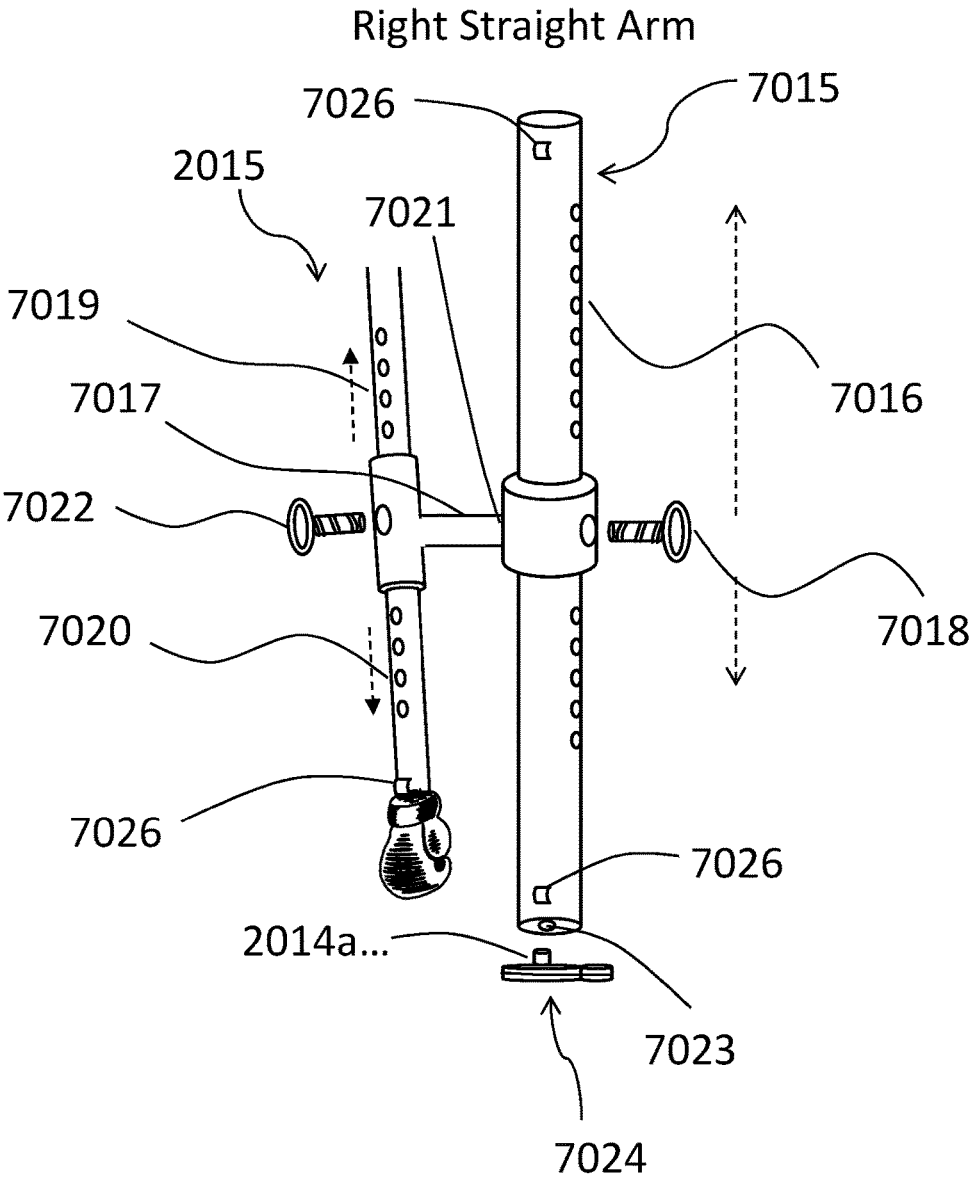
FIG. 1*h* illustrates views of the movable right straight arm configuration of the slip and counter machine of FIG. 1*a;*
Figure 1I:
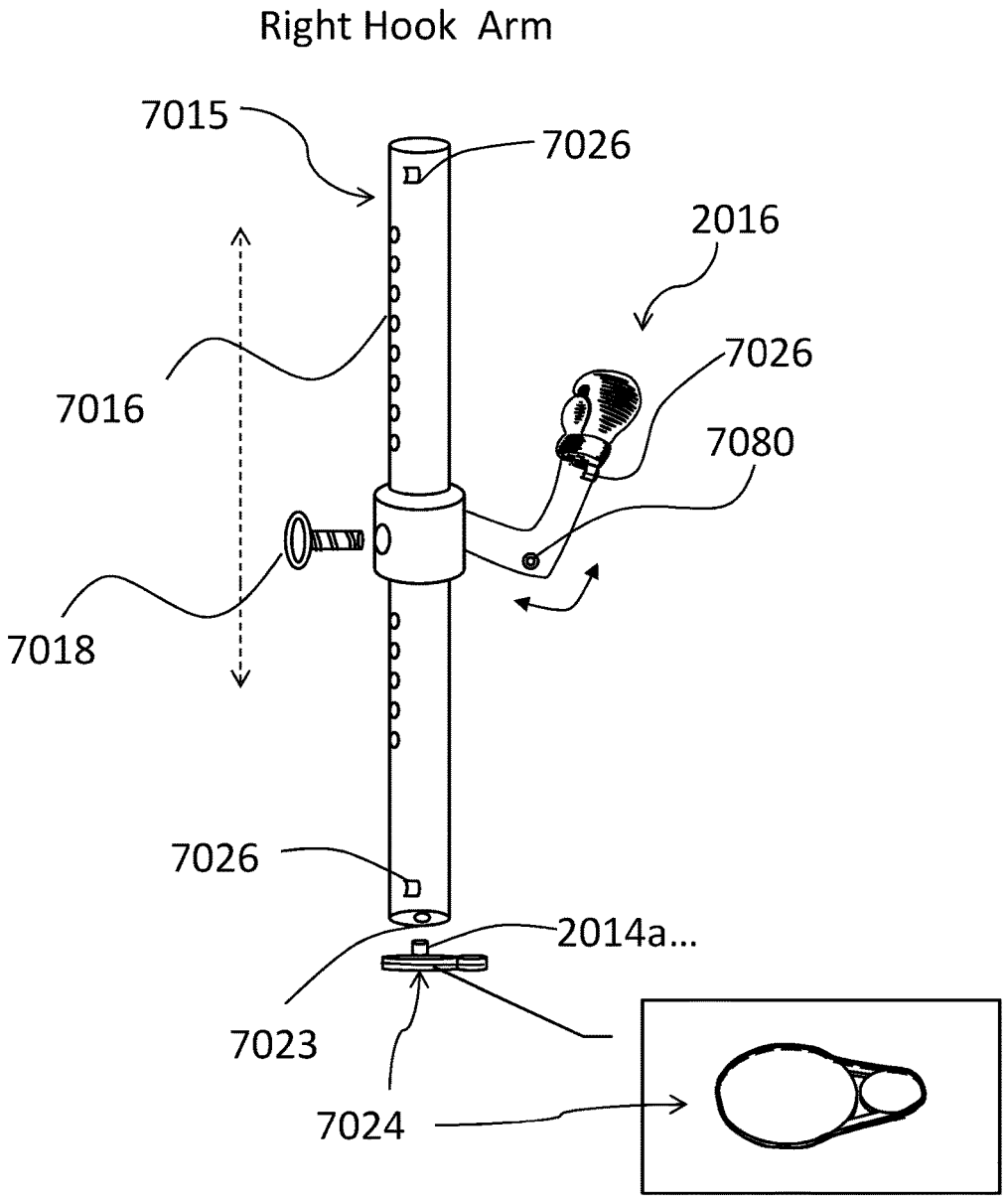
FIG. 1*i* illustrates views of the movable right hook arm configuration of the slip and counter machine of FIG. 1*a;*
Figure 1J:
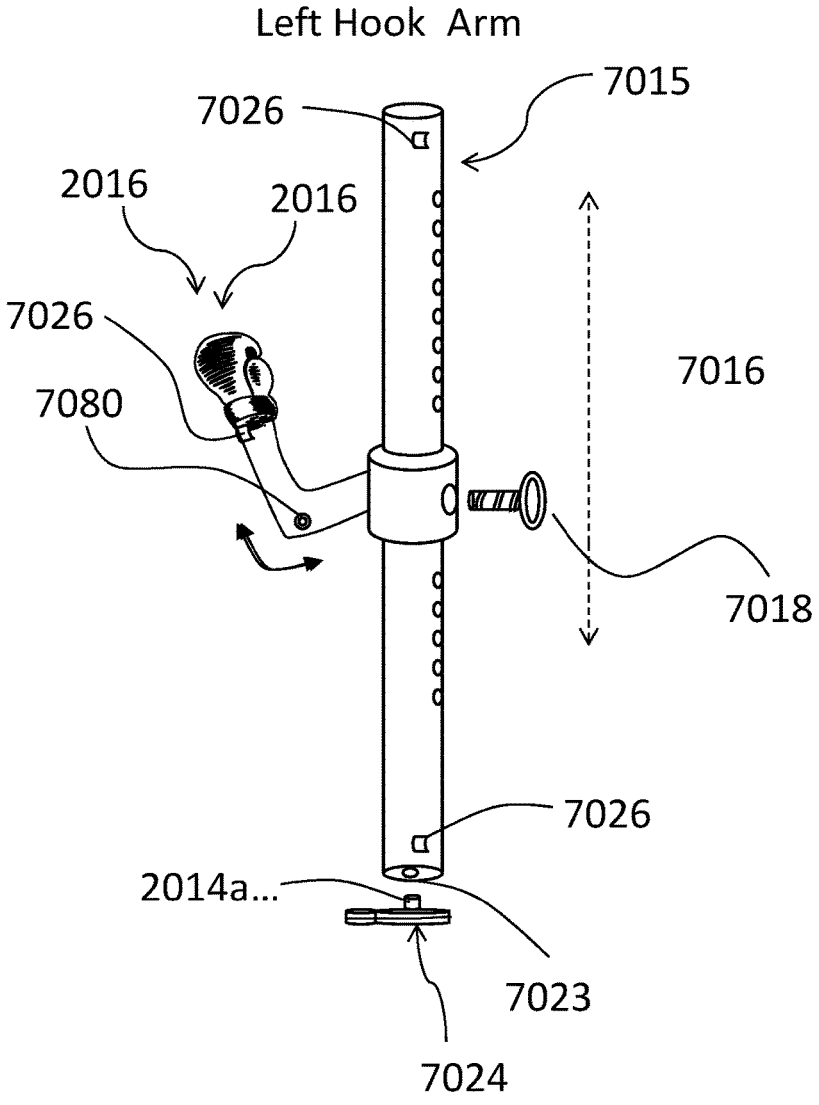
FIG. 1*j* illustrates views of the movable left hook arm configuration of the slip and counter machine of FIG. 1*a;*
Figure 1K:
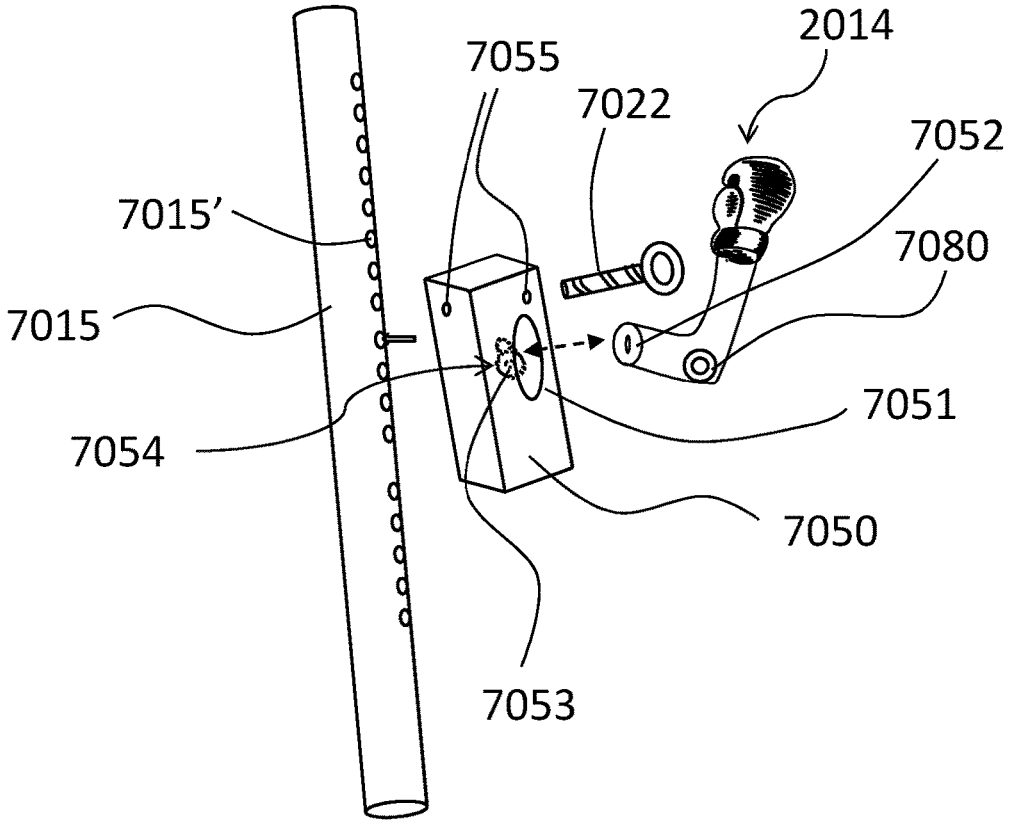
FIG. 1*k* illustrates views of the movable right uppercut arm configuration of the slip and counter machine of FIG. 1*a;*
Figure 1L:
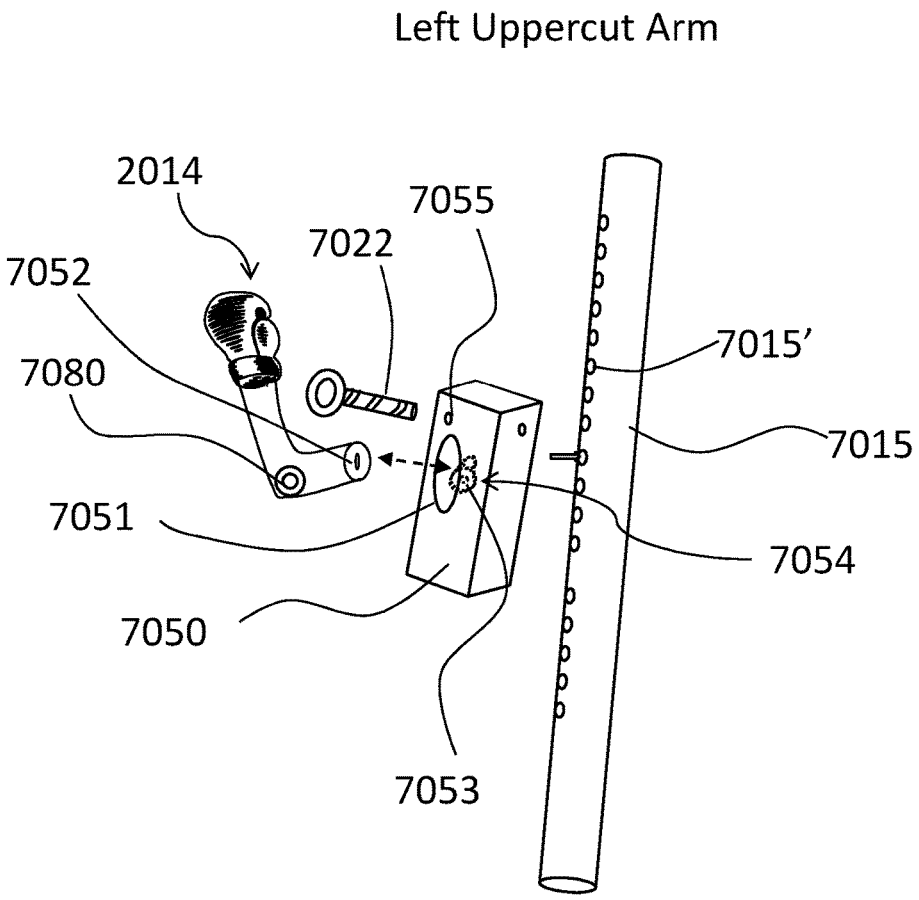
FIG. 1*l* illustrates views of the movable left uppercut arm configuration of the slip and counter machine of FIG. 1*a;*

FIG. 1*g* illustrates views of the movable left straight arm 2015 configuration of the slip and counter machine of FIG. 1*a.* FIG. 1*h* illustrates views of the movable right straight arm 2015 configuration of the slip and counter machine of FIG. 1*a.* FIG. 1*i* illustrates views of the movable right hook arm 2016 configuration of the slip and counter machine of FIG. 1*a.* FIG. 1*j* illustrates views of the movable left hook arm 2016 configuration of the slip and counter machine of FIG. 1*a.* FIG. 1*k* illustrates views of the movable right uppercut arm 2014 configuration of the slip and counter machine of FIG. 1*a.* FIG. 1*l* illustrates views of the movable left uppercut arm 2014 configuration of the slip and counter machine of FIG. 1*a.*

Referring generally to FIGS. 1*g*-1*l,* the two side walls of the slip and counter machine are connected to poles 7015 having height adjustable holes 7016 for moving a t-bar 7017 with a corresponding hole for receiving a pin 7018 for height adjustment along pole 7015. T-bar 7017 is attached to a secondary pole 7020 via a swivel joint 7021. Straight arms 2015 of FIGS. 1*g*-1*h* include holes 7019 to change the length of the arm 2015. The straight arms 2015 have the ability to be angled either upward or downward by utilizing the swivel joint 7021 between the straight arms 2015 and pole 7015. The preferred angle, just like the preferred height will be held in place by a long threaded tightening knob, or pin 7022. There's a hole 7023 in the bottom of the pole so that two wheels with a belt 7024 are integrated therein that moves the wheels and belt so that the pole 7015 slides into the pole via at least one prong 2014*a-f* that's connected to the wheels 2013' (see FIGS. 1*a* and 1*b*). Although the gloves on the arms are pillow soft, preferably various proximity sensors 7026 are provided for safety. Preferably the sensors 7026 are at top and/or bottom of the poles and wrist of arms. Only the pillow soft glove will hit the user.

Referring generally to FIGS. 1*k*-1*l,* hook arms 2014 slide into a fairly-long box 7050 that has an elongated hole 7051 in it so that the arms 2014 will have enough room to go up and down. Hook arms 2014, 2016 include an elbow joint 7080 and an aperture 7052 therein adapted to receive a prong 7053 that is connected to wheels with belt 7054 there around to move the arms 2014 up and down, all inside of box 7050. The box 7050 has a hole 7055 in the front and the back that will align with the holes 7015' on the pole 7015 and will be held in place with a long threaded pin 7022 or threaded knob. Also the slip and counter machine of FIG. 1 can work with poles exposed as well, with no side walls at all or outer casing, with at least 1 or 2 arms. Pads may be provided around each of the arms. In this configuration, at least one arm can now come towards a user simultaneously, to practice fighting against a few people at once. Lastly, although that multi-headed, multi- abdomen, multi-armed alien apparatus has a few protruding arms, it absolutely is not a slip and counter apparatus. The multi-armed apparatus simply allows a user to practice against various boxing styles and how to punch, knee, flying knee or kick regardless to the position of opponent's arms or head. Each side poses a different challenge.

Figure 2A:
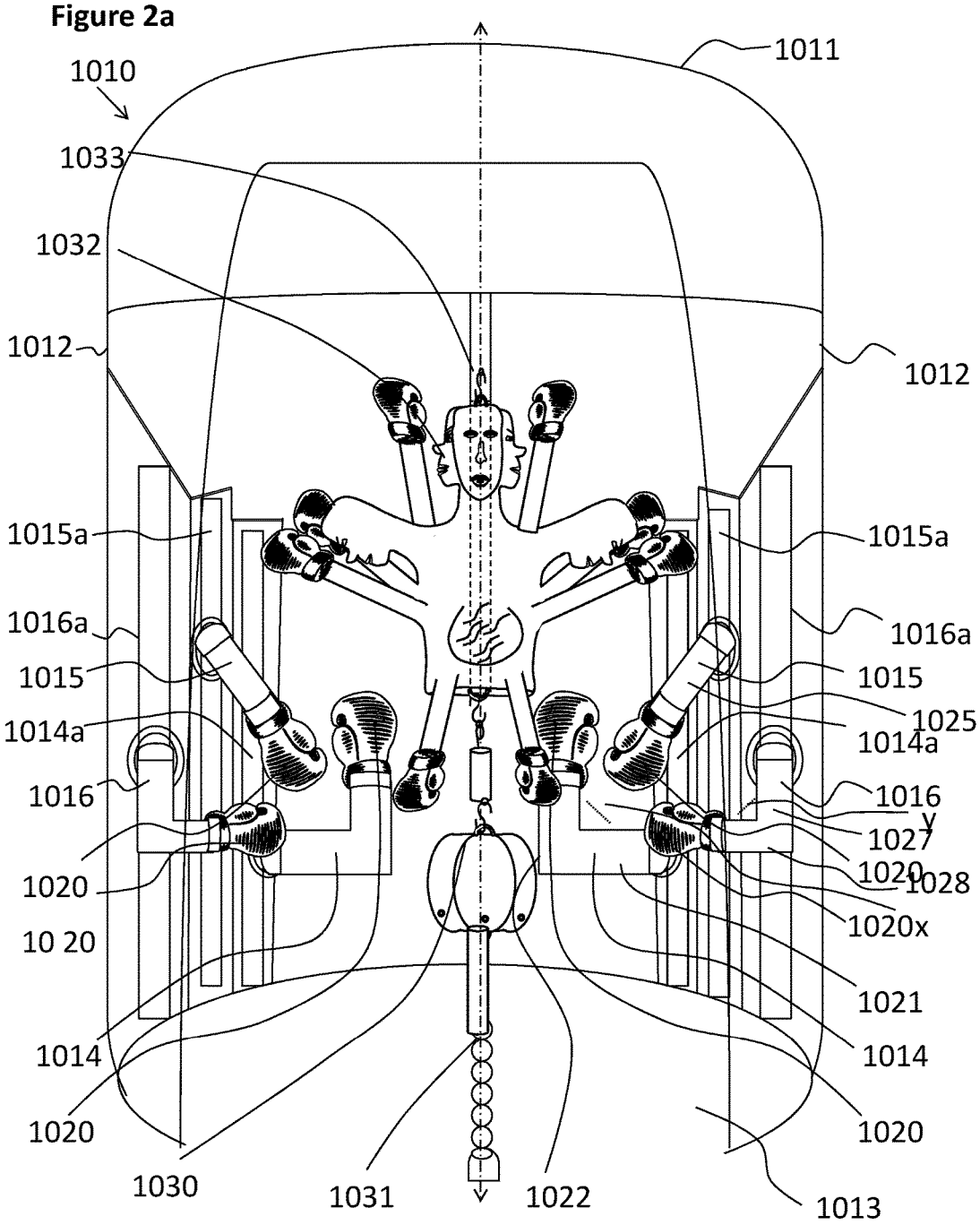
FIG. 2*a* illustrates a perspective view of an embodiment of the fight simulation apparatus of the subject invention, with a round or punch-able multi-stomach mid-section member counter area/element.
Figure 2B:
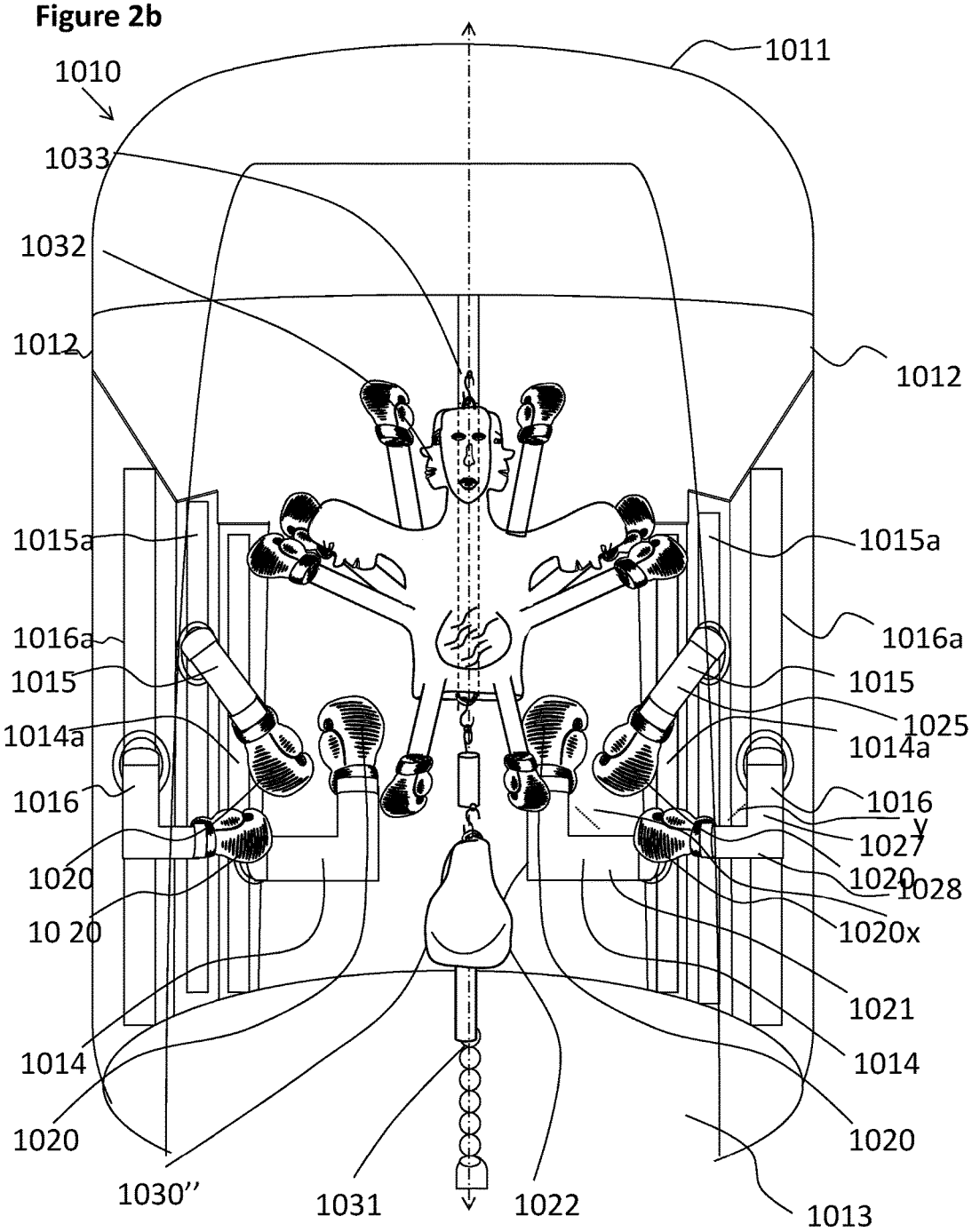
FIG. 2*b* illustrates the perspective view of the embodiment of FIG. 2*a,* however with a single round or punch-able stomach mid-section member counter area/element to illustrate interchangeability of the members.
Figure 2C:
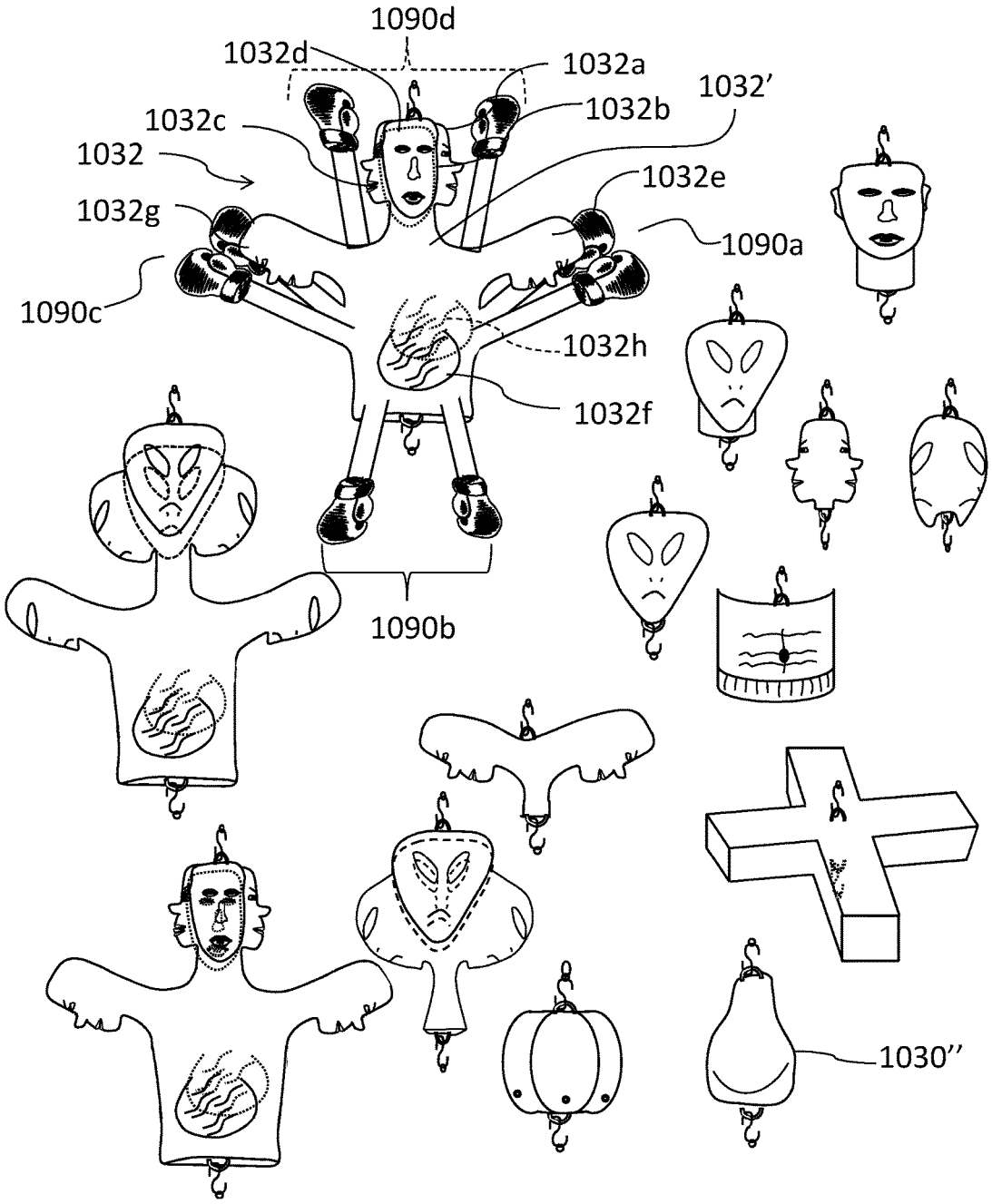
FIG. 2*c* illustrates views of the different punch-able members that can be interchanged on the apparatus, including showing the multi-headed member, a single head member, a single stomach member, and the multi-stomach member.
Figure 2D:
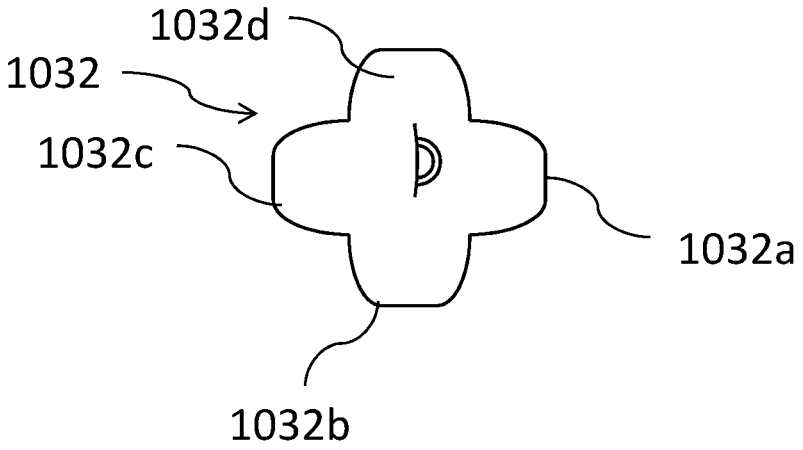
FIG. 2*d* illustrates a top view of the multi-head member.
Figure 2E:
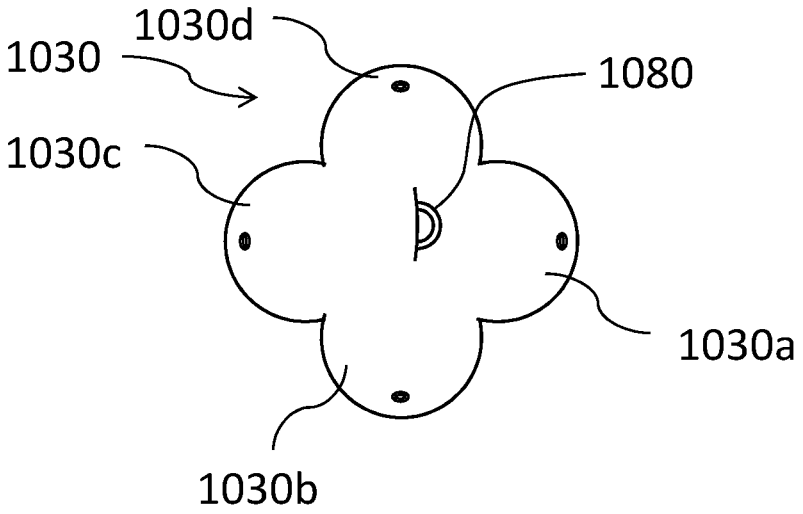
FIG. 2*e* illustrates a top view of the multi-stomach member.
Figure 3:
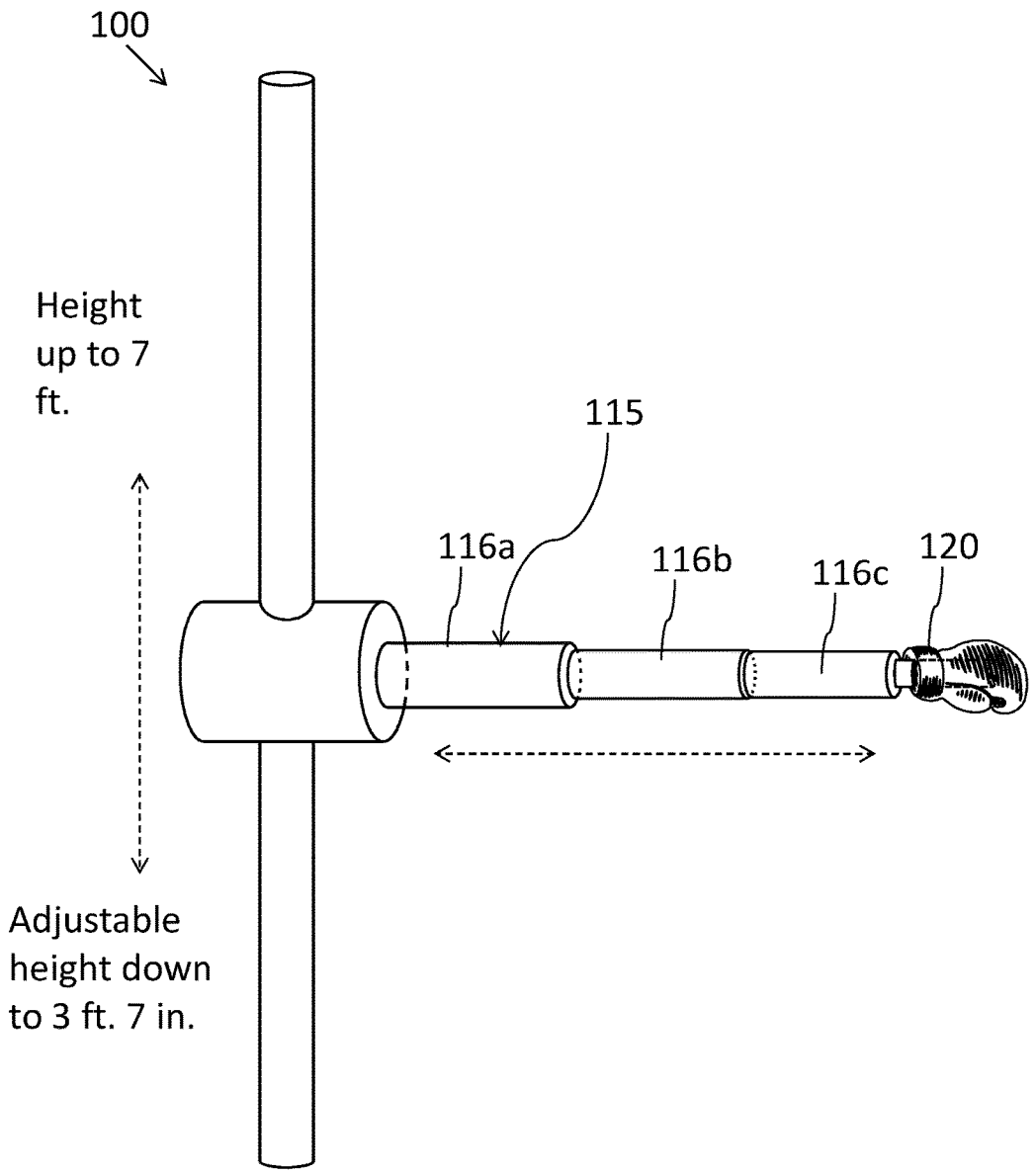
FIG. 3 illustrates a view of a center arm or straight punch arm wherein the arm is telescoping for length extension.

FIGS. 2*a*-2*e* illustrate perspective views of the subject fight simulation apparatus and interchangeable elements thereof. FIG. 2*a* illustrates a perspective view of an embodiment of the fight simulation apparatus of the subject invention, with a round or punch-able multi-stomach mid-section member counter area/element. FIG. 2*b* illustrates the perspective view of the embodiment of FIG. 2*a,* however with a single round or punch-able stomach mid-section member counter area/element to illustrate interchangeability of the members. FIG. 2*c* illustrates views of the different punch-able members that can be interchanged on the apparatus, including showing the multi-headed member, a single head member, a single stomach member (1030''), the multi-stomach member, 4-headed alien member, and 4-sided cross pads. FIG. 2*d* illustrates a top view of the multi-head member. Lastly, FIG. 2*e* illustrates a top view of the multi-stomach member.

FIG. 2*a* illustrates a perspective view of an embodiment of the fight simulation/workout machine, shown generally at 1010. FIG. 2*b* illustrates the perspective view of the embodiment of FIG. 2*a,* however with a round or punch-able mid/stomach section counter area/element interchanged in. Referring to FIGS. 2*a*-2*d,* the fight simulation/workout machine 1010 generally includes a U-Shaped construct having a top wall 1011, at least two parallel side walls 1012 arranged opposite from one another with an optional, but not required, bottom floor mat 1013. As used herein, the term "U-Shaped" is meant to be a ground view of the device 1010 as one stands directly in front of the device 1010. In this manner, a user is appointed to walk into the U-shape between the side walls 1012 and is thus substantially surrounded by the device. That is to say, the user's front, and sides are in proximity with the side walls 1012 of the device as the user walks inside the U-shape; providing a device

1010 having side walls 1012 forming an arc ranging from about 90 degrees up to about 270 degrees.

Preferably, the side walls 1012 are arced or curved and form a semi-circle of about 180 degrees. In this manner, fight simulation is optimized to substantially surround a user who walks into the U-shaped device (sides and front of user).

The slip and counter machine may include a sensor for activating or turning on the machine 1010. Alternatively, the device may be constructed with/without a bottom floor mat 1013 and instead there may simply be a sensor beam located near the bottom of one or more of the side walls 1012, or top wall 1011. Sensors are preferably located within or in close proximity to the movable arms of the slip and counter machine. It is further contemplated that the device may be constructed without a top wall 1011. In any event, the device includes side walls 1012 constructed in a manner so that a user can step into the device 1010 and the side walls 1012 substantially surround the user in that the side walls 1012 are located on the sides and front of the user.

Within side walls 1012 there are a series of arms 1014, 1015, 1016 extended within first, second and third slots 1014*a*, 1015*a*, 1016*a*, respectively, that allow the arms to adjust height wise from the floor mat 1013, on a substantially vertical plane. The slots 1014*a*, 1015*a*, 1016*a* or tracks are located substantially parallel to one another and are substantially perpendicular to the bottom floor mat 1013. Preferably there are three arms 1014, 1015, 1016 as shown, each located in separate slots 1014*a*, 1015*a*, 1016*a* and each being capable of being adjusted along the vertical plane extending from the floor/ground level/or bottom floor mat 1013. Each of the arms 1014, 1015, 1016 are spaced and constructed to deliver different punch types/provide different extension ranges for delivery of different punches, as discussed hereinafter.

The arms 1014, 1015, 1016 are provided within slots 1014*a*, 1015*a*, 1016*a* so that the arms 1014, 1015, 1016 vertically traverse the slots 1014*a*, 1015*a*, 1016*a* to accommodate users of varying heights. The arms and slots may include tongue and groove mating means, with teeth and mating slots. Alternatively, hydraulics and/or electronics may be used for movement of the arms 1014, 1015, 1016 along slots 1014*a*, 1015*a*, and 1016*a*.

Each of the arms 1014, 1015, 1016 includes a glove appendage member 20 thereon. Preferably, glove appendage members 20 are removable and different grade glove members 20 are provided, including pillow soft, soft, medium, hard.

Arm 1014 includes at least on elbow joint connecting an upper arm portion 1021 and a lower arm portion 1022 and provides an angle x located there between. FIG. 5 illustrates arm 1014, 1016 jointed configurations. Arm 1014 is appointed to deliver uppercut type punches. Arm 1016, like arm 1014, includes an elbow joint connecting an upper arm segment 1027 and a lower arm segment 1028 and provides an angle y located there between. Arm 1016 is appointed to deliver hook type punches. Advantageously, the purpose for the elbow joints on the hook arms 1016 are for tighter hooks, in case a user prefers fighting up close. The purpose for the elbow joints on the uppercut arms 1014 is so the half uppercut-half hook punch can be thrown.

In contrast, arms 1015, located centrally between arms 1014 and 1016, and are preferably constructed on as straight members 1025 that are angled downward (or upward) from side walls 1012. Preferably, arms 1015 slant or angle toward the center of the device 1010 and said angle is adjustable as illustrated by way of FIG. 4. As so constructed, arm 1015 delivers straight punches. Preferably, arms 1015 are provided as telescoping arms as shown in FIGS. 2 and 3.

Continuing with FIGS. 2*a* and 2*b*, counter areas/elements are provided, generally including a mid/stomach section counter area/element 1030 (1030' in FIG. 2*b*: providing a punch-able element like structure embodiment) having a strong cable 1031 or bungee cord, and a counter area/element shown as a multi headed member 1032. Cable 1031 may be composed of a flexible material so that the cable 1031 gives a little to avoid hurting the user's wrists; alternatively, cable 1031 may be composed of a rigid material but in such an event cable 1031 has some slack in order to give so it won't hurt the user's wrists. The counter areas are to be positioned in the back and center of the machine, the same way a user's body would be behind his/her arms in the fighting position.

Each of the counter elements, herein 1030 and 1032, are interchangeable, including use of the different punch-able members that can be interchanged on the apparatus, including showing the multi-headed member, a single head member, a single stomach member, and the multi-stomach member. These members are shown for example in FIG. 2*c*.

In the embodiment shown, and referring to FIGS. 2*a*, 2*b* and 2*d* specifically, a multi headed member 1032 is provided having eight heads 1032*a-h*, each with faces thereon (see FIG. 2*c*). The top portion 1032' of the multi headed member 1032 is constructed having four heads 1032*a-d* (see FIG. 2*c*), interconnected to one another. Directly on the top center there is a u-shaped loop 1032" for an s-hook 1033 to hook onto. Top portion 1032' extends to an abdomen which in turn includes four more heads 1032*e-h* (heads 1032*f* and 1032*h* are shown as back of heads inasmuch as they are angled downward at an angle). These heads 1032*e-h* are faced in an angle a little higher than facing towards the ground, and the necks are somewhat long. The angle of these heads 1032*e-h* preferably ranges from 30 degrees to 80 degrees in relation to the horizontal plane or ground surface. More preferably, the angle ranges from 35 degrees to 55 degrees. Most preferably, the angle is about 45 degrees. The plurality of heads provides various heads for numerous positions, strikes, timing, speed and accuracy. Preferably there are at least two heads, more preferably there are at least four heads, and most preferably there are at least eight heads as shown (as shown). [See FIG. 2*c* for more embodiments]. This multi headed apparatus most preferably has a total of eight faces and five heads. The side of each face on the four sided head preferably terminate or stop right before where an ear would appear, such as on a typical human head, so that the side of each head can be hit. Consequently, there will be no ears or back of head on the four face head portion of the multi headed member.

In the embodiment shown, and referring to FIGS. 2*a*, 2*b* and 2*e* specifically, a multi stomach member 1030 is provided having four stomachs 1030*a-d*. In this manner, as opposed to striking just one stomach hooked on to one end of a bungee cord, the user can strike various stomachs. Directly on the top center of the four sided portly stomachs there is a u-shaped loop 1080 for an s-hook 1022 to hook onto. Likewise concerning the multi stomach member, preferably each stomach will have each side exposed for side hits, but no backs will be exposed or provided.

Additionally, at least one set of arms 1090 is provided. Most preferably eight sets of arms are provided, 1090*a-d* (see FIG. 2*c*). The hands of the arms are preferably in the form of boxing gloves. One set of the arms is located in the front of the faces of the upper four faced head portion with gloved hands protecting both sides of the chin. The other three sets of arms are located in front of three out of the four angled heads; with extra arms being located on the apparatus in varying locations. Though the gloved hands are located on the side of the chins, none of the gloved hands are too close to the chins as there must be enough space for the user to punch around the arms and gloves of the apparatus. The multi headed member bottom preferably includes a threaded hole. A strong spring pole with a thread at both sides of the pole is screwed into the bottom of the stomach member. The other end of the spring pole screws into the bottom of the slip and counter apparatus. Additionally spring poles and bungee cords are provided with the device to provide for various heights and placement of the multi headed member and multi stomach member.

Counter areas/elements are preferably made in the shape of a human stomach. These counter elements can alternatively comprise circular counter spots, and the shape of the areas/elements can be hexagonal with counter spots thereon. In one embodiment, there are only two areas/elements: a mid-section (stomach area) area/element having a strong cable on it so that it does not move and preferably resembling an oblong oval or pear corresponding to the look of a portly belly area on a person, and a head counter area/element having rubber straps so that it can move a little more, but not as much as a double end bag. The counter areas/elements are to be positioned in the back and center of the machine, the same way a user's body would be behind his/her arms in the fighting position. The counter areas/elements should come with different cables and different rubber straps, for different height/sized customers.

The machine is preferably constructed having a U-shaped or arc-shaped construction. The uppercut slot 1014*a* for the uppercut arm 1014 is located the furthest away from the user and the closest arms towards the back of the device 1010, close to the counter areas/elements. The second or middle slot 1015*a* is appointed to deliver straight punches via the straight arm 1015. The third slot 1016*a* is for holding hook arm 1016 and for thus delivering deliver hook type punches. The straight arms 1015/second slot 1015*a* are preferably straight arms that go toward the center in a slant. The machine is approximately seven feet high so that the device can be utilized by users of varying heights. All six arms are able to go very low or are able to be adjusted to low levels, down to approximately 3 feet and 7 inches from the bottom mat 1013. The slots 1014*a*, 1015*a*, 1016*a* are designed to have the capability to make the arms 1014, 1015, 1016 work in a one foot position as well for small kids and people. Accordingly, the machine has a height range for the arm movement extending from 3 feet, 7 inches up to 7 feet.

The arms can be moved to heights located there between to adjust to the height or arm range of the user. The arms have the ability to work in a downward slant and upward slant so that a user can practice fighting people shorter and/or taller than himself or herself. The straight middle arms (1015) can be adjusted down low and slant in an upward position, for a taller person to practice fighting a shorter person. Also, preferably the hook arms and the uppercut arms (1016, 1014, respectively) have elbow joints, more significantly the uppercut arms, so that the machine can throw a half hook/half uppercut punch.

The machine is in communication with a power source, and may include a manual on/off power switch or a sensor can activate the machine. A control panel may be provided that allows some of the arms to be turned off, while others are on so that a user can just work on hooks, etc. The machine may be programmed to carry out random maneuvers or unpredictable combinations, or programmed to utilize pre-programmed combinations and/or workout or practice routines. Moreover, the machine control pad includes different speeds and user levels, including slow, fast, faster, pro speeds; and/or levels of beginner, intermediate, or advanced.

The arms include removable gloves that may be screwed on or snapped on or placed over the arms. The gloves are durable and stay secured during use. The purpose of the removable gloves is that the gloves can be composed of different materials or flexibility levels. For example, customers who are afraid or can't withstand a punch can put on the safe optional cushioned type of glove. Harder gloves can be provided for more advanced users.

FIG. 3 illustrates a view of a center arm or straight punch arm wherein the arm is telescoping for length extension, shown generally at 100. As herein illustrated, straight arm 115 (arm 15 in FIG. 1) located centrally to the other arms, preferably includes telescoping members 116*a-n*. Telescoping members 116*a-n* slide within each neighboring member so that the arm 115 can be extended lengthwise. The members 116*a-n* may include locking mechanisms and marking or measuring mechanisms for length adjustment. Preferably, to ensure a user does not get injured, a sensor 120 is incorporated in the wrist area of all the six arms, as indicated herein. The sensor 120 assures that the mechanical arms stop at roughly one foot from the user. Pillow soft gloves for example should be about one foot two inches long on all six arms.

Figure 4:
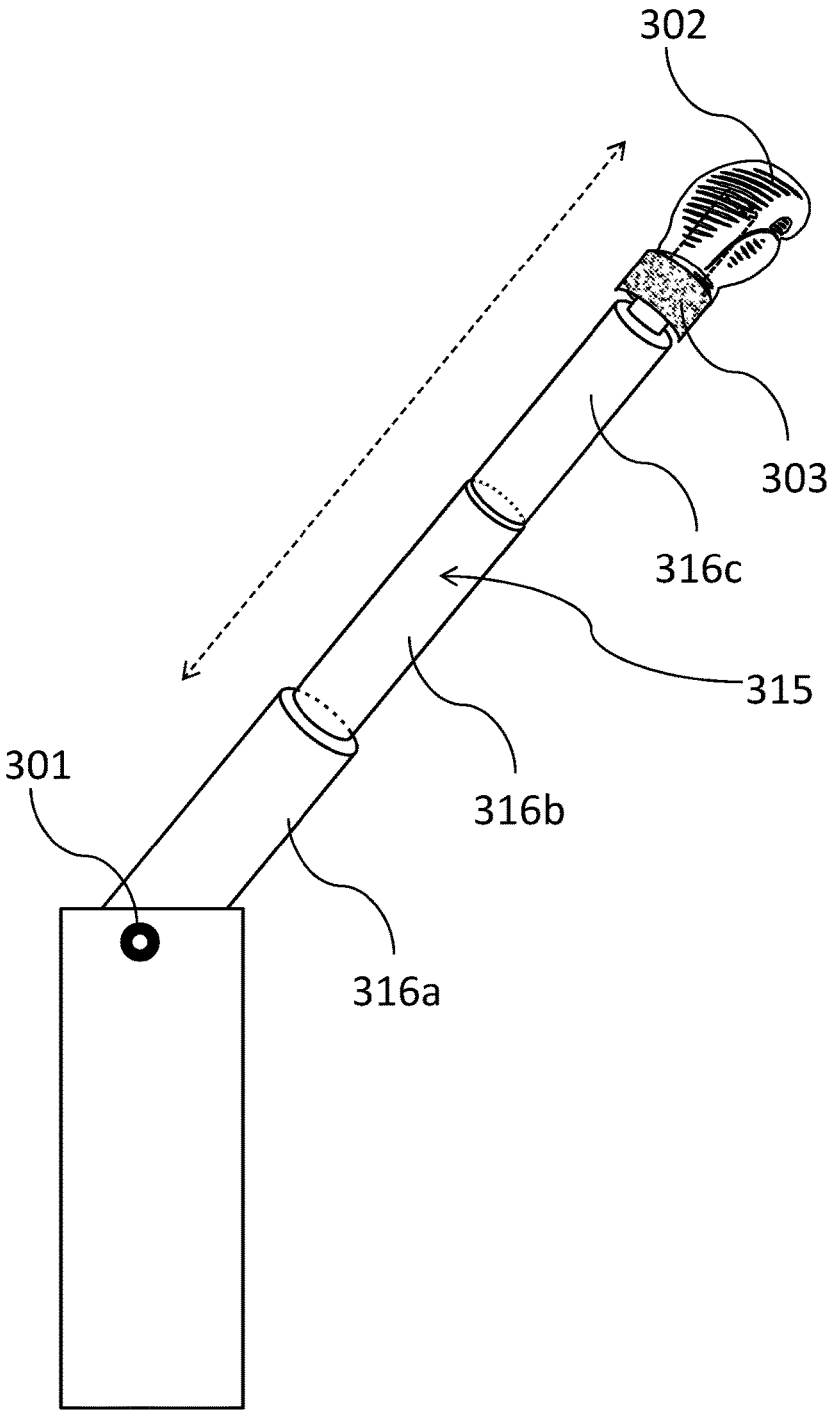
FIG. 4 illustrates a view of a center arm or straight punch arm wherein the arm is telescoping for length extension and is provided with a flexible joint at the slot-arm interface.

FIG. 4 illustrates a view of a center arm or straight punch arm 315 (i.e. arm 15 of FIG. 2) wherein the arm is telescoping for length extension and is provided with telescoping members 316*a-n* attached to a flexible joint 301 at the slot-arm interface. Pillow gloves 302 should be about one foot 2 inches long. A sensor 303 is provided at the wrist of the glove for preventing actual contact or to mitigate contact force. As sensor 303 senses the user's body within close proximity the arm movement slows or stops to prevent or mitigate contact force. The position of the arm as shown in the figure illustrates an example of when a tall person sets the angle and height extension of arm 315 as if practicing to fight a shorter person and vice versa.

FIG. 5 illustrates a view of a left hook arm, showing flexible joints, shown generally at 400. Left hook arm 414 is appointed to deliver uppercut type punches. Arm 414 includes at least one elbow joint 417*a-n* and wrist sensor 420. The purpose for the elbow joints is to provide tighter hooks, in case a user prefers fighting up close.

Figure 6:
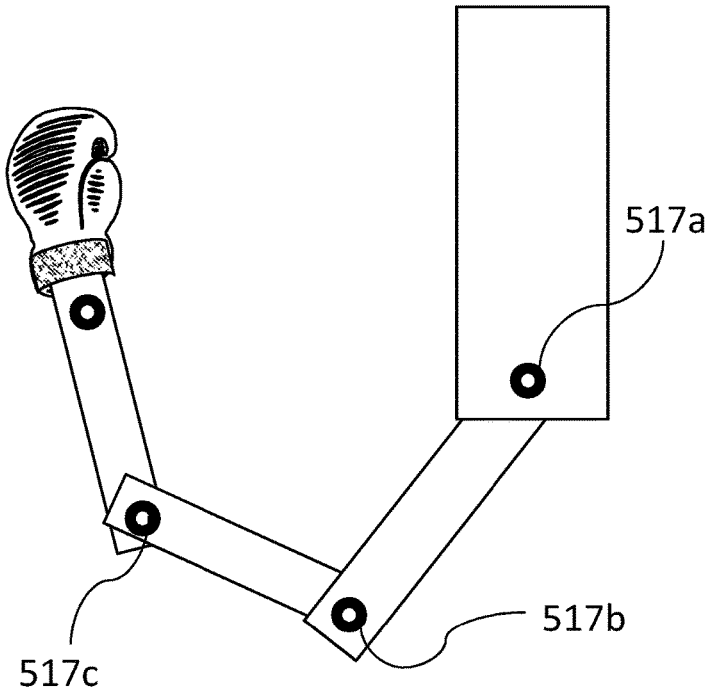
FIG. 6 illustrates a view of a left upper-cut arm, showing flexible joints.

FIG. 6 illustrates a view of a left upper-cut arm, showing flexible joints 517*a-n*. The machine is preferably shaped like a capital letter D without the straight line, or a U-shape, like a boomerang shape. The straight arms should have the ability to change reach for different size users. For example, various fighters have varying arm reaches: 80" reach (taller users), 72" reach (average height male), 65" reach (for smaller users), 60" reach, and 52" setting (for small users). A sensor may be integrated into the floor matt of the machine that triggers the machine into the on position and activates the arms. The sensor can begin after a time interval, such as 3-2-1, in order for the user to get ready for the simulation.

Figure 7:
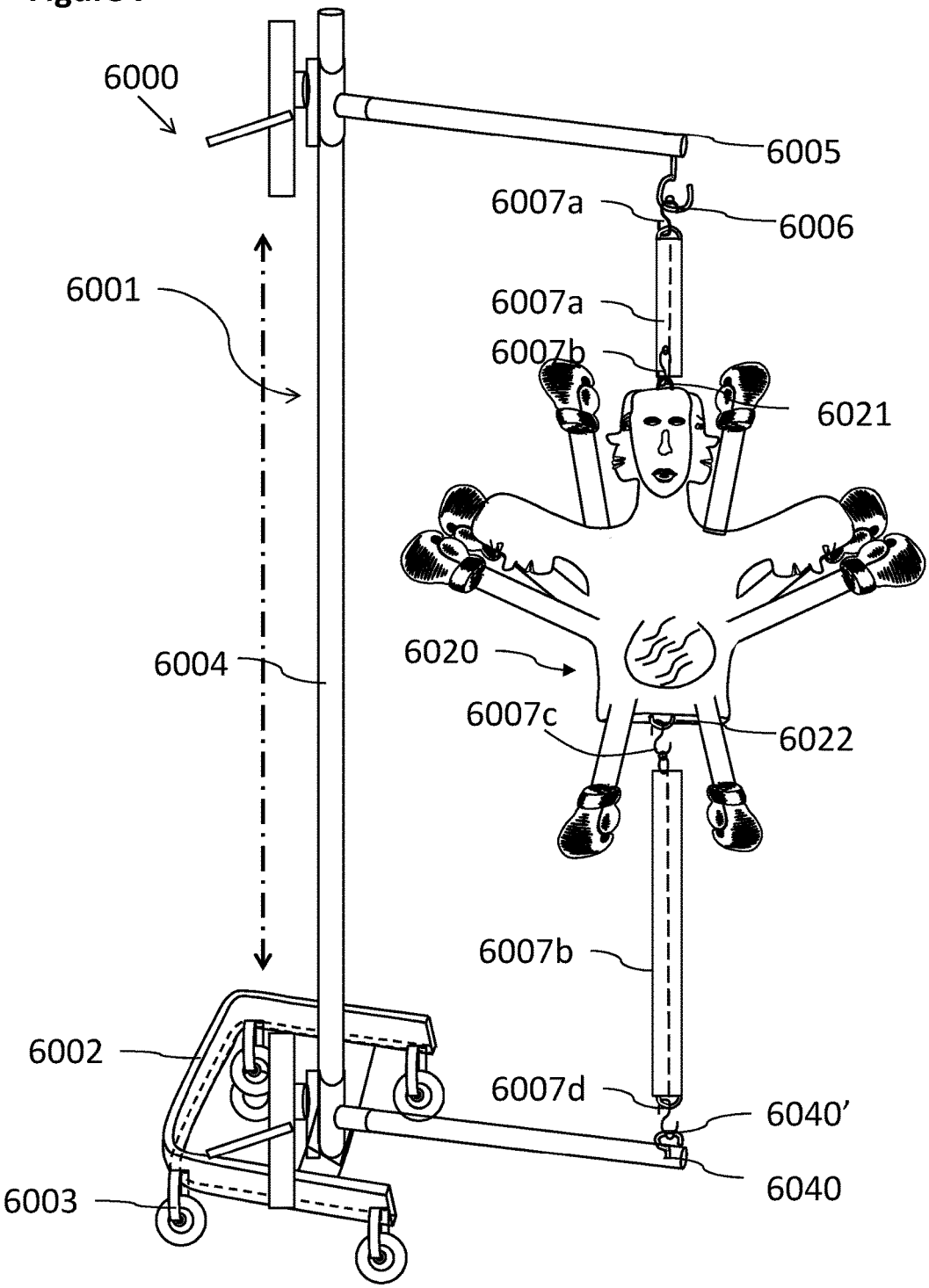
FIG. 7 illustrates a view of an embodiment of the subject invention wherein a mobile free multi-head member is provided.

FIG. 7 illustrates a view of an embodiment of the subject invention wherein a mobile free standing slip and counter machine is provided, shown generally at 6000. The free standing fight simulation workout machine 6000 comprises a main support structure 6001 formed herein with a base 6002 having locking wheels 6003 thereon for moving of the structure 6001. The structure 6001 further includes a vertical pole member 6004 extending upward with movable or height adjustable horizontal pole member 6005 extending horizontally therefrom. Horizontal pole member 6005 can be moved up and down vertical pole member 6004 for height adjustment. On the bottom side of horizontal pole member 6005 is a mounting loop 6006 thereon for attaching a first s-hook 6007*a* thereto, the first s-hook 6007*a* further is connected to a first cord (bungee) 6008*a*. The other end of first cord 6008*a* in turn is adapted to receive another s-shaped hook 6007*b*. At least one counter area/element 6020 is provided including a top having a u-shaped loop 6021 thereon for receiving second s-shaped hook 6007*b* adapted to be attached to the first cord 6008*a*. The counter area/element 6020 includes a bottom having a u-shaped loop 6022 thereon for receiving a third s-shaped hook 6007*c* adapted to be attached to a second cord 6008b, the second cord (bungee) 6008*b* having a fourth s-shaped hook 6007*d* attached on an opposite end thereof. A base portion 6040 is provided and includes a base loop 6040' that removably connects to the fourth s-shaped hook 6007*d*.

Preferably, the counter area/element 6020 is shaped as a head, more preferably being a multi-head member having at least two heads; and most preferably being a multi-head member having eight heads as shown. Eight heads are shown which further extend to an abdomen portion with four pairs of arms extending therefrom (see FIG. 2*c;* 1032). Preferably a mid-counter area/element is also provided, optionally including a multi-stomach mid counter area/element, which preferably includes at least four stomach portions forming a four sided portly stomach shown and described hereinabove.

Figure 8:
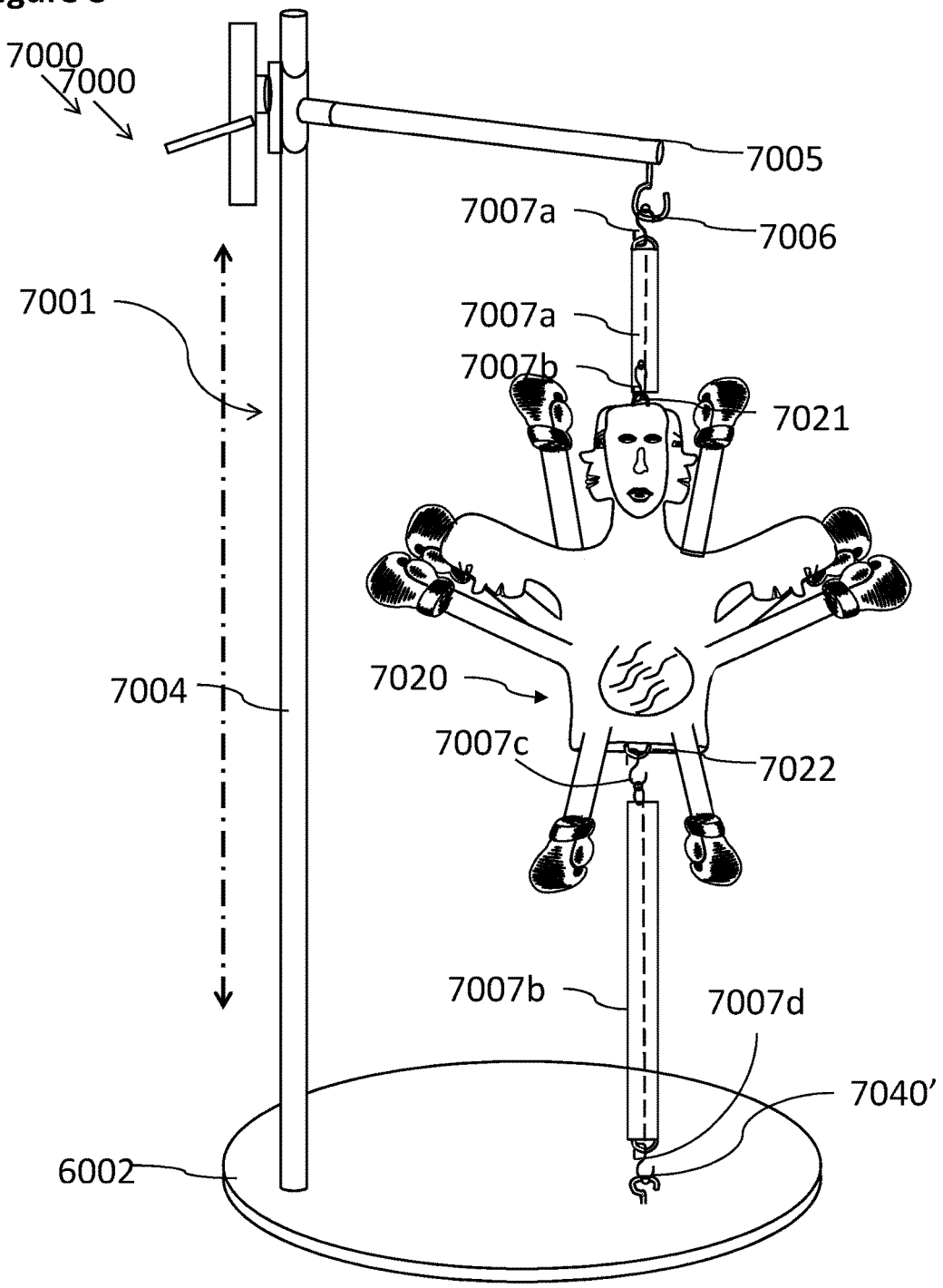
FIG. 8 illustrates a view of an embodiment of the subject invention wherein a free standing multi-head member is provided.

FIG. 8 illustrates a view of an embodiment of the subject invention wherein a free standing slip and counter machine is provided, shown generally at 7000. The free standing fight simulation workout machine 7000 comprises a main support structure 7001 formed herein with a base 7002 having platform 7003. The structure 7001 further includes a vertical pole member 7004 extending upward with movable or height adjustable horizontal pole member 7005 extending horizontally therefrom. Horizontal pole member 7005 can be moved up and down vertical pole member 7004 for height adjustment. On the bottom side of horizontal pole member 7005 is a mounting loop 7006 thereon for attaching a first s-hook 7007*a* thereto, the first s-hook 7007 further is connected to a first cord (bungee) 7008*a*. The other end of first cord 7008*a* in turn is adapted to receive another s-shaped hook 7007*b*. At least one counter area/element 7020 is provided including a top having a u-shaped loop 7021 thereon for receiving second s-shaped hook 7007*b* adapted to be attached to the first cord 7008*a*. The counter area/element 7020 includes a bottom having a u-shaped loop 7022 thereon for receiving a third s-shaped hook 7007*c* adapted to be attached to a second cord 7008*b*, the second cord (bungee) 7008*b* having a fourth s-shaped hook 7007*d* attached on an opposite end thereof. Base portion/platform 7003 include a base loop 7040' that removably connects to the fourth s-shaped hook 7007*d*.

Preferably, the counter area/element 7020 is shaped as a head, more preferably being a multi-head member having at least two heads; and most preferably being a multi-head member having eight heads as shown. Eight heads are shown which further extend to an abdomen portion with four pairs of arms extending therefrom (see FIG. 2*c;* 1032). Preferably a mid-counter area/element is also provided, optionally including a multi-stomach mid counter area/element, which preferably includes at least four stomach portions forming a four sided portly stomach shown and described hereinabove.

In the embodiments shown in FIGS. 6 and 7, the counter elements are interchangeable, including use of the different punch-able members that can be interchanged on the apparatus, including showing the multi-headed member, a single head member, a single stomach member, and the multi-stomach member. These members are shown for example in FIG. 2*c*.

Figure 9A:
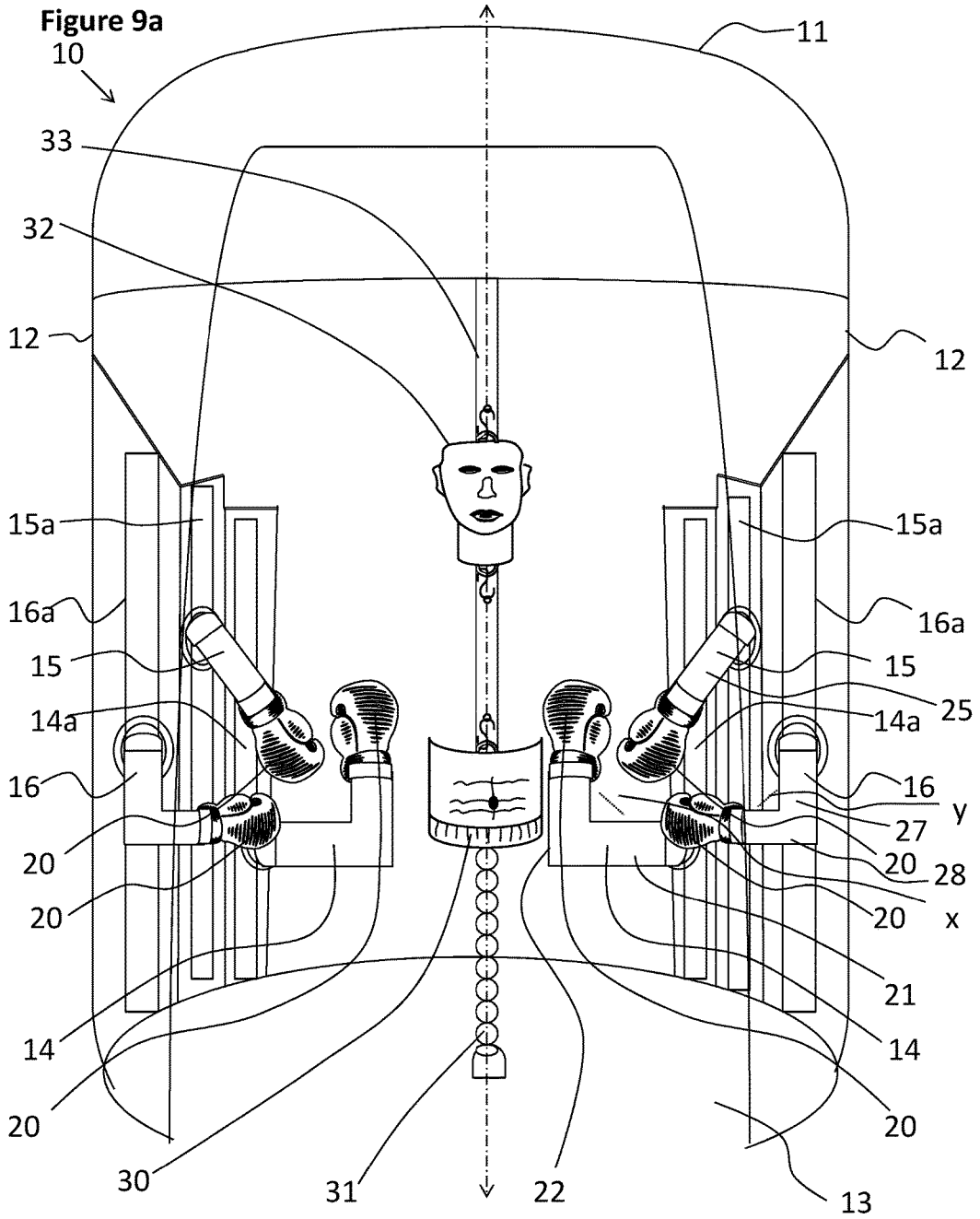
FIG. 9*a* illustrates a perspective view of an embodiment of the fight simulation apparatus of the subject invention.
Figure 9B:
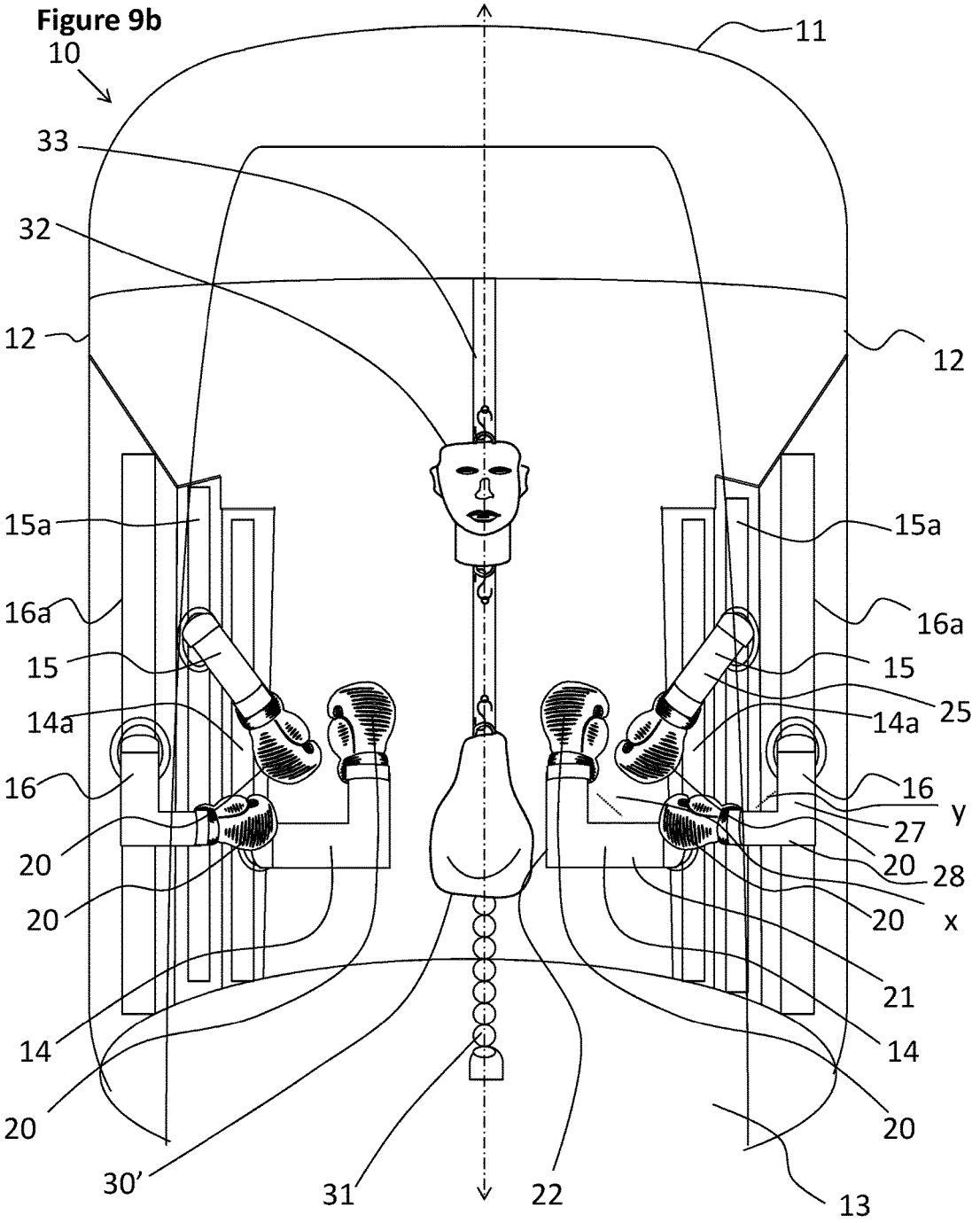
FIG. 9*b* illustrates the perspective view of the embodiment of FIG. 2*a,* however with a round or punch-able mid-section counter area/element.

FIG. 9*a* illustrates a perspective view of an embodiment of the fight simulation/workout machine, shown generally at 10. FIG. 9*b* illustrates the perspective view of the embodiment of FIG. 9*a*, however with a round or punch-able mid/stomach section counter area/element. Referring to FIGS. 9*a* and 9*b*, the fight simulation/workout machine 10 generally includes a U-Shaped construct having a top wall 11, at least two parallel side walls 12 arranged opposite from one another, and a bottom floor mat 13. As used herein, the term "U-Shaped" is meant to be a ground view of the device 10 as one stands directly in front of the device 10. In this manner, a user is appointed to walk into the U-shape between the side walls 12 and is thus substantially surrounded by the device. That is to say, the user's front, and sides are in proximity with the side walls 12 of the device as the user walks inside the U-shape; providing a device 10 having side walls 12 forming an arc ranging from about 90 degrees up to about 270 degrees. Preferably, the side walls 12 are arced or curved and form a semi-circle of about 180 degrees. In this manner, fight simulation is optimized to substantially surround a user who walks into the U-shaped device (sides and front of user).

Wherein the slip and Counter machine includes software and readable memory for various games, the arms may include a sort of strong durable spring, or some type of corrugated material etc. (see, for example, FIG. 17) and sensors may be incorporated. Sensors are preferably located in strategic areas, like on the poles, on the moving mechanism (preferably a turntable at the base, preferably appointed to be inserted inside the slip and counter machine, such as in FIG. 1*a*).

Bottom floor mat 13 may include a sensor therein for activating or turning on the machine 10. Alternatively, the device may be constructed without a bottom floor mat 13 and instead there may simply be a sensor beam located near the bottom of one or more of the side walls 12, or top wall 11. It is further contemplated that the device may be constructed without a top wall 11. In any event, the device includes side walls 12 constructed in a manner so that a user can step into the device 10 and the side walls 12 substantially surround the user in that the side walls 12 are located on the sides and front of the user.

Within side walls 12 there are a series of arms 14, 15, 16 extended within first, second and third slots 14*a*, 15*a*, 16*a*, respectively, that allow the arms to adjust height wise from the floor mat 13, on a substantially vertical plane. The slots 14*a*, 15*a*, 16*a* or tracks are located substantially parallel to one another and are substantially perpendicular to the bottom floor mat 13. Preferably there are three arms 14, 15, 16 as shown, each located in separate slots 14*a*, 15*a*, 16*a* and each being capable of being adjusted along the vertical plane extending from the floor/ground level/or bottom floor mat 13. Each of the arms 14, 15, 16 are spaced and constructed to deliver different punch types/provide different extension ranges for delivery of different punches, as discussed hereinafter.

The arms 14, 15, 16 are provided within slots 14*a*, 15*a*, 16*a* so that the arms 14, 15, 16 vertically traverse the slots 14*a*, 15*a*, 16*a* to accommodate users of varying heights. The arms and slots may include tongue and groove mating means, with teeth and mating slots. Alternatively, hydraulics and/or electronics may be used for movement of the arms 14, 15, 16 along slots 14*a,* 15*a,* and 16*a.*

Each of the arms 14, 15, 16 includes a glove appendage member 20 thereon. Preferably, glove appendage members 20 are removable and different grade glove members 20 are provided, including pillow soft, soft, medium, hard.

Arm 14 includes at least on elbow joint connecting an upper arm portion 21 and a lower arm portion 22 and provides an angle x located there between. FIG. 5 illustrates arm 14, 16 jointed configurations. Arm 14 is appointed to deliver uppercut type punches. Arm 16, like arm 14, includes an elbow joint connecting an upper arm segment 27 and a lower arm segment 28 and provides an angle y located there between. Arm 16 is appointed to deliver hook type punches. Advantageously, the purpose for the elbow joints on the hook arms 16 are for tighter hooks, in case a user prefers fighting up close. The purpose for the elbow joints on the uppercut arms 14 is so the half uppercut-half hook punch can be thrown.

In contrast, arms 15, located centrally between arms 14 and 16, and are preferably constructed on as straight members 25 that are angled downward (or upward) from side walls 12. Preferably, arms 15 slant or angle toward the center of the device 10 and said angle is adjustable as illustrated by way of FIG. 4. As so constructed, arm 15 delivers straight punches. Preferably, arms 15 are provided as telescoping arms as shown in FIGS. 2 and 3.

Continuing with FIGS. 9*a* and 9*b*, counter areas/elements are provided, generally including a mid/stomach section counter area/element 30 (30' in FIG. 9*b:* providing a punchable element like structure embodiment) having a strong cable 31 on it so that it does not move, and a head counter area/element 32 having rubber straps 33 so that it can move a little more, but not as much as a double end bag. Cable 31 may be composed of a flexible material so that the cable 31 gives a little to avoid hurting the user's wrists; alternatively, cable 31 may be composed of a rigid material but in such an event cable 31 has some slack in order to give so it won't hurt the user's wrists. The counter areas are to be positioned in the back and center of the machine, the same way a user's body would be behind his/her arms in the fighting position.

Figure 10A:
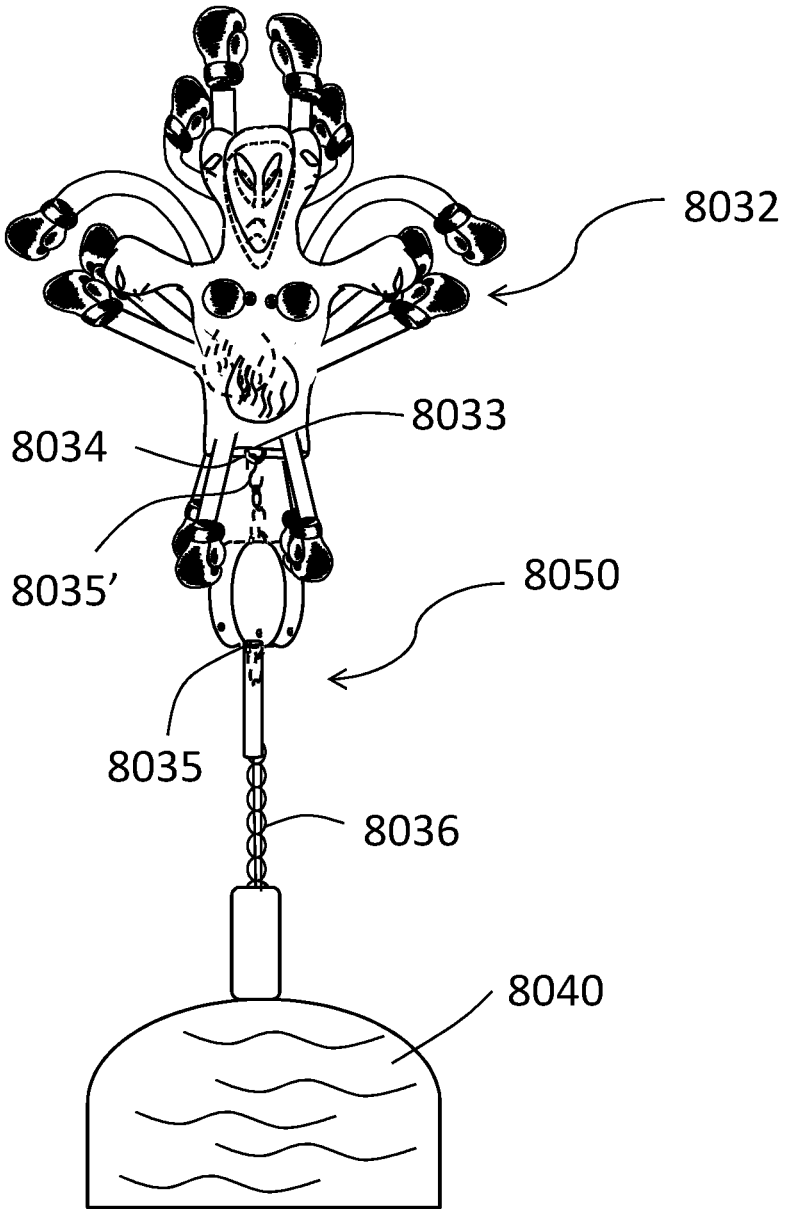
FIG. 10*a* illustrates a perspective view of the embodiment of the fight simulation apparatus of the subject invention where the multi-head, multi-abdomen, and multi-arm apparatus is removed from the slip and counter machine and placed on a free standing apparatus as a punching or kicking bag type structure (for example)
Figure 10B:
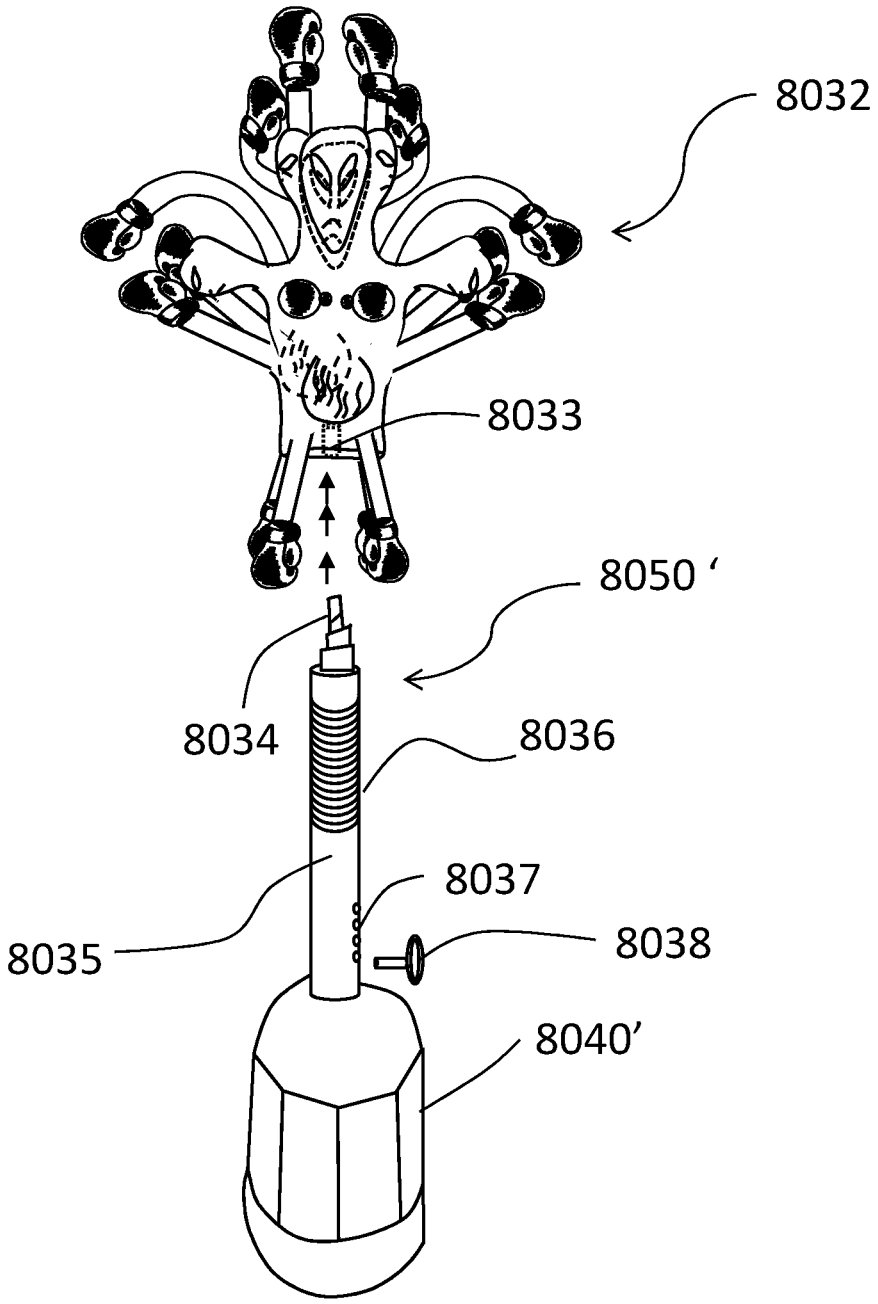
FIG. 10*b* illustrates a perspective view of the embodiment of the fight simulation apparatus of the subject invention where the multi-head, multi-abdomen, and multi-arm apparatus is removed from the slip and counter machine and placed on a free standing apparatus as a punching or kicking bag type structure (for example)

FIGS. 10*a*-10*b* illustrate views of the fight simulation apparatus of the subject invention where the multi-head, multi-abdomen, and multi-arm apparatus 8032 is removed from the slip and counter machine and placed on a free standing apparatus 8050, 8050' as a punching or kicking bag type structure (for example). The heads may arranged to extend from or come out of what would be the chest or/and abdomen. As depicted directly under the two gloves, there's a head, with the back of a head facing the floor (the head may be facing sideways or upward). Multi-arm apparatus 8032 includes a bottom threaded aperture 8033 adapted to receive a threaded member 8034 located on a hook 8035' or a strong flexible spring rod 8035 preferably having a spring member 8036 integrated therein for interchangeability. Height adjustable holes 8037 are provided for adjusting the height of rod 8035 and for insertion of a knob 8038 for securing to a base 8040, 8040' which may be filled with sand or water, or provided as an otherwise heavy base to prevent the apparatus from tipping or falling over.

Figure 11A:
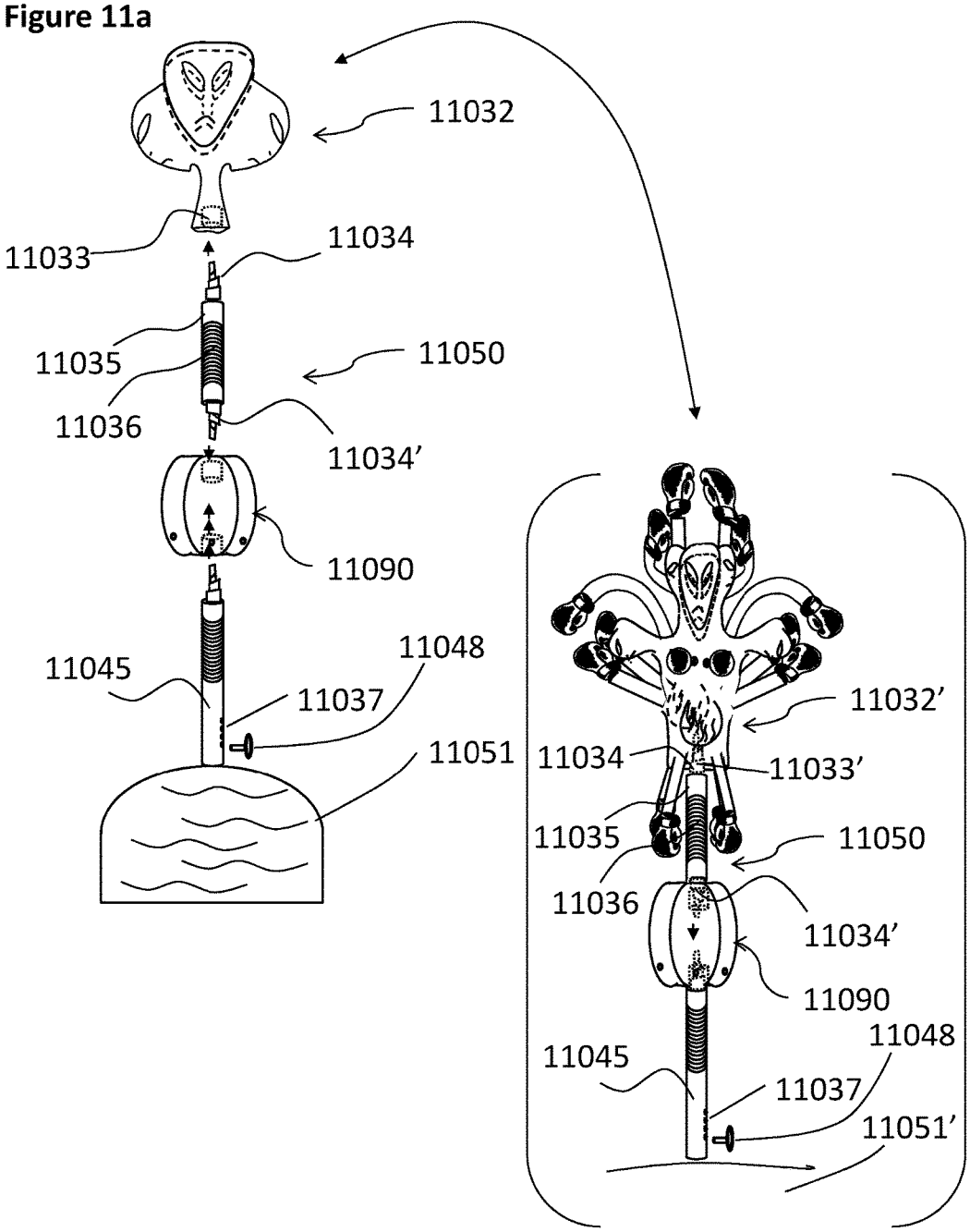
FIG. 11*a* illustrates a perspective view of the embodiment of the fight simulation apparatus of the subject invention where embodiments of interchangeable multi-head apparatuses are removed from the slip and counter machine and placed on a free standing apparatus as punching or kicking bag type structures (for example)
Figure 11B:
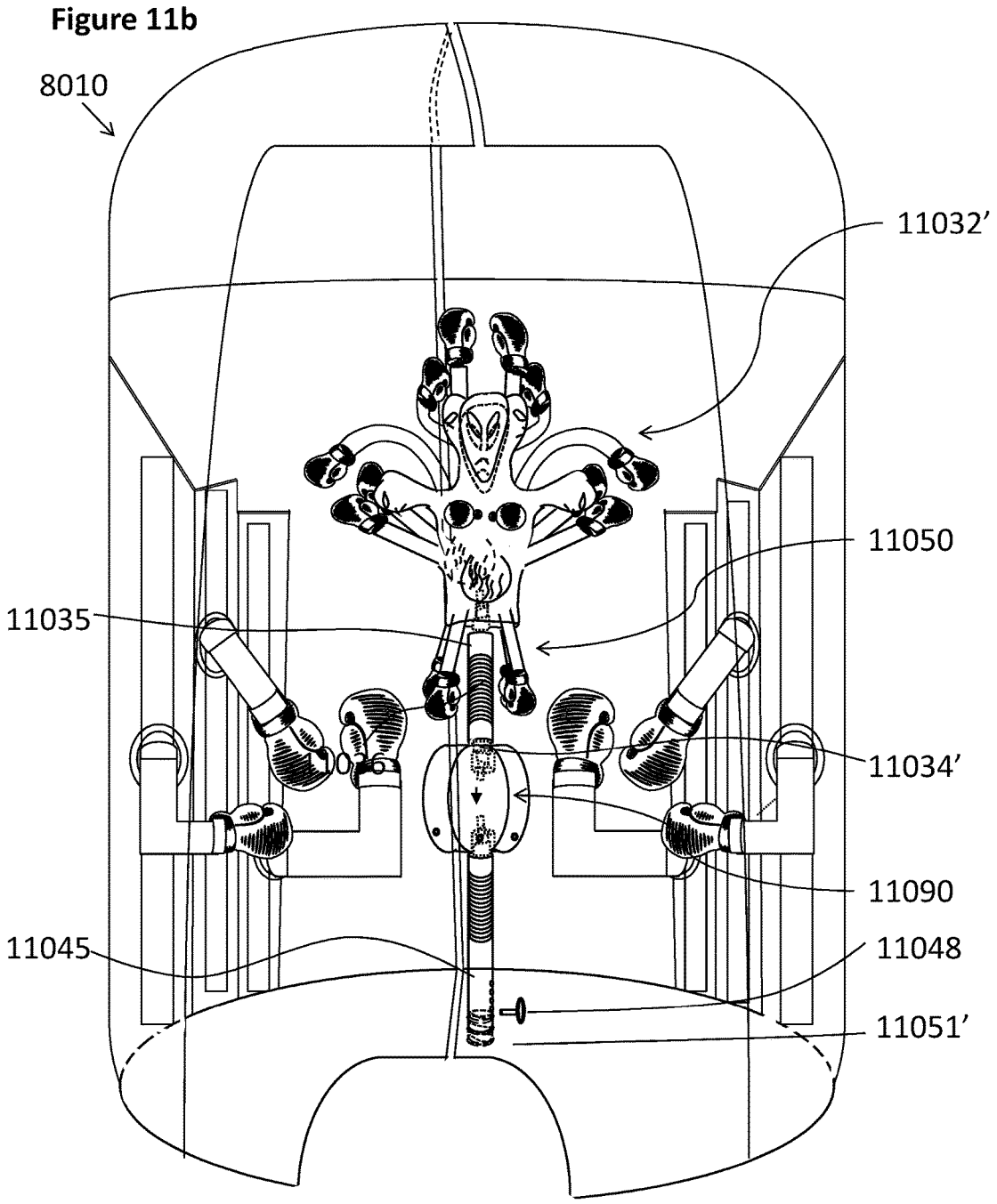
FIG. 11*b* illustrates a perspective view of the embodiment of FIG. 11*a* wherein one of the interchangeable multi-head apparatuses is positioned on the free standing apparatus and the free standing apparatus is placed within the slip and counter machine as a free standing punching or kicking bag type structure (for example) therein.

FIG. 11*a* illustrates a perspective view of the embodiment of the fight simulation apparatus of the subject invention where embodiments of interchangeable multi-head apparatuses 11032, 11032' are removed from the slip and counter machine and placed on a free standing apparatus 11050. FIG. 11*b* illustrates a perspective view of the embodiment of FIG. 11*a* wherein one of the interchangeable multi-head apparatuses 11032' is positioned on the free standing apparatus and placed within the slip and counter machine as a punching or kicking bag type structure (for example) therein. Referring to FIGS. 11*a* and 11*b,* multi-arm apparatus 11032, 11032' include a bottom threaded aperture 11033, 11033' adapted to receive a first threaded member 11034 located on a first strong flexible spring rod 11035 preferably having a spring member 11036 integrated therein. First strong flexible spring rod 11035 includes a second threaded member 11034' adapted to be attached to the base of the device 11051, 11051' (base of the slip and counter 11050 of FIG. 11*b*) or to another interchangeable part, herein shown as a 4-sided portly abdomen 11090. A second strong flexible spring rod 11045 is then attached to the underside of the 4-sided portly abdomen 11090 in the same manner as the first rod 11035. The bottom of the second rod 11045 is in turn attached to base 11051, 11051'. Height adjustable holes 11037 are provided for adjusting the height of rod 11045 and for insertion of a knob 11048 for securing to a base 11051, 11051' which may be filled with sand or water via base 11051 of FIG. 11*a*, or provided as an otherwise heavy base, or comprise the base 11051' of the slip and counter 11050 as shown in FIG. 11*b,* to prevent the apparatus from tipping or falling over.

FIG. 12 illustrates a perspective view of the embodiment of the fight simulation apparatus of the subject invention where a multi-head apparatus being a single head interchangeable part is removed from the slip and counter machine and placed on an adjustable free standing apparatus and is discussed hereinabove.

Figure 13:
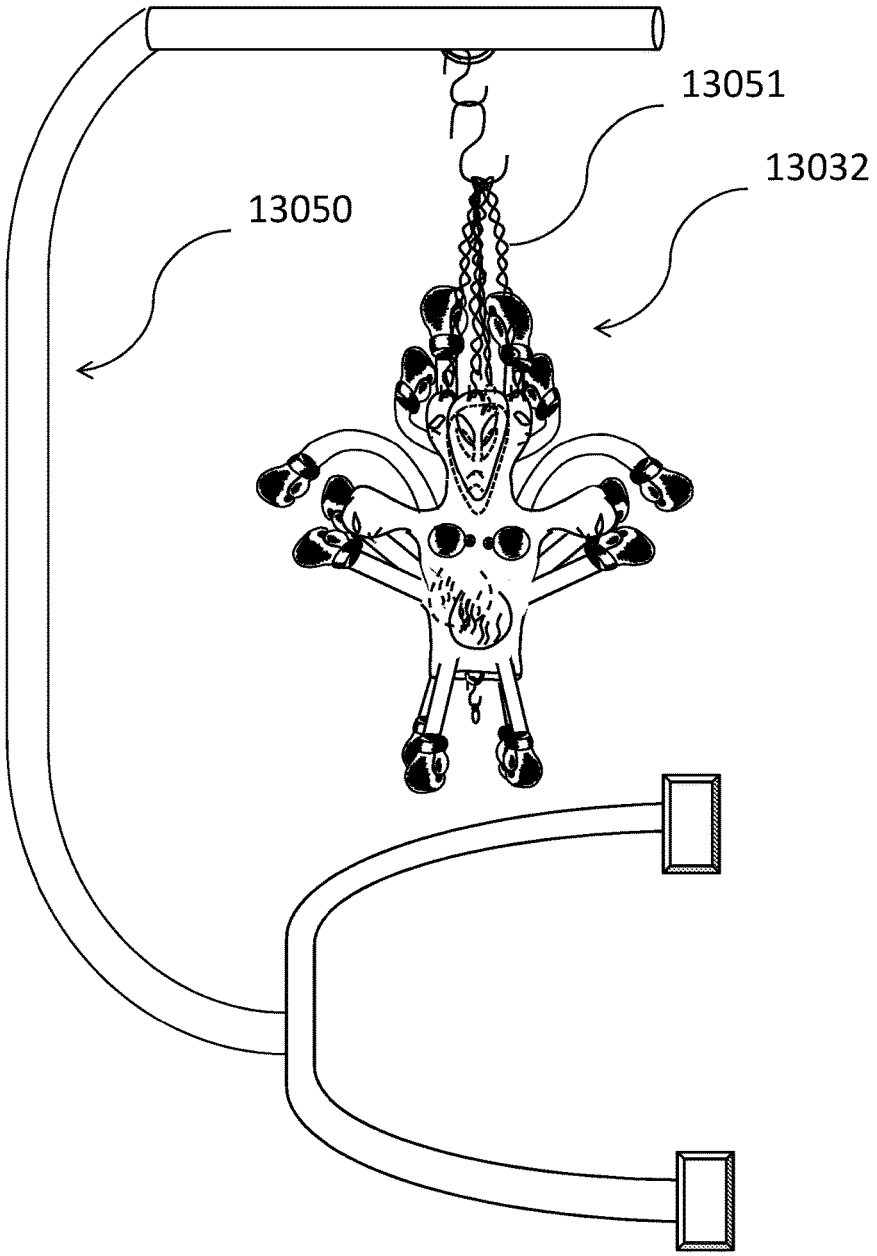
FIG. 13 illustrates a perspective view of the embodiment of the fight simulation apparatus of the subject invention where the multi-head, multi-abdomen, and multi-arm apparatus is removed from the slip and counter machine and placed on a free standing apparatus as a punching or kicking bag type structure (for example)

FIG. 13 illustrates a perspective view of the embodiment of the fight simulation apparatus of the subject invention where the multi-head, multi-abdomen, and multi-arm apparatus 13032 is removed from the slip and counter machine and placed on a free standing apparatus 13050. Bungee cords 13051 are utilized to secure the apparatus 13032 to the free standing apparatus 13050.

Figure 14:
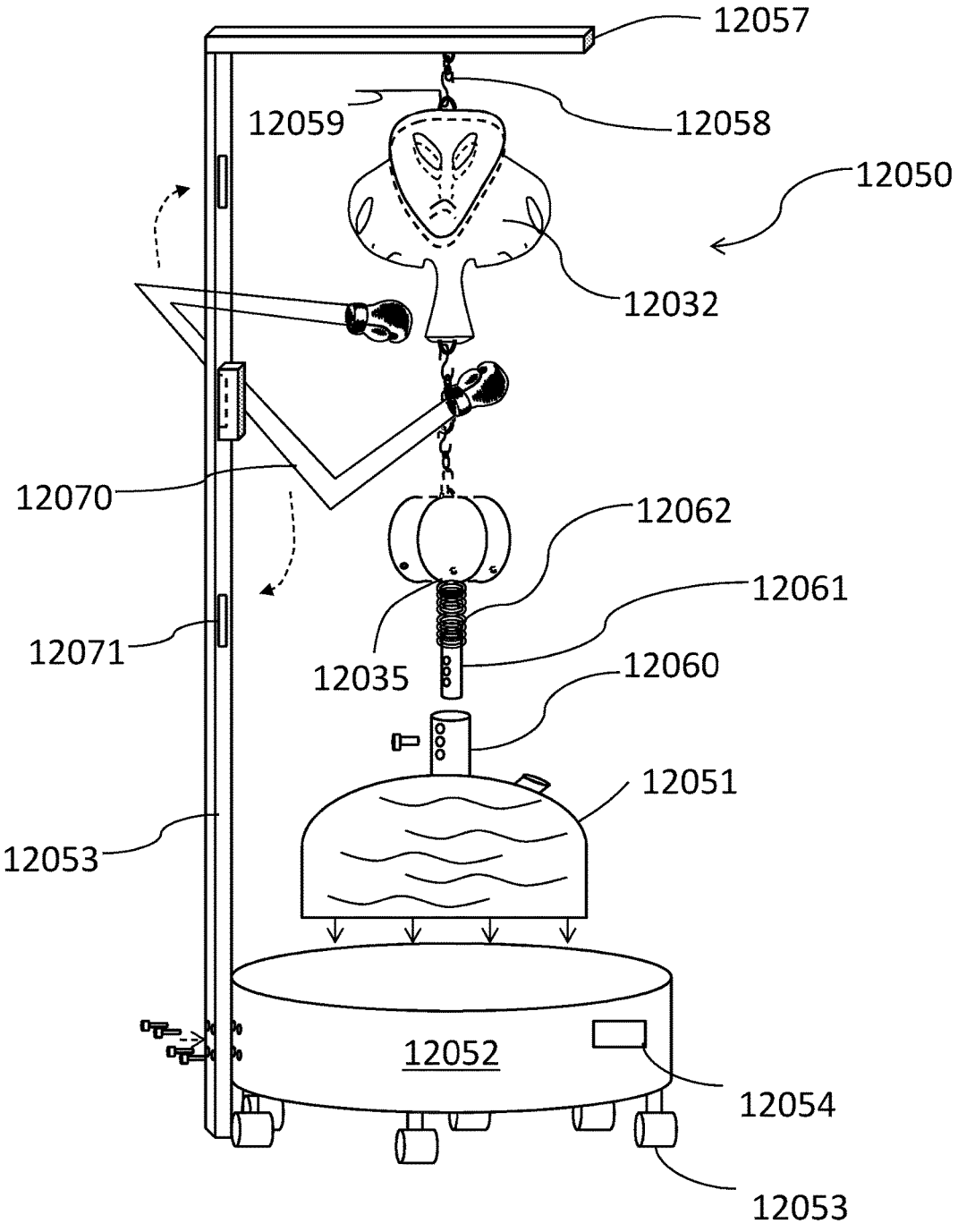
FIG. 14 illustrates a perspective view of the embodiment of the fight simulation apparatus of the subject invention where the multi-head, multi-abdomen, and multi-arm apparatus is removed from the slip and counter machine and placed on a free standing apparatus as a punching or kicking bag type structure (for example)
Figure 15:
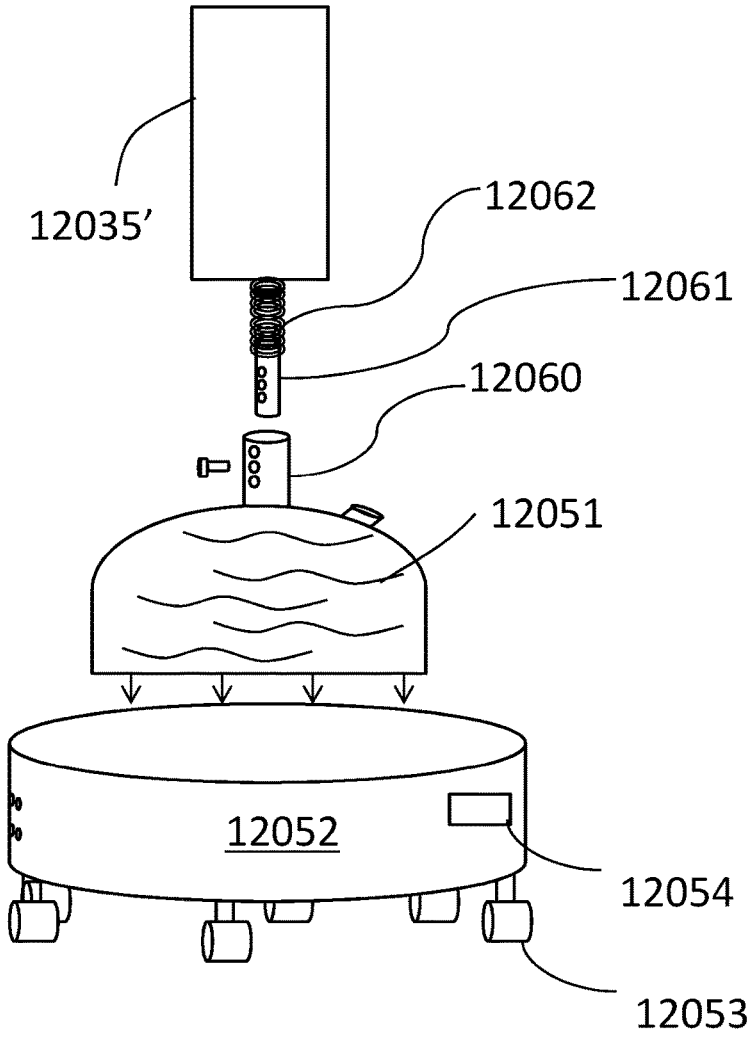
FIG. 15 illustrates a perspective view of the embodiment of the fight simulation apparatus of the subject invention where the multi-head, multi-abdomen, and multi-arm apparatus is removed from the slip and counter machine and placed on a free standing apparatus as a punching or kicking bag type structure (for example)

FIG. 14 illustrates a perspective view of the embodiment of the fight simulation apparatus of the subject invention where the multi-head, multi-abdomen, and multi-arm apparatus is removed from the slip and counter machine and placed on a free standing apparatus as a punching or kicking bag type structure (for example). FIG. 15 illustrates a perspective view of the embodiment of the fight simulation apparatus of the subject invention where the multi-head, multi-abdomen, and multi-arm apparatus is removed from the slip and counter machine and placed on a free standing apparatus as a punching or kicking bag type structure (for example).

Referring to FIGS. 14 and 15, an adjustable free standing apparatus 12050 includes a free standing support pole 12053 having a horizontal support pole 12057 extending therefrom. At least two sets of height-adjustable arms 12070 are located on the base pole support portion 12053 which includes slots 12071 therein and wherein the height-adjustable arms 12070 are capable of being inserted into the slots 12071 for height adjustment. Horizontal support pole 12057 include attachment means (i.e. a hook) 12058 for securing an apparatus thereto. The apparatus may be bungee cords or flexible elastomeric cords 12059 which in turn connect to an interchangeable member, 12032, herein shown as a multi-headed member (optional interchangeable members are shown in FIGS. 1*f* and 2*c*). At the base 12051 a connection means 12060 is provided which in turn may be a threaded connector that is adapted to attach to an insert pole 12061. Alternatively, as illustrated in FIG. 14, the side of the pole 12061 may include pin apertures adapted to align with apertures of connector means 12060 and secured with a pin. Base 12051 may be filled with sand or water, or provided as an otherwise heavy base to prevent the apparatus from tipping or falling over. A base platform 12052 is provided. An interchangeable member 12035 is removably attached to and located in-line with and under multi-headed member 12032.

Base platform 12052 is constructed to be strong and big enough for any apparatus to fit into. Most preferably, the base platform 12052 is constructed to accommodate all the different apparatus of the present invention, including the four sided alien head apparatus with at least one head. The base may be formed by injection molding or other manufacture methods. Base platform 12052 includes a plurality of wheels 12053 that can go in any direction. A sensor 12054 and hardware operable with software can be integrated into base platform 12052 or added as an aftermarket product. The sensor 12054 is preferably hardwired into the base in communication with a small motor that powers wheels 12053 for movement of the base. A power source (battery or wall plug outlet AC/DC) is provided for supplying power to the small motor. A handheld remote control can be provided to communicate with the base platform 12052 for movement, including the following positions: left, right, back, forward, etc. Locking mechanisms may be provided to lock the wheels. Locking mechanisms can include typical wheel lock mechanisms. Wherein the sensor 12054 is provided, it is preferably integrated within the base platform and a program is provided to allow different settings including the sensor can be elected to follow the user, or to move away from the user, or a random or sequential combination of both (follow; move away), or programmed with different workout modules. Various speeds may also be incorporated into the programming of the base platform's movement. Height adjustable holes/adjustable apertures 12054 are located at the bottom of the support pole 12053 along with a tightening knob or pin 12055. If the free standing device 12050 is being utilized in conjunction with the slip and counter machine, doors may be provided in the back of slip and counter machine, located behind each side wall, so that the user would have access to changing the height of the arms.

In FIG. 14, the free standing fight simulation workout machine's interchangeable member, base and base platform are removable from the free standing fight simulation workout machine to provide a separate free standing apparatus, wherein said interchangeable member comprises a kicking bag alone or by itself 12035'. The support structure, wheels, sensors, motors etc. will also work fine if added directly to the apparatus base itself or any apparatus base.

The free standing fight simulation workout machines shown in FIGS. 14 and 15 are readily capable of being placed within the slip and counter workout machine as discussed.

Figure 16:
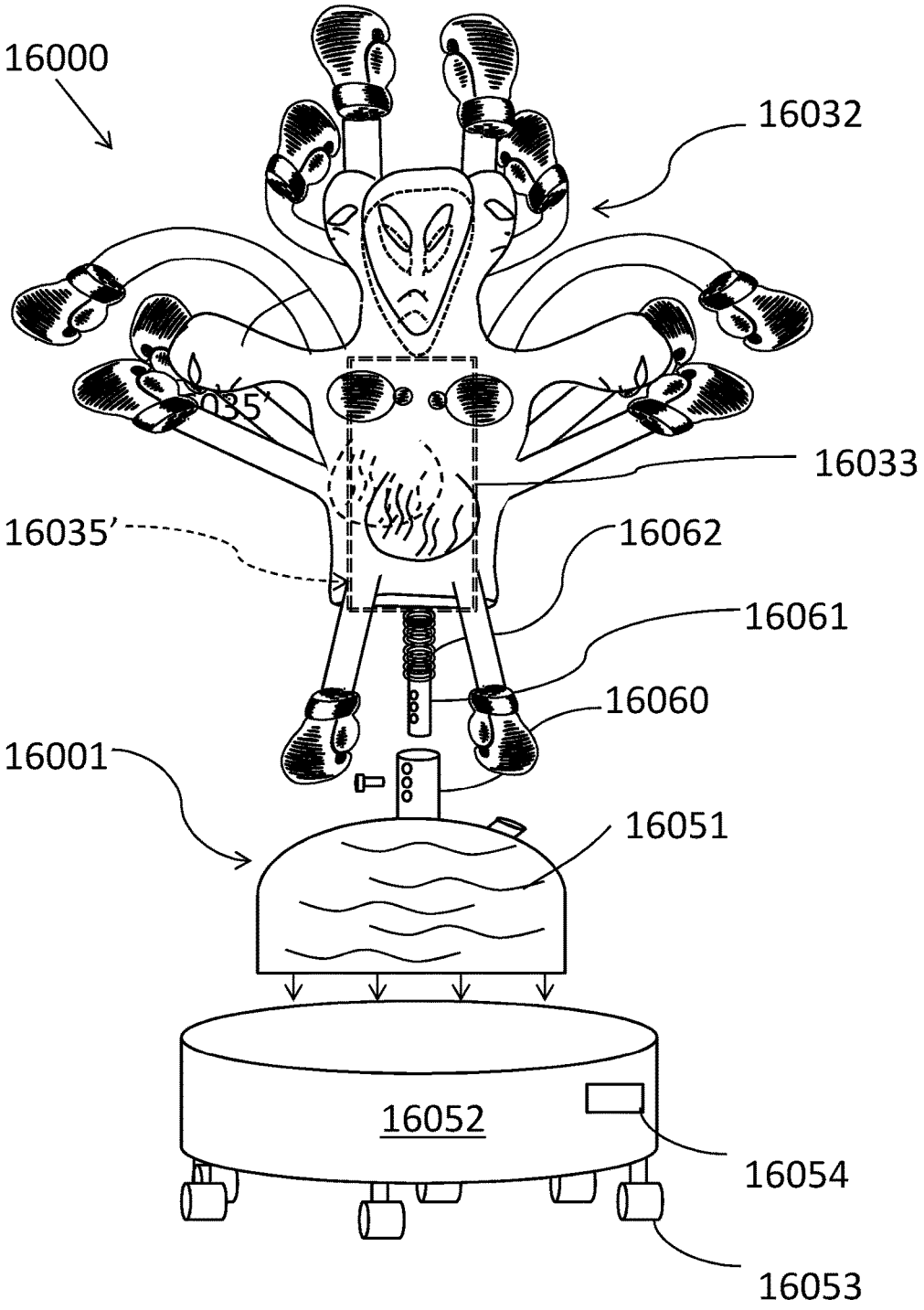
FIG. 16 illustrates an embodiment of a free standing fight simulation workout machine with a fight simulation multi-headed, multi-abdomen, multi-armed apparatus adapted to be placed over the free standing apparatus of FIG. 15.

FIG. 16 illustrates an embodiment of a free standing fight simulation workout machine with a fight simulation multi-headed, multi-abdomen, multi-armed apparatus adapted to be placed over the free standing apparatus of FIG. 15, shown generally at 16000. In this embodiment an adjustable free standing apparatus 16001 is provided similarly to FIG. 15. An interchangeable member 16035', preferably a punching or kicking bag, receives a multi-headed member, herein shown as a multi-headed member 16032 via cavity 16033 located within the multi-headed member. The interchangeable member 16035' is attached to a base 16051 by a connection means 16060, which for example may be a threaded connector that is adapted to attach to an insert pole 16061. Base 16051 may be filled with sand or water, or provided as an otherwise heavy base to prevent the apparatus from tipping or falling over. A base platform 16052 is provided. The base platform 16052 may have a plurality of omni-directionally rotating wheels 16053 adapted to provide movement, and a wheel lock function adapted to lock the wheels in place. A sensor 16054 may be provided. In the embodiment shown, the multi headed/armed apparatus can go over a punching or kicking bag (i.e. interchangeable member 16035') via hollow the center 16033 (i.e. FIG. 10*a* can be arranged with a cavity within the multi-headed member so that it is able to slide onto the punching or kicking bag for instance in FIG. 15).

Figure 17:
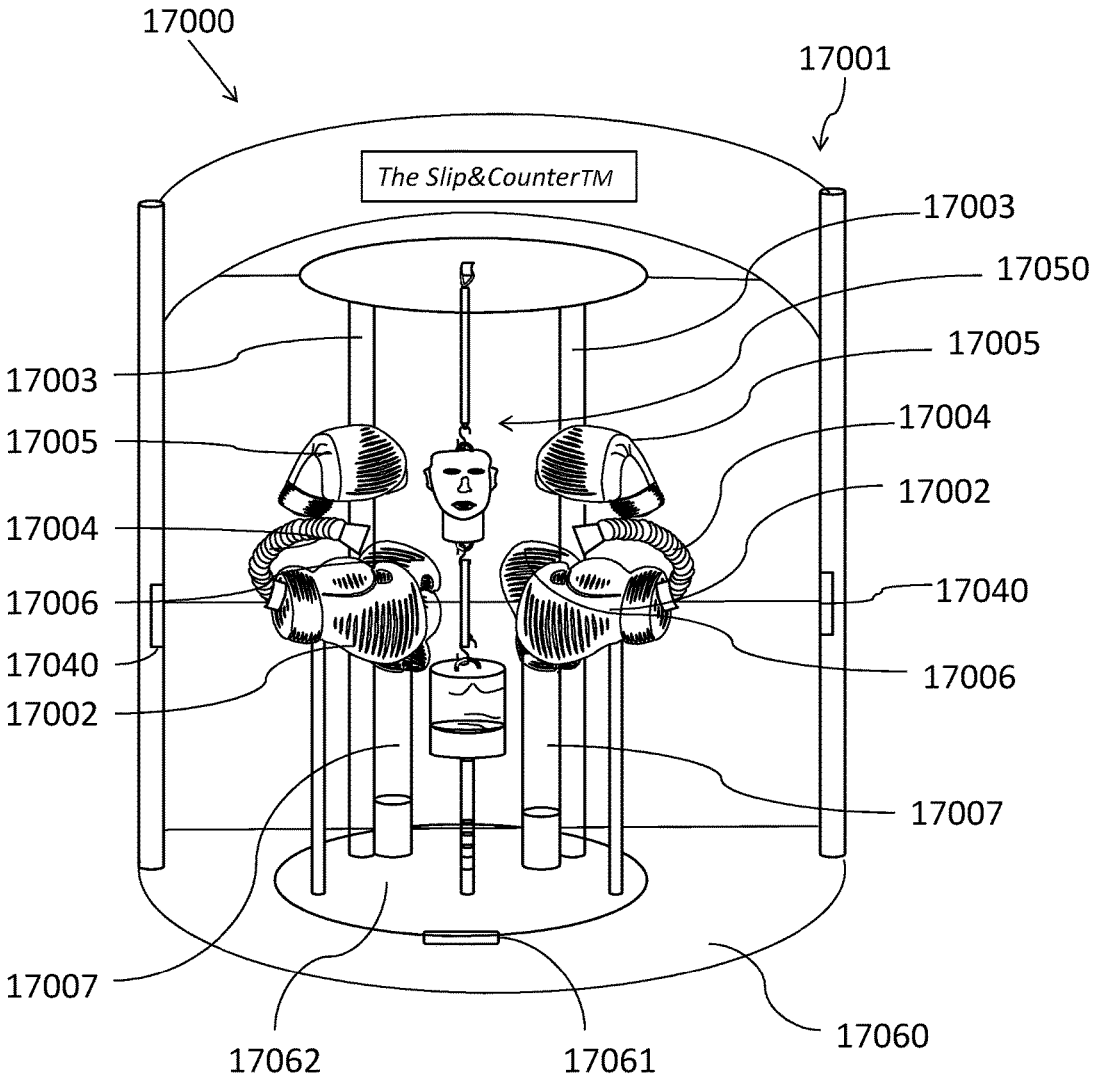
FIG. 17 illustrates another embodiment of the fight simulation workout machine with a fight simulation multi-headed, multi-abdomen, multi-armed apparatus.

FIG. 17 illustrates another embodiment of the fight simulation workout machine with a fight simulation multi-headed, multi-abdomen, multi-armed apparatus, shown generally at 17000. Herein the slip and counter machine is shown at 17001; the interchangeable head, multi-headed, multi-abdomen, multi-armed apparatus is placed inside the slip and counter machine as shown at 17050. The head, multi-headed, multi-abdomen, multi-armed apparatus includes interchangeable punching and kicking bags, as for example shown in FIGS. 1*f*, 2*c*, and 2*d* and is attached to hooks and bungee cords within the slip and counter machine.

The slip and Counter machine 17001 includes arms 17002 with boxing gloves attached to support poles 17003 via a strong durable spring 17004, or some type of flexible corrugated material. Arms 17005 with boxing gloves are also attached to support poles 17003. A set of lower arms 17006 with boxing gloves are located on lower poles 17007. Arms 17002, 17005 and 17006 are provided with boxing gloves for punching and kicking. Sensors 17040. are provided for sensing movement of the boxer and causing corresponding or game-play movements of the arms 17002, 17005 and 17006 with boxing gloves. Sensors 17040 are preferably located in strategic areas, like on the poles, on a moving mechanism (preferably a turntable at the base, preferably appointed to be inserted inside the slip and Counter machine, such as in FIG. 1*a*). Optionally, the sensor or sensors are located in association with a turntable that follows a user's movement by incorporating one or more sensors under a well cushioned mat that the turntable rests on, so that wherever a user moves the turntable follows.

All of the poles and counter areas for user to strike [arms with boxing gloves 17002, 17005 and 17007] may go onto the turntable, and sidewalls may not be necessary, and again the arms may have to be some sort of strong corrugated material or springs or the like. A boxer/user can change out the abdomen area [head, multi-headed, multi-abdomen interchangeable member 17050] and replace it with some sort of kicking bag. A platform is provided 17060 that may be constructed having a turntable 17062 or moving mechanism operable to turn or move by way of the base sensors 17061 to follow the user, which can be turned off or on as needed. (The movable platform configuration may also be utilized in the embodiments throughout, including in FIG. 9*a* for non-limiting example). A single pole for each of the arms may be used, or each arm may be on separate poles or combinations thereof.

The multi-headed member can be made with any durable material and filled with any flexible material and could be pads as oppose to faces or heads. Alternatively, all of the heads and arms may have to be attached to form the multi-headed member. The multi-headed member may be formed as a molded construct as one-piece. Optionally, the multi-headed member may be formed from molding of different components arranged and attached together by adhesive, sewing and the like.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A free standing fight simulation workout machine with a fight simulation multi-headed, multi-abdomen, multi-armed apparatus comprising:

a. at least one main support pole structure having a mounting means for attaching a first s-hook thereto supported by a base pole support portion supporting said height adjustable main support structure;

b. a multi-headed member having at least one head having a mating s-hook adapted to be removably attached on said first s-hook of said main support structure;

c. an interchangeable member, said interchangeable member being removably attached to and being located in-line with and under said multi-headed member;

d. at least one set of height-adjustable arms located on said base pole support portion, said base pole support portion comprising slots therein and wherein said height-adjustable arms are capable of being inserted into said slots for height adjustment;

e. a base in-line with and under said interchangeable member;

f. a base platform having a plurality of omni-directionally rotating wheels adapted to provide movement of said base platform, and having a wheel lock function adapted to lock said wheels in place to make said base platform stationary, said base resting in said base platform.

wherein said head and arms are arranged to provide different punch configurations, so that said multi-head member provides various angles adapted for a user to punch, knee, and/or do a flying knee and said apparatus presents at least two fighting stances.

2. The free standing fight simulation workout machine as recited by claim 1, wherein said base support portion includes at least one slot located at different locations to provide height adjustment of said set of arms.

3. The free standing fight simulation workout machine as recited by claim 1 further comprising at least one abdomen section located under said multi-headed member.

4. The free standing fight simulation workout machine as recited by claim 3, wherein said abdomen section is not connected to said multi-headed member and is provided as said interchangeable member.

5. The free standing fight simulation workout machine as recited by claim 4, wherein said interchangeable member comprises a kicking bag or pad.

6. The free standing fight simulation workout machine as recited by claim 1, wherein said base platform comprises a sensor, a motor, power source, programmable storage media, and various speed settings so that said base platform is adapted to move in relation to a user.

7. The free standing fight simulation workout machine as recited by claim 1, wherein said base platform comprises a remote control in communication with a motor, power source, antenna and receiver, and various speed settings so that said base platform is adapted to be remotely controlled and moved in relation to a user.

8. The free standing fight simulation workout machine as recited by claim 1, wherein said base is filled with a substance to provide a bottom heavy base.

9. The free standing fight simulation workout machine as recited by claim 1 further comprising a slip and counter workout machine having at least two substantially parallel opposing side walls having arms with interchangeable appendages, and wherein said multi-headed, multi-abdomen, multi-armed apparatus is centered in said slip and counter workout machine.

10. The free standing fight simulation workout machine as recited by claim 9, wherein said interchangeable appendages comprise gloves, punching mitts, human heads, animal heads, insect heads, alien heads, scary zombie heads, faces, balls with faces and interchangeable masks, or combinations thereof.

11. The free standing fight simulation workout machine as recited by claim 1, wherein said multi-headed member is removable and replaceable with an interchangeable member.

12. The free standing fight simulation workout machine as recited by claim 1, wherein said multi-headed member has an abdomen and at least one set of arms integrated therein to form a unilateral or single molded unit.

13. The free standing fight simulation workout machine as recited by claim 1 further comprising a system of interchangeable members including a single head arranged on a single abdomen member, a four sided multi-headed member arranged on a multi-abdomen member, a four sided cross-shaped pad member, all being interchangeable with one another.

14. The free standing fight simulation workout machine as recited by claim 1, wherein said multi-headed member and interchangeable member are attached by way of expandable or elastic cords, bands or springs.

15. The free standing fight simulation workout machine as recited by claim 1, wherein said multi-headed member includes a bottom part having at least one neck and on the bottom of that neck a proximal end of a bungee cord or a spring is clamped or hooked onto said neck, and wherein a distal end of said bungee cord or a spring is hooked onto a top of said interchangeable member.

16. The free standing fight simulation workout machine as recited by claim 1, wherein said interchangeable member is formed as an abdomen.

17. The free standing fight simulation workout machine as recited by claim 16, wherein said interchangeable member is formed as a four sided abdomen.

18. The free standing fight simulation workout machine as recited by claim 1, wherein said interchangeable member has a bottom having an elastic cord or spring removably attached to a height adjustable pole that extends down into said base.

19. The free standing fight simulation workout machine as recited by claim 1, wherein said base platform includes attachment means for attachment to said base support portion.

20. The free standing fight simulation workout machine as recited by claim 1, wherein said interchangeable member, base and base platform are removable from said free standing fight simulation workout machine to provide a separate free standing apparatus, wherein said interchangeable member comprises a kicking bag alone with base and base platform.

21. The free standing fight simulation workout machine as recited by claim 1 further comprising a slip and counter workout machine comprising at least two substantially parallel opposing side walls and wherein said multi-headed, multi-abdomen, multi-armed apparatus is centered in said slip and counter workout machine.

22. The free standing fight simulation workout machine as recited by claim 21, wherein said height-adjustable arms are adapted to strike a user simultaneously.

23. The free standing fight simulation workout machine as recited by claim 21, wherein said base support comprises a pole having slots therein and wherein said height-adjustable arm is located on said pole.

24. The free standing fight simulation workout machine as recited by claim 23, wherein said pole includes at least one height-adjustable arm providing six arms, and wherein said pole is adapted to be placed in proximity to said side walls.

25. The free standing fight simulation workout machine as recited by claim 21, wherein a floor is provided and said floor is on a turntable platform to provide rotation and movement.

26. The free standing fight simulation workout machine as recited by claim 21 further comprising game selection.

27. A free standing fight simulation workout machine as recited by claim 26, wherein said slip and counter workout machine comprises a counter, said game selection comprises a game #1 wherein said counter is adapted to count the number of punches a user ducks during a preselected time interval, and said user will be able to increase speed of arms and turntable when necessary.

28. The free standing fight simulation workout machine as recited by claim 26, wherein said slip and counter workout machine comprises a sensor and a counter, said game selection comprises a game #2 wherein said counter is adapted to count the number of strikes during a preselected time interval, said user will be able to increase speed of arms and turntable when necessary, and wherein said arms are operable based on a program to sometimes strike said user simultaneously, wherein said user wins by having more striking points than said fight simulation workout machine in said amount of time.

29. The free standing fight simulation workout machine as recited by claim 26, wherein said slip and counter workout machine comprises a sensor and a counter, said game selection comprises a game #3 wherein said arms include appendages that are removable and interchangeable, said appendages comprising gloves comprising boxing type punching mitts, scary zombie, animals, faces and different types of heads, and wherein said appendage when placed on said arms will randomly or in a programmable way jump out towards a user, as if to bite said user, then said user will have a set amount of time to strike said appendage before it retracts back into place, thus accumulating points.

30. The free standing fight simulation workout machine as recited by claim 21 wherein: a) each of said side walls includes at least one, preferably at least two, height-adjustable arms traversing slots, b) a glove appendage member is located on a proximate end of each of said arms, c) at least one counter area/counter element is provided, and d) the arms are located on the side walls and arranged in a manner as to provide different punch configurations, including hook punches, straight punches or uppercuts and uppercut type punches, respectively.

31. The free standing fight simulation workout machine as recited by claim 1, wherein said multi-headed member comprises at least one abdomen section and said at least one head is arranged to extend from or come out of said abdomen section.

32. The free standing fight simulation workout machine as recited by claim 1, wherein said multi-headed member comprises a cavity adapted to receive and fit over a punching bag.

* * * * *